US005376513A

United States Patent [19]

Mihayashi

[11] Patent Number: 5,376,513

[45] Date of Patent: Dec. 27, 1994

[54] SILVER HALIDE COLOR PHOTOGRAPHIC LIGHT-SENSITIVE MATERIALS

[75] Inventor: Keiji Mihayashi, Ashigara, Japan

[73] Assignee: Fuji Photo Film Co., Ltd., Kanagawa, Japan

[21] Appl. No.: 149,529

[22] Filed: Nov. 9, 1993

Related U.S. Application Data

[63] Continuation of Ser. No. 773,270, Oct. 9, 1991, abandoned.

[30] Foreign Application Priority Data

Oct. 12, 1990 [JP] Japan ..... 2-273572

[51] Int. Cl.[5] ..... G03C 7/333; G03C 7/36

[52] U.S. Cl. ..... 430/504; 430/359; 430/505; 430/549; 430/552; 430/553; 430/556; 430/557; 430/558; 430/562; 430/955

[58] Field of Search ..... 430/359, 549, 553, 562, 430/543, 556, 557, 558, 955, 504, 505, 552

[56] References Cited

U.S. PATENT DOCUMENTS

| | | | |
|---|---|---|---|
| Re. 27,848 | 5/1964 | Weissberger et al. | 430/556 |
| 3,265,506 | 8/1966 | Weissberger et al. | 430/556 |
| 4,072,525 | 2/1978 | Inouye et al. | 430/387 |
| 4,146,396 | 3/1979 | Yokota et al. | 430/387 |
| 4,268,591 | 5/1981 | Tschopp | 430/556 |
| 4,439,513 | 3/1984 | Sato et al. | 430/203 |
| 4,647,527 | 3/1987 | Ikenoue et al. | 430/504 |
| 4,833,069 | 5/1989 | Hamada et al. | 430/552 |
| 5,064,753 | 11/1991 | Sohei et al. | 430/567 |
| 5,075,207 | 12/1991 | Langen et al. | 430/556 |
| 5,112,730 | 5/1992 | Ohkawa et al. | 430/226 |
| 5,118,599 | 6/1992 | Lau et al. | 430/558 |

FOREIGN PATENT DOCUMENTS

| | | |
|---|---|---|
| 1221748 | 10/1986 | Japan . |
| 3304242 | 12/1988 | Japan . |

*Primary Examiner*—Lee C. Wright

*Attorney, Agent, or Firm*—Birch, Stewart, Kolasch & Birch

[57] ABSTRACT

A silver halide color photographic light-sensitive material comprising a support having thereon at least one light-sensitive silver halide emulsion layer, wherein the light-sensitive material contains a yellow colored cyan coupler and an acylacetamide yellow dye forming coupler having an acyl moiety represented by the general formula (A):

(A)

wherein $R_1$ represents a univalent group, Q represents a group of non-metal atoms required to form, together with C, a three to five membered hydrocarbon ring or a three to five membered heterocyclic ring which has within the ring at least one hetero atom selected from among N, O, S and P, with the proviso that $R_1$ is not a hydrogen atom and it does not join with Q to form a ring.

22 Claims, No Drawings

SILVER HALIDE COLOR PHOTOGRAPHIC LIGHT-SENSITIVE MATERIALS

This application is a continuation of application Ser. No. 07/773,270 filed on Oct. 9, 1991, now abandoned.

FIELD OF THE INVENTION

The present invention relates to silver halide color photographic light-sensitive materials, and more precisely to silver halide color photographic light-sensitive materials in which yellow colored cyan couplers and novel acylacetamide type yellow dye forming couplers are used.

BACKGROUND OF THE INVENTION

Color reproduction is one of the various characteristics which are required of silver halide color photographic light-sensitive materials (referred to hereinafter simply as light-sensitive materials).

The use of colored couplers in color negative photographing materials, for example, for correcting the unwanted absorptions of the colored images, is one means of improving color reproduction. Disclosures concerning these colored couplers have been made in many publications and patents, and as one example reference can be to the disclosures made in *Research Disclosure,* No. 17643, section VII-G.

So-called magenta colored cyan couplers which have a peak absorption wavelength in the visible region in the range from about 500 to 600 nm, and which undergo a coupling reaction with the oxidized product of a primary aromatic amine developing agent and form cyan images which have an absorption peak wavelength of about 630–750 nm are used at the present time in order to correct the unwanted absorptions of the cyan image using colored couplers.

However, the visible region absorbance of the cyan image also has an absorbance in the region of 400–500 nm. If these unwanted absorptions are corrected by means of a so-called yellow colored coupler, an effect resembling photographically the inter-layer effect can be obtained in the yellow colored image layer from the cyan colored image and it can be anticipated that this will be desirable from the viewpoint of color reproduction, and this possibility has been disclosed, for example, in JP-A-61-221748 and JP-A-1-319744. (The term "JP-A" as used herein signifies an "unexamined published Japanese patent application".)

However, the conventional yellow colored cyan couplers, including the compounds disclosed in the two JP-A specifications mentioned above, may not have satisfactory color forming properties, or they may have to be used in large coated weights in order to provide the density which is required because they have a low molecular extinction coefficient. Moreover, these conventional couplers have problems in that the storage properties of the manufactured light-sensitive material prior to color development processing are poor and the colored picture is susceptible to considerable fading. These problems are obstacles to the use of these conventional couplers and they cannot be said to have reached a practical stage at the present time.

On the other hand, acylacetamide couplers and malondianilide couplers are generally used as yellow dye forming couplers (referred to hereinafter as yellow couplers) for forming the yellow image.

The yellow dyes obtained from these couplers are generally formed in a silver halide emulsion layer which is color sensitive to radiation which has a complementary color relationship to the radiation which is adsorbed by the dye, or in a layer adjacent thereto.

Moreover, acylacetamide couplers as typified by the benzoylacetanilide couplers and pivaloylacetanilide couplers are generally used as yellow couplers, and especially for image forming purposes. The former generally have a high coupling activity with the oxidized product of a color developing agent during development and, since the molecular absorption coefficients of the yellow dyes which are produced are high, they are used in the main in color light-sensitive materials for photographing, and especially in color negative films, where a high photographic speed is required. The latter are such that the spectral absorption characteristics and fastness of the yellow dyes are excellent and so in the main they are used in color papers and color reversal films.

However, although the coupling reactivity with the oxidized product of a primary aromatic amine developing agent during color development is high and the molecular extinction coefficient of the yellow azomethine dye which is formed is high with a benzoylacetanilide coupler, there is a disadvantage in that the spectral absorption characteristics of the yellow image are poor. Although the spectral characteristics of the yellow image are excellent with a pivaloylacetanilide coupler, the coupling reactivity with the oxidized product of a primary aromatic amine developing agent during development is low and there is a further disadvantage here in that the molecular extinction coefficient of the yellow azomethine dye which is formed is small.

A high coupling reactivity of a coupler and a large molecular extinction coefficient of the dye which is formed enables high photographic speeds, high gamma values and high color densities to be obtained, and provides so-called high color forming properties. Furthermore, excellent spectral absorption characteristics for the yellow image means that there is a good cut-off on the long wavelength side of the spectral absorption, for example, and that the absorption characteristics have little unwanted absorption in the green region.

Hence, the couplers which provide both advantages, which is to say which provide high color forming properties (high coupler coupling reactivity, large dye molecular extinction coefficient and high yellow dye fastness) and colored images which have excellent spectral absorption characteristics would be very desirable.

As acyl groups for acylacetanilide couplers, the pivaloyl group, the 7,7-dimethylnorbornane-1-carbonyl group and the 1-methylcyclohexane-1-carbonyl group for example have been suggested in U.S. Pat. No. 3,265,506 (U.S. Pat. Re No. 27,848) and the cyclopropane-1-carbonyl group and the cyclohexane-1-carbonyl group, for example, have been suggested in JP-A-47-26133. However, these couplers sometimes have a poor coupling reactivity and consequently the variation in photographic properties due to processing fluctuations during color development processing are sometimes considerable. In addition, the molecular extinction coefficient of the dye is sometimes small or there are problems with poor spectral absorption characteristics of the colored image and with the fastness of the colored image.

Moreover, with the benzoylacetanilide couplers and pivaloylacetanilide couplers which are typical acylacetanilide couplers, couplers which have oil soluble ballast groups within the molecule are mixed with and dissolved in a high boiling point organic solvent and finely dispersed to form a dispersion which is mixed with silver halide to prepare a color light-sensitive material. When this is done there is a disadvantage in that the photographic speed and the color density are reduced when the amount of high boiling point organic solvent added per unit weight of coupler is reduced.

SUMMARY OF THE INVENTION

The first object of the invention is to provide silver halide color photographic light-sensitive materials which have improved color reproduction.

The second object of the invention is to provide silver halide color photographic light-sensitive materials with high activity, wherein the fluctuation in photographic properties which accompanies processing fluctuations is reduced and wherein stable photographic properties can be obtained.

The third object of the invention is to provide silver halide color photographic light-sensitive materials in which the colored images which are obtained are fast and have a colored image fastness which has a good tri-color balance (e.g., yellow, cyan and magenta).

The fourth object of the invention is to provide silver halide color photographic light-sensitive materials in which the fluctuation in photographic properties on aging the light-sensitive material prior to development processing is improved.

It has been discovered that the above mentioned objects of the invention can be realized by means of a silver halide color photographic light-sensitive material comprising a support, having thereon at least one silver halide emulsion layer, wherein there are included a yellow colored cyan coupler and an acylacetamide yellow dye forming coupler having an acyl moiety represented by the general formula (A) indicated below.

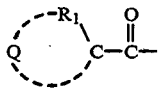

(A)

In formula (A), $R_1$ represents a univalent group. Q represents a group of non-metal atoms which is required to form, together with C, a three to five membered hydrocarbon ring or a three to five membered heterocyclic ring which has within the ring at least one hetero-atom selected from among N, O, S and P. However, $R_1$ is not a hydrogen atom and it does not join with Q to form a ring.

DETAILED DESCRIPTION OF THE INVENTION

The invention is described in detail below.

The preferred acylacetamide yellow couplers of the present invention are represented by the general formula (Y):

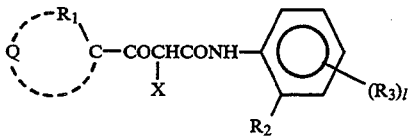

(Y)

wherein $R_1$ represents a univalent group other than a hydrogen atom, Q represents a group of non-metal atoms which forms, together with C, a three to five membered hydrocarbon ring or a three to five membered heterocyclic ring which contains within it at least one hetero-atom selected from among N, S, O and P, $R_2$ represents a hydrogen atom, a halogen atom (F, Cl, Br, I (same in the description of formula (Y) below)), an alkoxy group, an aryloxy group, an alkyl group or an amino group, $R_3$ represents a group which can be substituted on a benzene ring, X represents a hydrogen atom or a group (referred to hereinafter as a leaving group) which can be eliminated by means of a coupling reaction with the oxidized product of a primary aromatic amine developing agent, and l represents an integer from 0 to 4. Furthermore, in those cases where l is 2 or more, the $R_3$ groups may be the same or different.

Examples of $R_3$ include halogen atoms, alkyl groups, aryl groups, alkoxy groups, aryloxy groups, alkoxycarbonyl groups, aryloxycarbonyl groups, carboxamido groups, sulfonamido groups, carbamoyl groups, sulfamoyl groups, alkylsulfonyl groups, ureido groups, sulfamoylamino groups, alkoxycarbonylamino groups, alkoxysulfonyl groups, acyloxy groups, a nitro group, heterocyclic groups, a cyano group, acyl groups, alkylsulfonyloxy groups and arylsulfonyloxy groups. Examples of leaving groups include heterocyclic groups which are bonded to the coupling active site by a nitrogen atom, aryloxy groups, arylthio groups, acyloxy groups, alkylsulfonyloxy groups, arylsulfonyloxy groups, heterocyclic oxy groups and halogen atoms.

In the present invention an acyl moiety in a group includes an aliphatic and aromatic acyl moiety.

When $R_1$, $R_2$, $R_3$ and X in formula (Y) are alkyl groups or contain alkyl groups, and if there is no particular limitation, the term alkyl group signifies a linear chain, branched chain or cyclic, substituted or unsubstituted alkyl group (for example, methyl, isopropyl, tert-butyl, cyclopentyl, tert-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, phenoxyethyl).

When $R_1$, $R_2$, $R_3$ and X in formula (Y) are aryl groups or contain aryl groups, and if there is no particular limitation, the term aryl group signifies a substituted or unsubstituted single ring or condensed ring aryl group (for example, phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-tert-pentylphenyl, p-methanesulfonamidophenyl, 3,4-dichlorophenyl).

When $R_1$, $R_2$, $R_3$ and X in formula (Y) are heterocyclic groups or contain heterocyclic groups, and if there is no particular limitation, a heterocyclic group signifies a substituted or unsubstituted three to eight membered single ring or condensed ring heterocyclic group containing at least one hetero-atom selected from among O, N, S, P, Se and Te (for example, 2-furyl, 2-pyridyl, 4-pyridyl, 1-pyrazolyl, 1-imidazolyl, 1-benzotriazolyl, 2-benzotriazolylsic), succinimido, phthalimido, 1-benzyl-2,4-imidazolidindione-3-yl).

The preferred substituent groups for use in formula (Y) are described below.

$R_1$ in formula (Y) is preferably a halogen atom, a cyano group or a univalent group which has a total number of carbon atoms (referred to hereinafter as the C-number) from 1 to 30 (for example alkyl, alkoxy, acyl, amino) or from 6 to 30 (for example aryl, aryloxy), which may be further substituted, and the substituent groups may be, for example, halogen atoms, alkyl groups, aryl groups, alkoxy groups, a nitro group, substituted or unsubstituted amino groups, carbonamido groups, sulfonamido groups or acyl groups.

Q in formula (Y) preferably represents a group of non-metal atoms which, together with C, is required to form a three to five membered hydrocarbon ring of C-number from 3 to 30 or a heterocyclic ring of C-number from 2 to 30 which contains within the ring at least one hetero-atom selected from among N, S, O and P, which may be substituted with substituent groups. Furthermore, the rings formed by Q together with C may contain unsaturated bonds within the ring. Examples of rings formed by Q together with C include cyclopropane, cyclobutane, cyclopentane, cyclopropene, cyclobutene, cyclopentene, oxetene, oxolane, 1,3-dioxolane, thietane, thiolane and pyrrolidine rings. Examples of substituent groups include halogen atoms, a hydroxyl group, alkyl groups, aryl groups, acyl groups, alkoxy groups, aryloxy groups, a cyano group, alkoxycarbonyl groups, alkylthio groups, and arylthio groups.

$R_2$ in formula (Y) preferably represents a halogen atom, an alkoxy group of C-number from 1 to 30, an aryloxy group of C-number from 6 to 30, an alkyl group of C-number from 1 to 30 or an amino group of C-number from 0 to 30, and these groups may be substituted with substituent groups, and examples of the substituent include halogen atoms, alkyl groups, alkoxy groups and aryloxy groups. When the amino group is a substituted amino group the substituents may be connected to each other to form a heterocyclic group containing the N atom in the amino group.

$R_3$ in formula (Y) is preferably a halogen atom or an alkyl group of C-number from 1 to 30, an aryl group of C-number from 6 to 30, an alkoxy group of C-number from 1 to 30, an alkoxycarbonyl group of C-number from 2 to 30, an aryloxycarbonyl group of C-number from 7 to 30, a carbonamido group of C-number from 1 to 30, a sulfonamido group of C-number from 1 to 30, a carbamoyl group of C-number from 1 to 30, a sulfamoyl group of C-number from 0 to 30, an alkylsulfonyl group of C-number from 1 to 30, an arylsulfonyl group of C-number from 6 to 30, a ureido group of C-number from 1 to 30, a sulfamoylamino group of C-number from 0 to 30, an alkoxycarbonylamino group of C-number from 2 to 30, a heterocyclic group of C-number from 1 to 30, an acyl group of C-number from 1 to 30, an alkylsulfonyloxy group of C-number from 1 to 30 or an arylsulfonyloxy group of C-number from 6 to 30. These groups may be substituted with substituent groups such as halogen atoms, alkyl groups, aryl groups, heterocyclic groups, alkoxy groups, aryloxy groups, heterocyclic oxy groups, alkylthio groups, arylthio groups, heterocyclic thio groups, alkylsulfonyl groups, arylsulfonyl groups, acyl groups, carbonamido groups, sulfonamido groups, carbamoyl groups, sulfamoyl groups, alkoxycarbonylamino groups, sulfamoylamino groups, ureido groups, cyano groups, nitro groups, acyloxy groups, alkoxycarbonyl groups, aryloxycarbonyl groups, alkylsulfonyloxy groups and arylsulfonyloxy groups.

In formula (Y), l preferably represents 1 or 2 and the substitution position of $R_3$ is preferably at the meta- or para-position with respect to

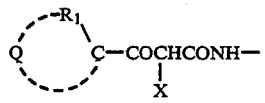

group.

X in formula (Y) preferably represents a heterocyclic group which is bonded to the coupling active site by a nitrogen atom, or an oxygen atom, a sulfur atom, an aryloxy group, an aliphatic or aromatic carbonyloxy group, an aliphatic or aromatic sulfonyloxy group or a heterocyclic ring thio group. X is more preferably a heterocyclic group which is bonded to the coupling active site by a nitrogen atom or an aryloxy group.

When X represents a heterocyclic group, it is preferably a substituted or unsubstituted five to seven membered single ring or condensed ring heterocyclic group. Examples of such groups include succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine and 2-imino-1,3,4-thiazolidine-4-one, and these heterocyclic rings may be substituted with substituents. Examples of the substituents include halogen atoms, a hydroxyl group, a nitro group, a cyano group, a carboxyl group, a sulfo group, alkyl groups, aryl groups, alkoxy groups, aryloxy groups, alkylthio groups, arylthio groups, alkylsulfonyl groups, arylsulfonyl groups, alkoxycarbonyl groups, aryloxycarbonyl groups, acyl groups, acyloxy groups, amino groups, carbonamido groups, sulfonamido groups, carbamoyl groups, sulfamoyl groups, ureido groups, alkoxycarbonylamino groups and sulfamoylamino groups. When X represents an aryloxy group it is preferably an aryloxy group of C-number from 6 to 30, and this may be substituted with groups selected from among the substituents cited in the case where X represents a heterocyclic group described earlier. Halogen atoms, a nitro group, carboxyl group, a trifluoromethyl group, alkoxycarbonyl groups, carbonamido groups, sulfonamido groups, carbamoyl groups, sulfamoyl groups, alkylsulfonyl groups, arylsulfonyl groups or a cyano group are preferred as substituents for the aryloxy groups.

The groups most desirably used in formula (Y) are described below.

$R_1$ is more desirably a halogen atom or an alkyl group of C-number from 1 to 5, and most desirably an alkyl group of C-number from 1 to 3 such as a methyl group, an ethyl group and an n-propyl group.

Q is most desirably a group of non-metal atoms which, together with C, forms a three to five membered hydrocarbon ring being, for example,

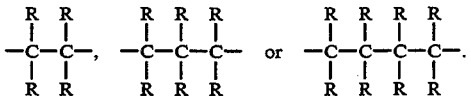

Here, R represents a hydrogen atom, a halogen atom or an alkyl group. The plurality of R may be all the same or they may be different. Furthermore, two R groups may be connected to each other to form a condensed three to six membered hydrocarbon ring.

Q is most desirably

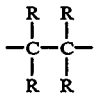

which, together with C, forms a three membered ring.

$R_2$ is more desirably a chlorine atom, a fluorine atom, an alkyl group of C-number from 1 to 6 (for example, methyl, trifluoromethyl, ethyl, isopropyl, tert-butyl), an alkoxy group of C-number from 1 to 8 (for example, methoxy, ethoxy, methoxyethoxy, butoxy) or an aryloxy group of C-number from 6 to 24 (for example, phenoxy, p-tolyloxy, p-methoxyphenoxy), and it is most desirably a chlorine atom, a methoxy group or a trifluoromethyl group.

$R_3$ is more desirably a halogen atom, an alkoxy group, an alkoxycarbonyl group, an aryloxycarbonyl group, a carbonamido group, a sulfonamido group, a carbamoyl group or a sulfamoyl group, and it is most desirably an alkoxy group, an alkoxycarbonyl group, a carbonamido group or a sulfonamido group.

X is more desirably a group which can be represented by formulas (Y-1), (Y-2) or (Y-3) which are indicated below.

(Y-1)

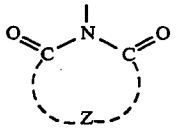

Z in formula (Y-1) represents

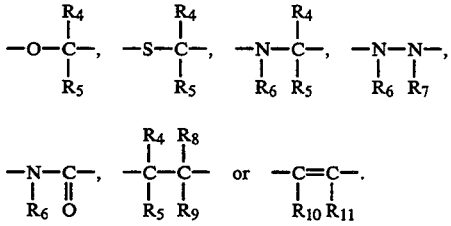

Here, $R_4$, $R_5$, $R_8$ and $R_9$ each represents a hydrogen atoms, alkyl groups, aryl groups, alkoxy groups, aryloxy groups, alkylthio groups, arylthio groups, alkylsulfonyl groups, arylsulfonyl groups or amino groups, $R_6$ and $R_7$ each represents a hydrogen atom, alkyl groups, aryl groups, alkylsulfonyl groups, arylsulfonyl groups, or alkoxycarbonyl groups, and $R_{10}$ and $R_{11}$ each represents a hydrogen atom, alkyl groups or aryl groups. $R_{10}$ and $R_{11}$ may be joined together to form a benzene ring. $R_4$ and $R_5$, $R_5$ and $R_6$, $R_6$ and $R_7$, or $R_4$ and $R_8$ may be joined together to form a ring (for example, cyclobutane, cyclohexane, cycloheptane, cyclohexene, pyrrolidine, piperidine). The above-described groups represented by $R_4$, $R_5$, $R_6$, $R_7$, $R_8$, $R_9$, $R_{10}$ or $R_{11}$ may have substituents such as those described for $R_3$.

Of the heterocyclic groups represented by formula (Y-1), those which are heterocyclic groups in which Z in formula (Y-1) is

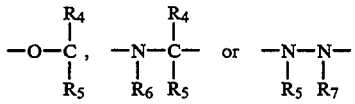

are especially desirable. The C-number of the heterocyclic groups represented by formula (Y-1) is from 2 to 30, preferably from 4 to 20, and most desirably from 5 to 16.

(Y-2)

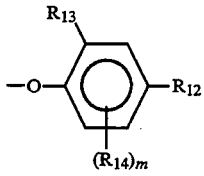

In formula (Y-2), at least one of $R_{12}$ and $R_{13}$ is a group selected from among halogen atoms, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group and acyl group, and the other may be a hydrogen atom, an alkyl group or an alkoxy group. $R_{14}$ has the same meaning as $R_{12}$ or $R_{13}$, and m represents an integer from 0 to 2. The C-number of the aryloxy groups represented by formula (Y-2) is from 6 to 30, preferably from 6 to 24, and most desirably from 6 to 15.

(Y-3)

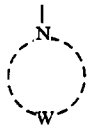

In formula (Y-3), W represents a group of non-metal atoms which is required, together with N, to form a pyrrole ring, a pyrazole ring, an imidazole ring or a triazole ring. Here, the ring represented by

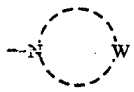

may have substituents. Examples of the preferred substituents include halogen atoms, a nitro group, a cyano group, alkoxycarbonyl groups, alkyl groups, aryl groups, amino groups, alkoxy groups, aryloxy groups and carbamoyl groups. The C-number of the heterocyclic groups represented by formula (Y-3) is from 2 to 30, preferably from 2 to 24, and most desirably from 2 to 16.

X is most desirably a group which is represented by formula (Y-1).

The couplers which are represented by general formula (Y) may form bis-compounds or polymers (including oligomers) which are bonded together via a single bond, a divalent or higher valent group at the groups represented by $R_1$, Q, X or

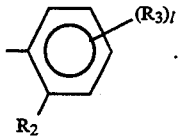

In this case, the number of carbon atoms may be outside the range of C-numbers indicated for each of the substituent groups aforementioned.

When the coupler shown by general formula (Y) forms a polymer, a typical example thereof is a homopolymer or a copolymer of an addition polymerizable ethylene type unsaturated compound having a yellow dye-forming coupler residual group (yellow-coloring monomer), and is preferably represented by following formula (Y-a):

$$\text{—}(G_i)_{gi}(H_j)_{hj}\text{—} \qquad \text{(Y-a)}$$

In formula (Y-a), $G_i$ is a repeating unit derived from a coloring monomer and is a group represented by following formula (Y-b); $H_j$ is repeating unit derived from a non-coloring monomer; i represents a positive integer; j represents 0 or a positive integer; and gi and hj represent the weight fractions by weight of $G_i$ and $H_j$, respectively. In this case, when i or j is plural, it means that $G_i$ or $H_j$ contains plural kinds of repeating units.

(Y-b)

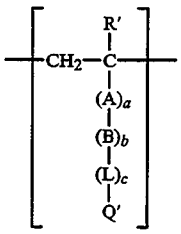

In formula (Y-b), R' represents a hydrogen atom, an alkyl group of C-number from 1 to 4 or a chlorine atom; A represents —CONH—, —COO— or a substituted or unsubstituted phenylene group; B represents a substituted or unsubstituted alkylene group, a phenylene group or an aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b, and c each represents 0 or 1; and Q' represents a yellow coupler residual group formed by removing one hydrogen atom from $R_1$, Q, X or

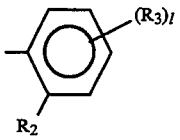

of the compound represented by general formula (Y).

As the non-coloring ethylenic monomer giving the repeating unit shown by $H_j$, which does not cause a coupling reaction with the oxidation product of an aromatic primary amine developing agent, there are, for example, acrylic acid, α-chloroacrylic acid, α-alkylacrylic acids (e.g., methacrylic acid), the amides or esters derived from these acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy methacrylate), vinyl esters (e.g., vinyl acetate, vinyl propionate and vinyl laurate), acrylonitrile, methacrylonitrile, aromatic vinyl compounds (e.g., styrene and the derivatives thereof such as vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid esters, N-vinyl-2-pyrrolidone, N-vinylpyridine, 2-vinylpyridine and 4-vinylpyridine.

In these monomers, acrylic esters, methacrylic esters, and maleic acid esters are particularly preferred.

The non-coloring ethylenic monomers can be used as a combination of two or more kinds thereof. For example, a combination of methyl acrylate and butyl acrylate, butyl acrylate and styrene, butyl methacrylate and methacrylic acid, or methyl acrylate and diacetonacrylamide can be used.

As well-known in the field of polymer couplers, the ethylenic unsaturated monomer being copolymerized with the vinylic monomer corresponding to aforementioned formula (Y-b) can be selected so that the state such as solid, liquid or micell of the copolymer formed and the physical properties and/or chemical properties of the copolymer, such as the solubility (solubility in water or organic solvents), the compatibility with a binder for a photographic colloid composition (e.g., gelatin), the flexibility, the thermal stability, the coupling reactivity with the oxidation product of a developing agent, the non-diffusibility in a photographic colloid, etc., are influenced well.

These copolymers may be random copolymers or copolymers having a specific sequence (e.g., block copolymers and alternate copolymers).

The number average molecular weight of the yellow polymer coupler being used in this invention is usually from the order of several thousands to the order of several hundred thousands but an oligomer-form polymer coupler having an average molecular weight of not more than 5,000 can also be utilized.

When formula (Y-a) represents a copolymer, the ranges of gi for the repeating unit shown by $G_i$ derived from a coloring monomer and hj for the repeating unit shown by Hj derived from a non-coloring monomer are as follows. That is, the total sum of gi is from 10 to 100 and the total sum of hj is from 90 to 0 by fraction of weight, and preferably the total sum of gi is from 30 to 70 and the total sum of hj is from 70 to 30 by fraction of weight.

The yellow polymer coupler being used in this invention may be an oleophilic polymer soluble in an organic solvent (e.g., ethyl acetate, butyl acetate, ethanol, methylene chloride, cyclohexanone, dibutyl phthalate, and tricresyl phosphate), a hydrophilic polymer miscible with an aqueous solution of a hydrophilic colloid such as gelatin, etc., or a polymer having a structure and property capable of forming a micell in a hydrophilic colloid.

The yellow polymer coupler being used in this invention may be prepared in the form of a latex by emulsion-dispersing an organic solvent solution of an oleophilic polymer coupler obtained by the polymerization of a vinylic monomer giving a coupler unit shown by aforementioned formula (Y-b) in an aqueous gelatin, or may be directly prepared by an emulsion polymerization method.

As the method of emulsion-dispersing in the form of a latex the oleophilic polymer coupler in an aqueous gelatin solution, the method described in U.S. Pat. No. 3,451,820 can be used and as the emulsion polymerization method, the methods described in U.S. Pat. Nos. 4,080,211 and 3,370,952 can be used.

Actual examples of each substituent group in formula (Y) are indicated below.

Examples of $R_1$ and the

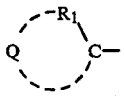

group formed by Q together with C are indicated below.

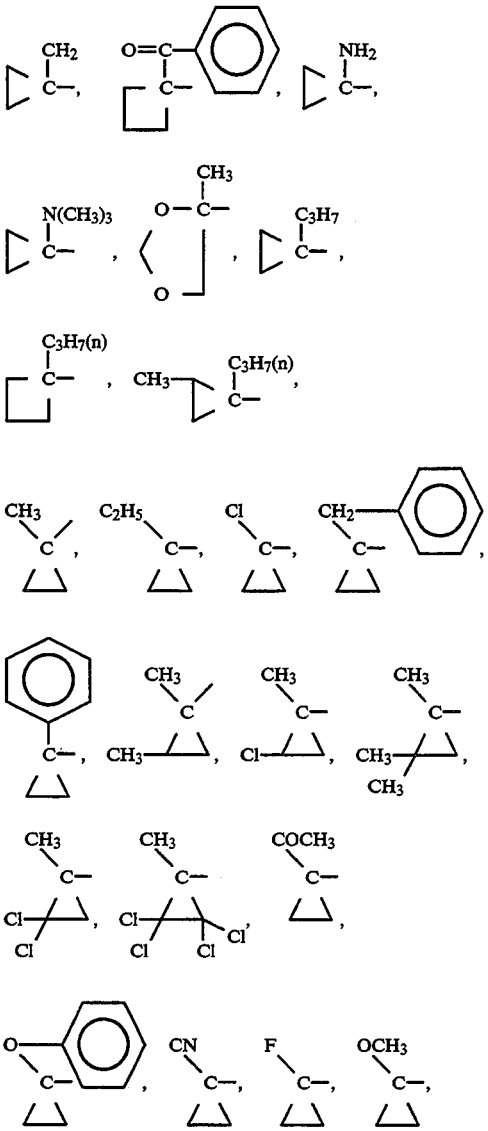

-continued

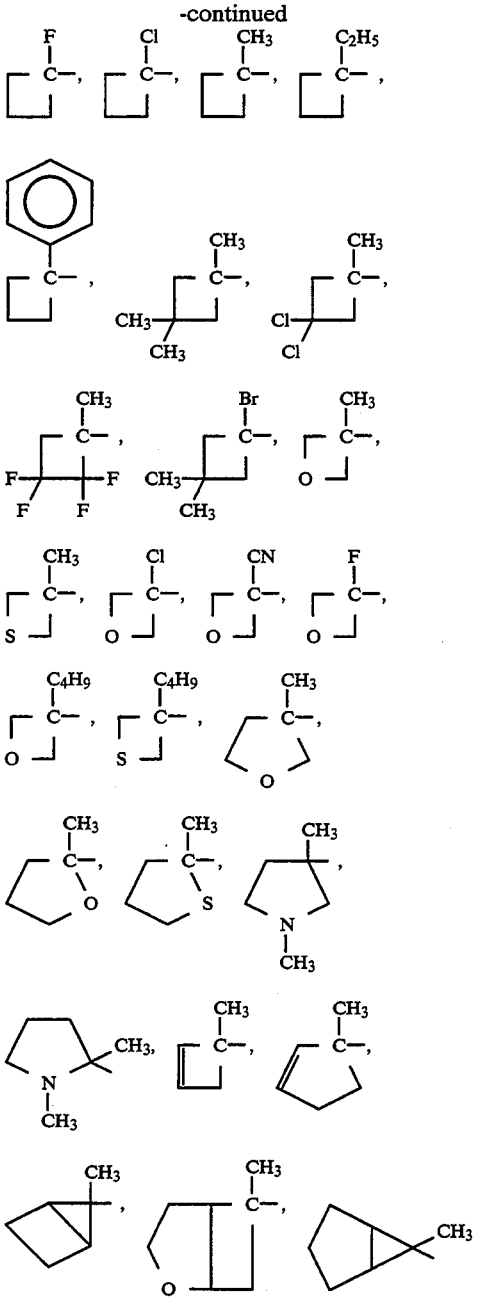

② Examples of $R_2$

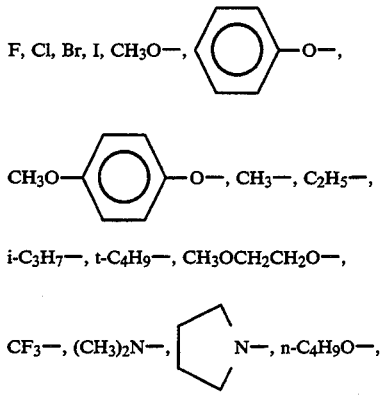

-continued

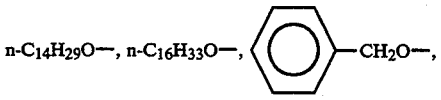

n-$C_{12}H_{25}O$—,

③ Examples of $R_3$

F, Cl, Br, I, $CH_3O$—, $C_2H_5O$—,
n-$C_{12}H_{25}O$—, $CH_3$, t-$C_4H_9$—,
—$COOCH_3$, —$COOC_2H_5$, —$COOC_4H_9$-n,

—$COOC_{12}H_{25}$-n, —$OCH_2CH(C_6H_{13}\text{-n})C_8H_{17}$-n

—$COOCH(CH_3)COOC_{12}H_{25}$-n, —$COOCH(C_4H_9\text{-n})COOC_{12}H_{29}$-n,

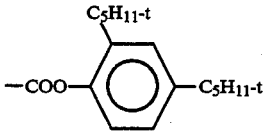

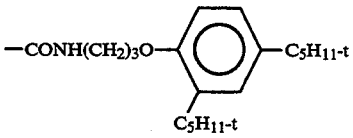

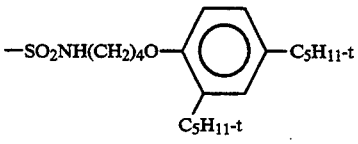

—$SO_2N(CH_3)_2$, —$SO_2NHCOC_2H_5$,

—$SO_2NHC_{16}H_{33}$-n, —$NHCOC_{13}H_{27}$-n,
—$NHCOC_{15}H_{31}$-n, —$NHCOC_{17}H_{35}$-n,
—$NHCOCH(C_6H_{13}\text{-n})C_8H_{17}$-n, —$NHCOCH(CHCH_2C_4H_9\text{-t})CH_2CH_2CH(CH_3)CH_2C_4H_9$-t —$NHCOCH(CH_3)CH_2SO_2C_{16}H_{33}$-n

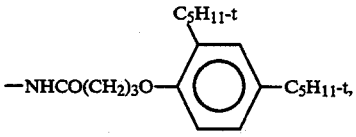

-continued

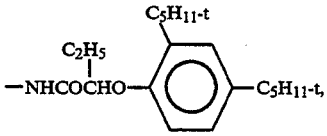

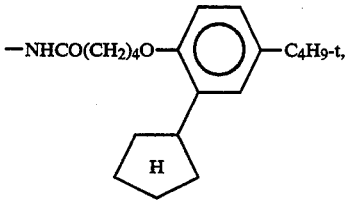

—$NHCOCH(C_3H_7\text{-t})SO_2C_{16}H_{33}$-n,

—$NHSO_2C_{12}H_{25}$-n, —$NHSO_2C_{16}H_{33}$-n,

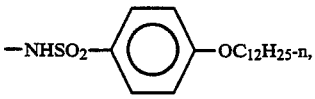

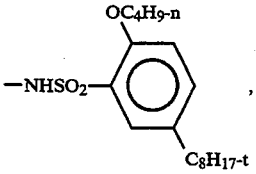

, —$SO_2NHCH_3$,

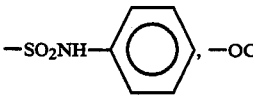

, —$OCOC_{11}H_{23}$-n,

—$OSO_2C_{12}H_{25}$-n, —$NHCOOC_{12}H_{25}$-n,

④ Example of X

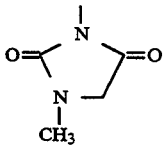

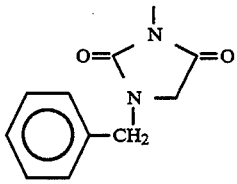

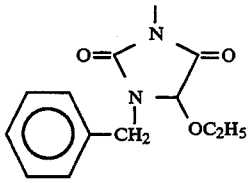

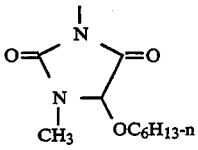

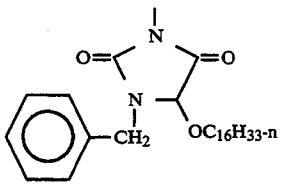

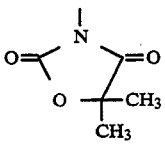

-continued
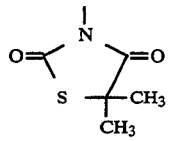
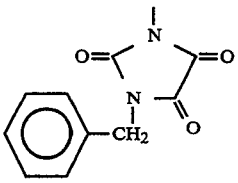
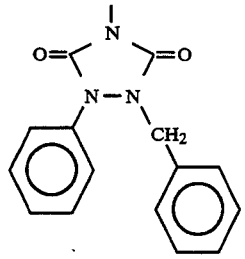
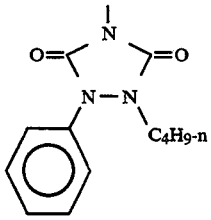
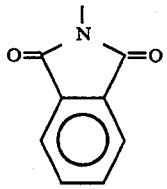
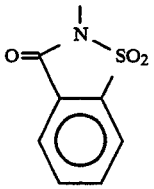
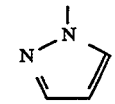
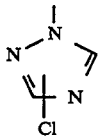
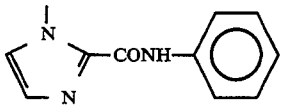
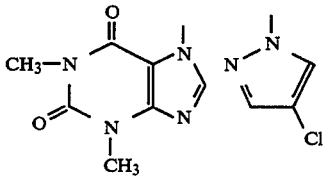
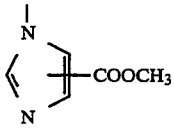
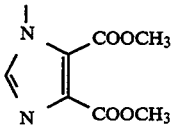
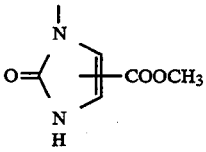
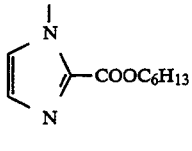
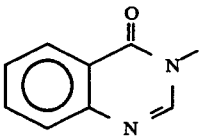
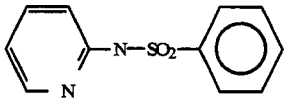
-continued
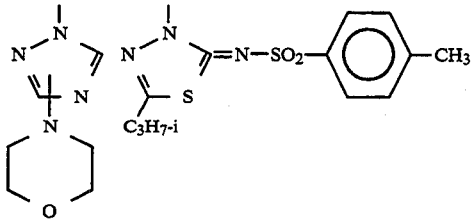
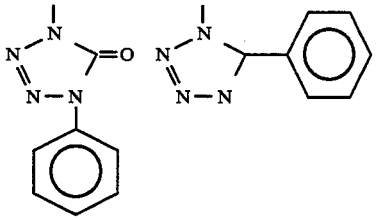
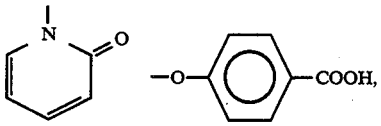
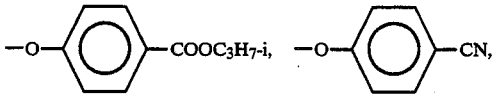
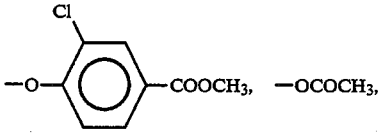
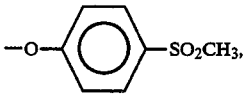
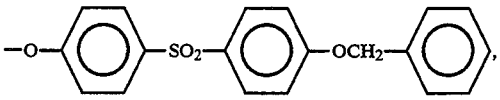
$-OSO_2CH_3$,
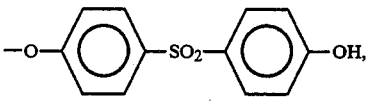
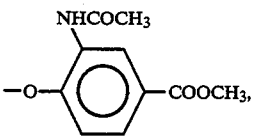
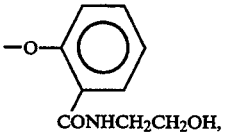

-continued
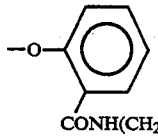
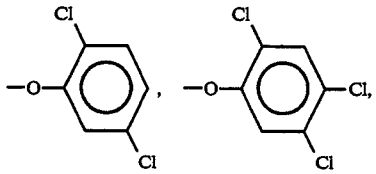
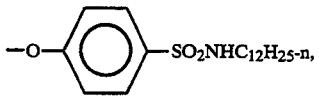
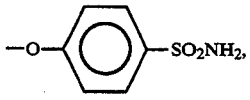
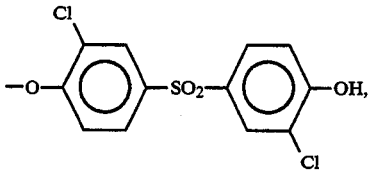
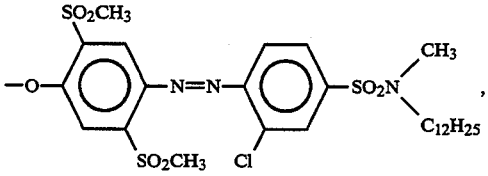
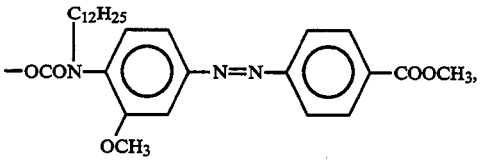
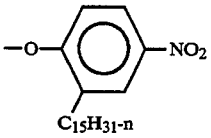
-continued
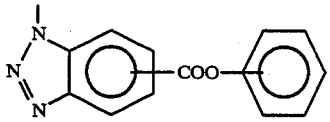
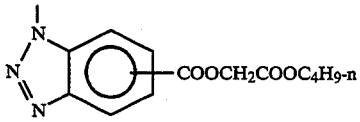
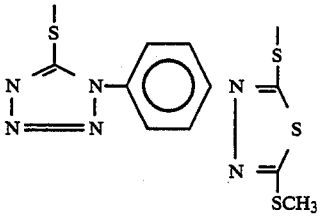
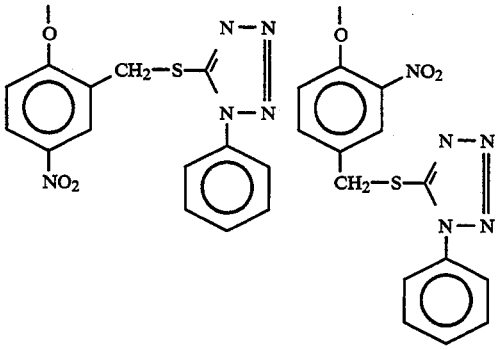
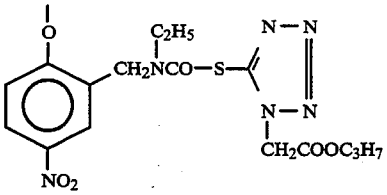
Actual examples of yellow couplers which can be represented by formula [Y] are indicated below.
Y-1
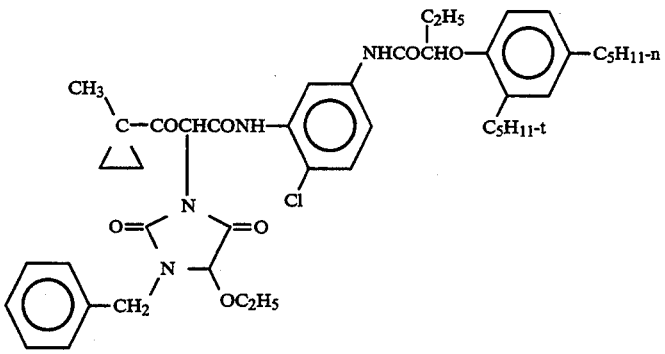

-continued
Y-2
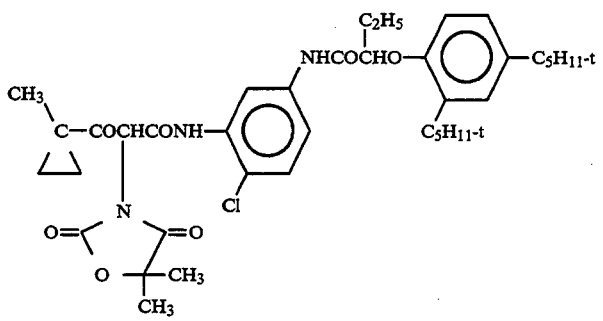
Y-3
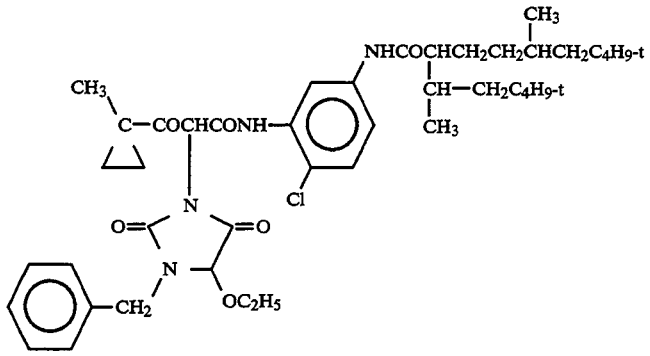
Y-4
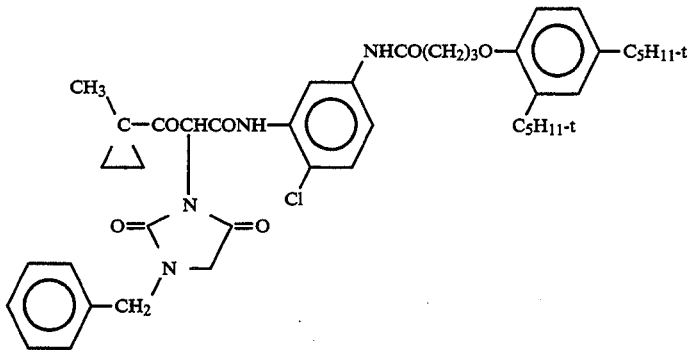
Y-5
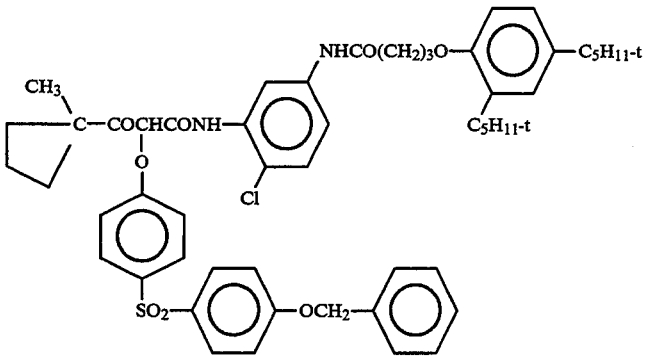

-continued
Y-6
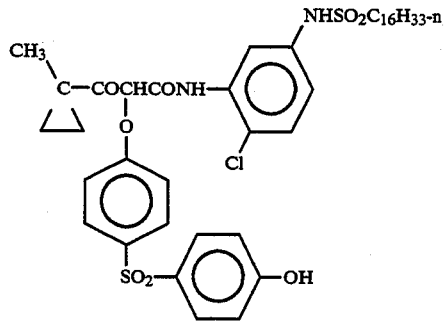
Y-7
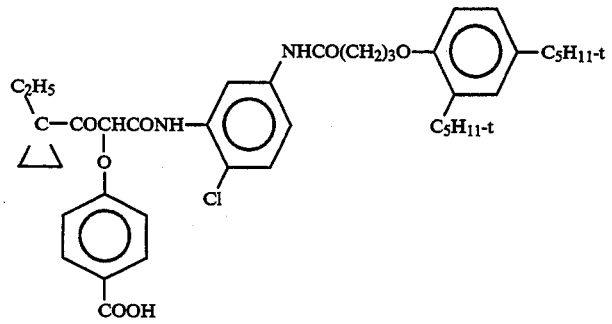
Y-8
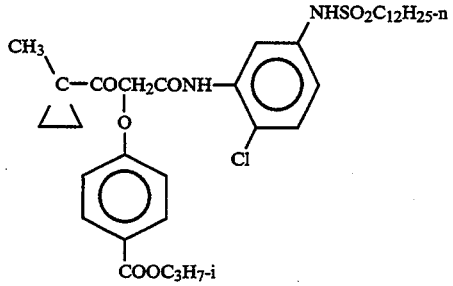
Y-9
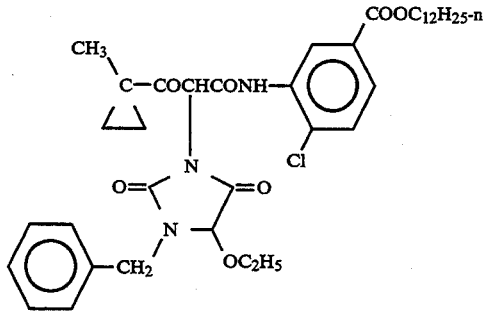
Y-10
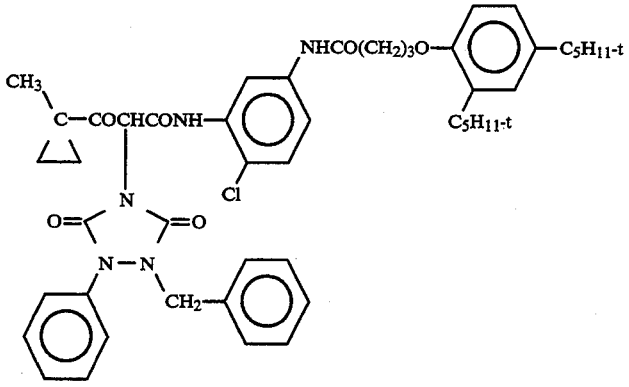

-continued
Y-11
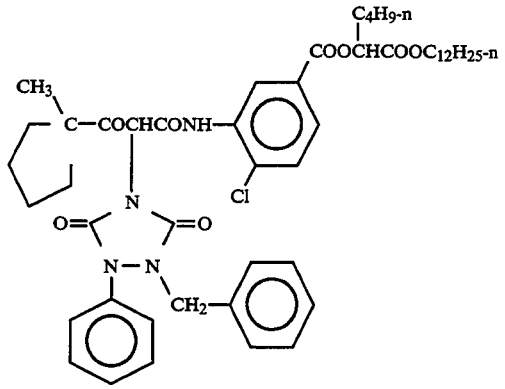
Y-12
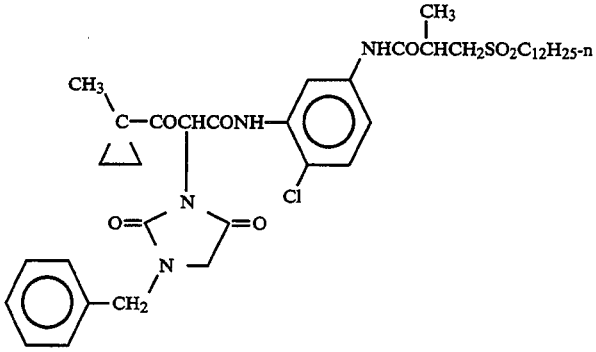
Y-13
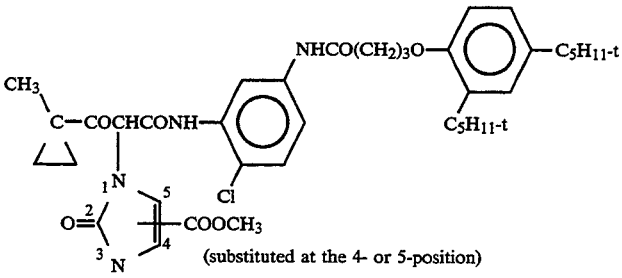
Y-14
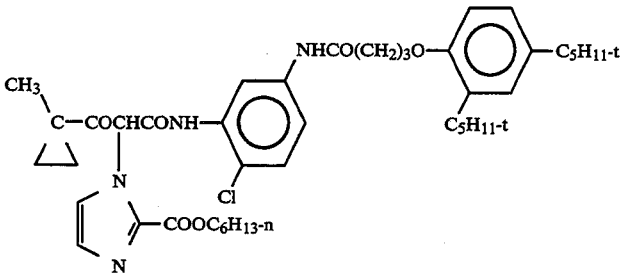
Y-15
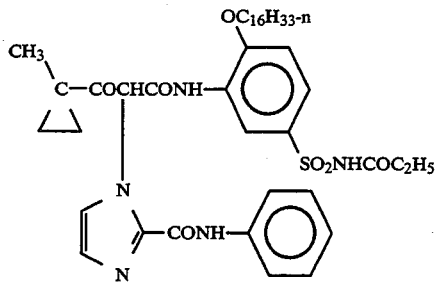

-continued
Y-16
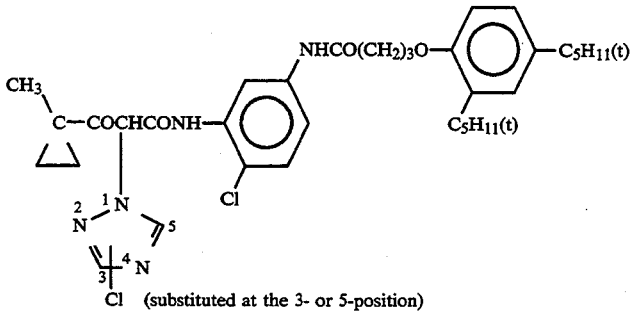
Y-17
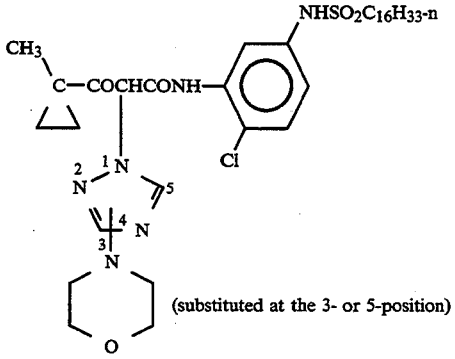
Y-18
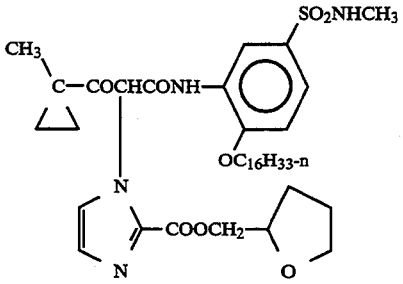
Y-19
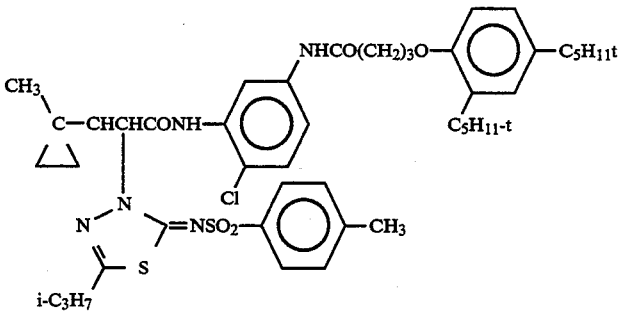
Y-20
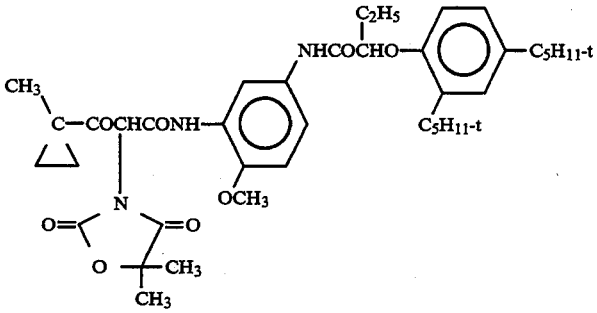

-continued
Y-21
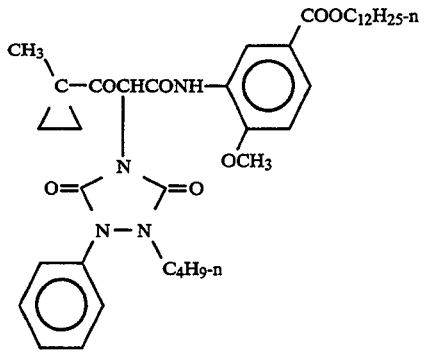
Y-22
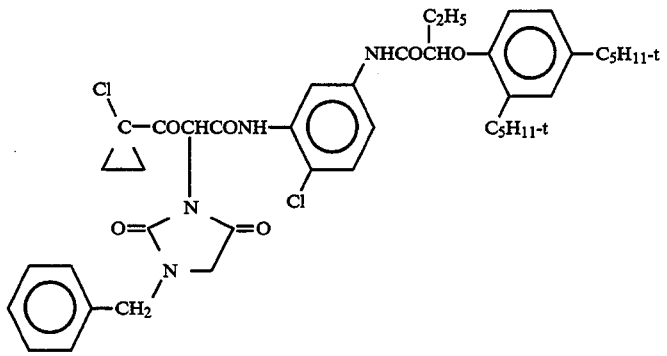
Y-23
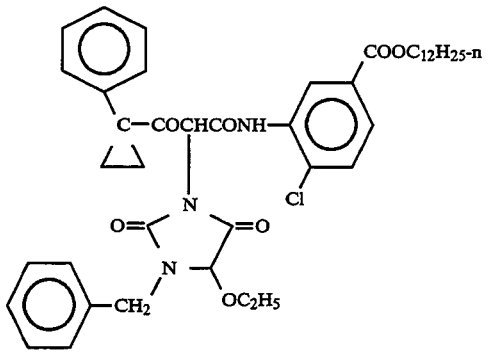
Y-24
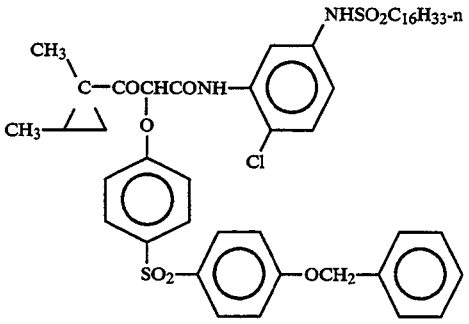

-continued
Y-25
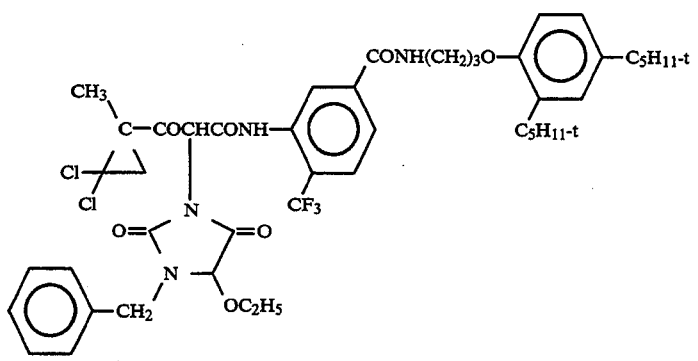
Y-26
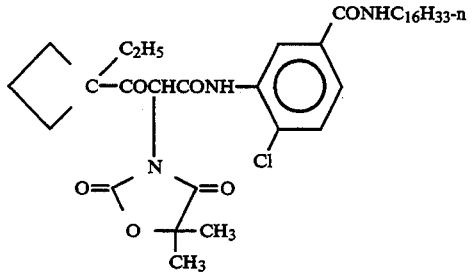
Y-27
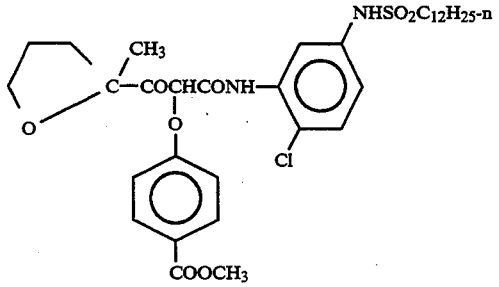
Y-28
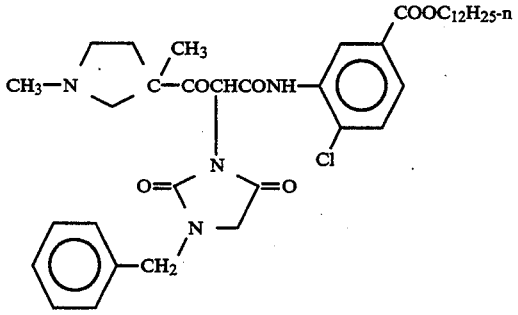
Y-29
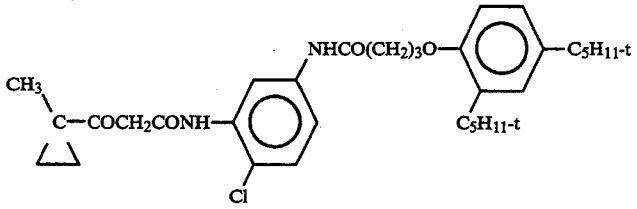

-continued
Y-30
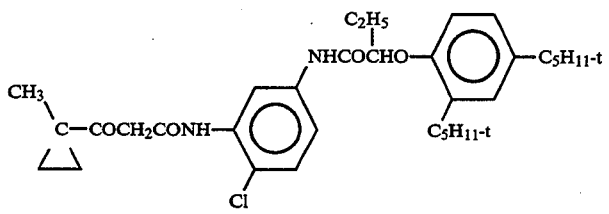
Y-31
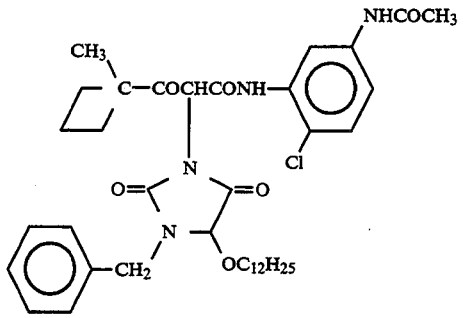
Y-32
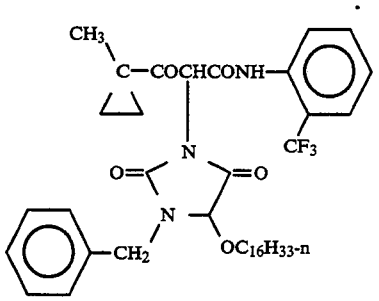
Y-33
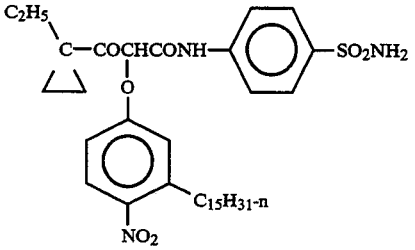
Y-34
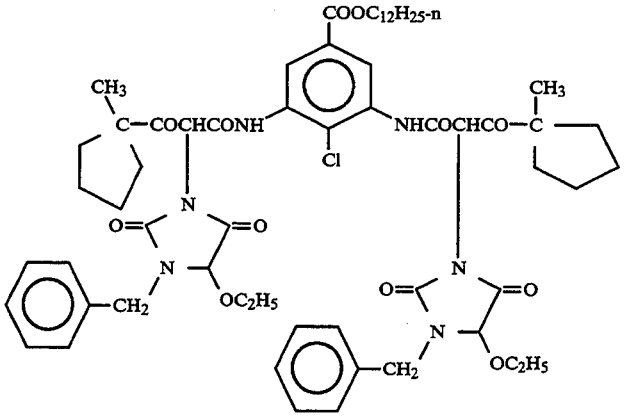

-continued
Y-35
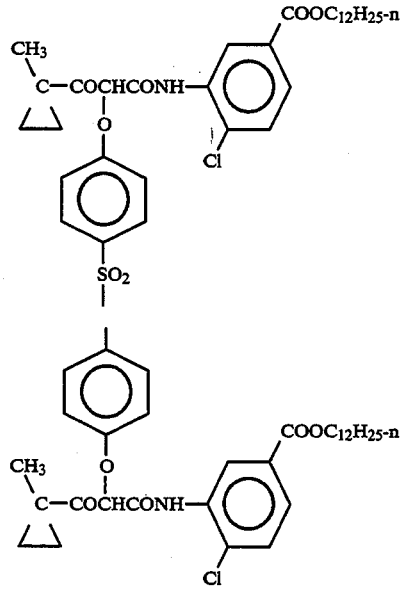
Y-36
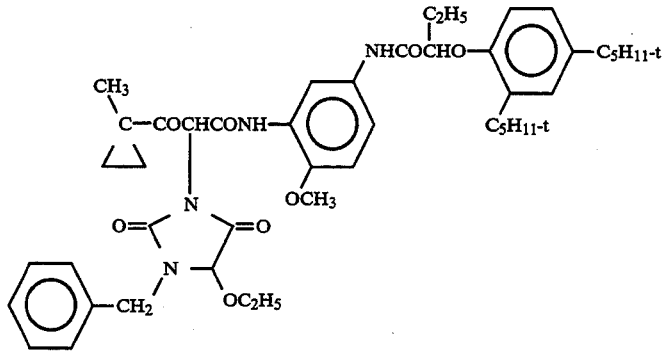
Y-37
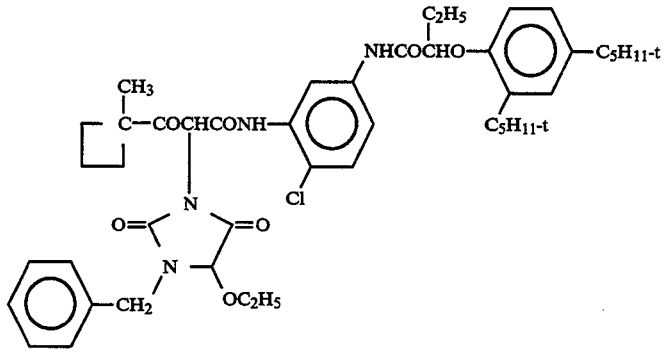
Y-38
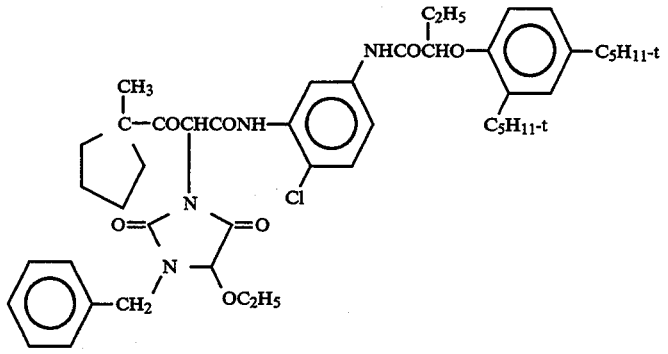

-continued
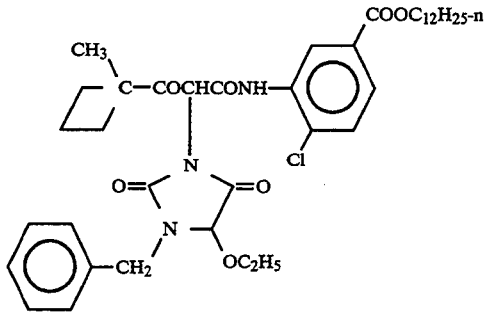
Y-39
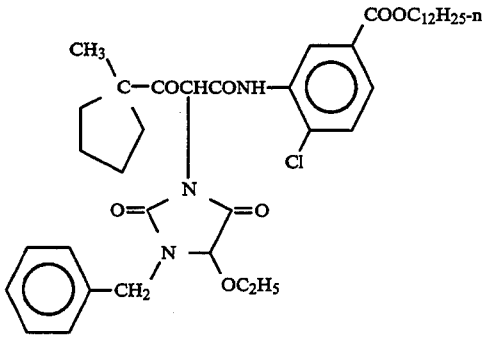
Y-40
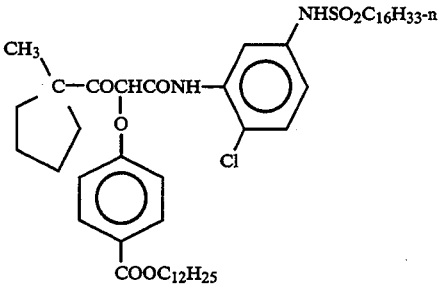
Y-41
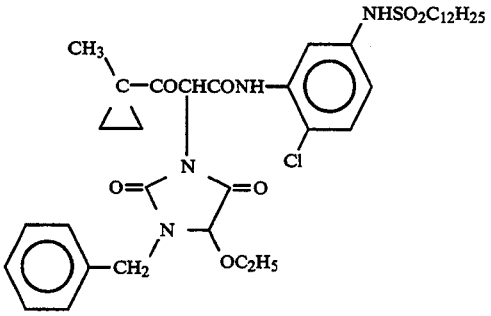
Y-42
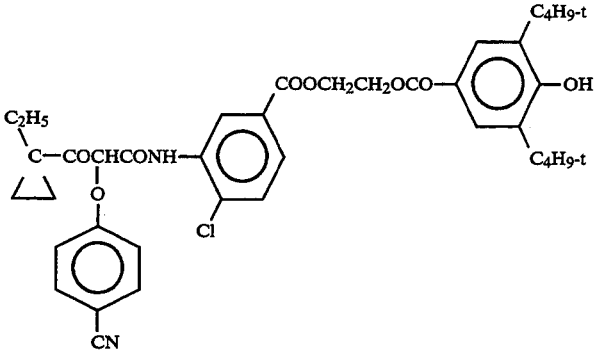
Y-43

-continued
Y-44
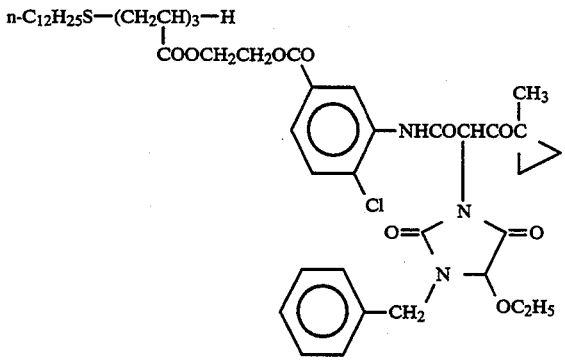
Y-45
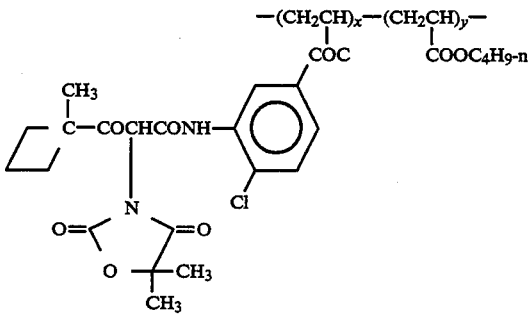
x:y = 50:50 (by weight)
Number average molecular weight 50,000
Y-46
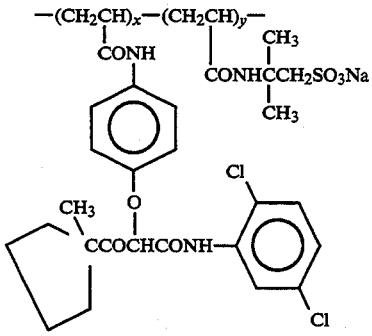
x:y = 80:20 (by weight)
Number average molecular weight 70,000
Y-47
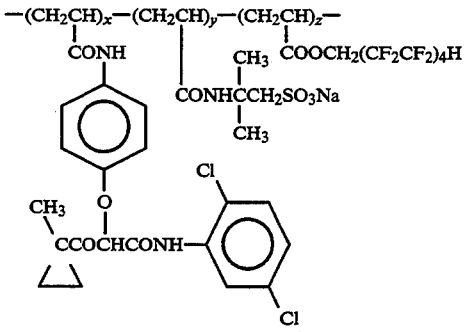
x:y:z = 50:30:20 (by weight)
Number average molecular weight 70,000

-continued
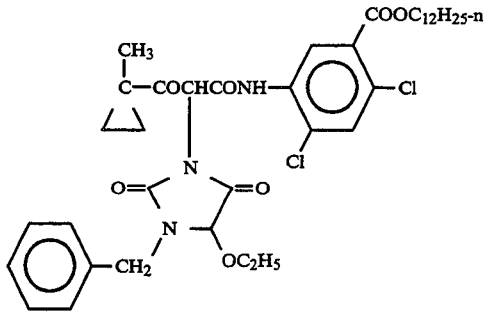
Y-48
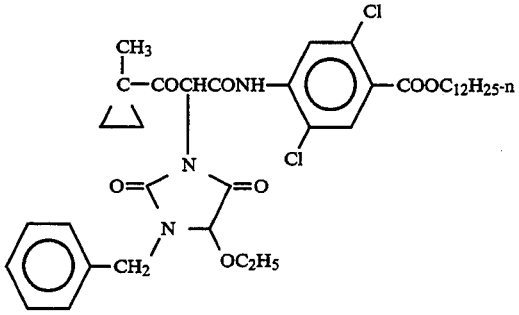
Y-49
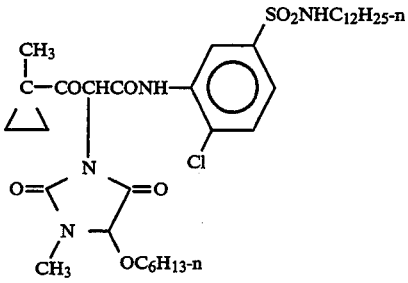
Y-50
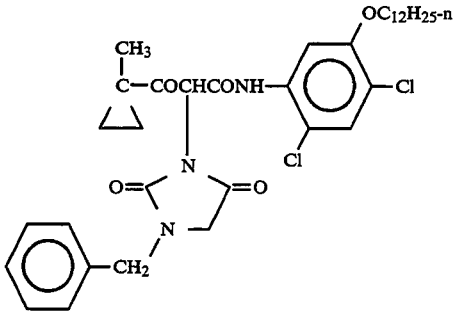
Y-51
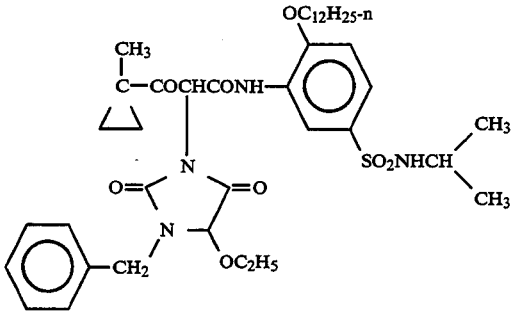
Y-52

-continued
Y-53
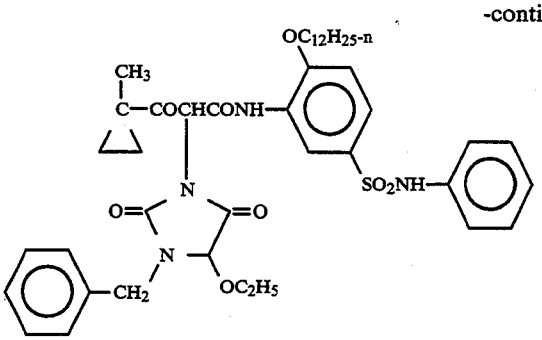
Y-54
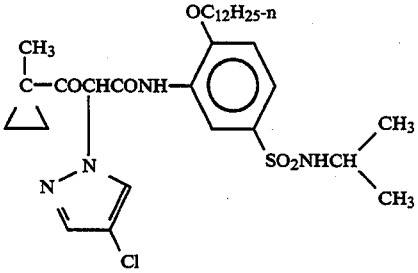
Y-55
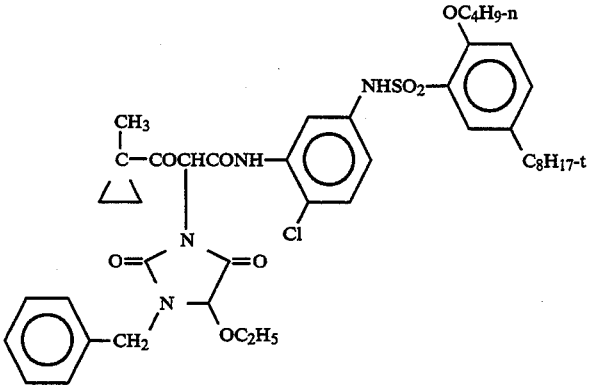
Y-56
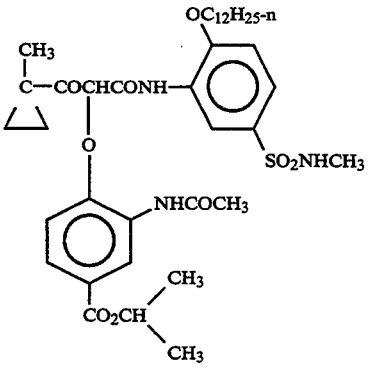
Y-57
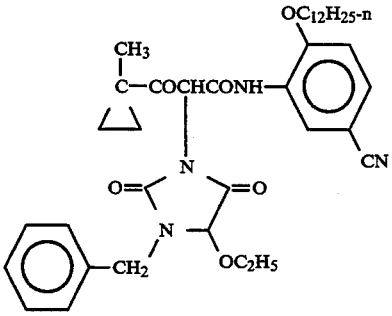

-continued
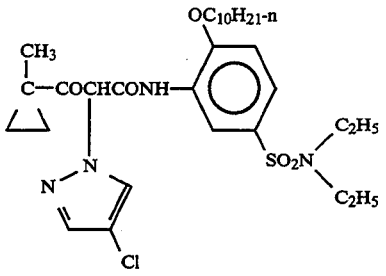
Y-58
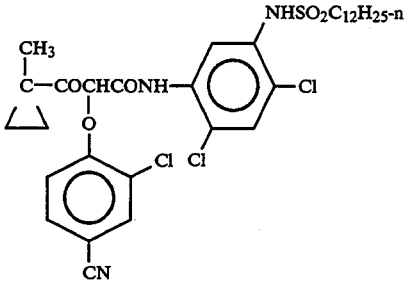
Y-59
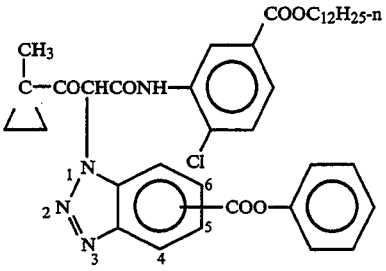
Y-60
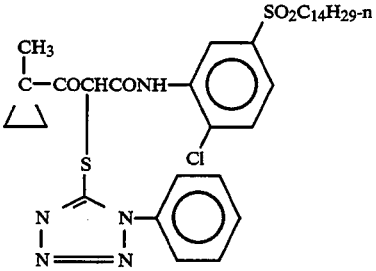
Y-61
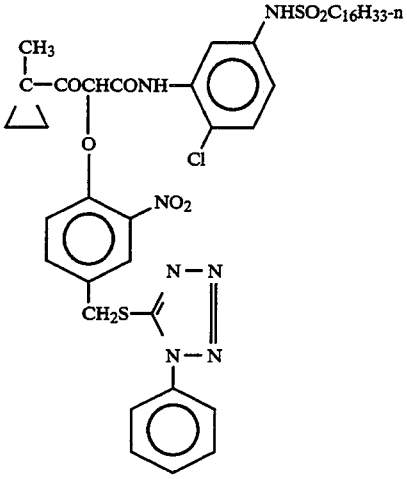
Y-62

-continued
Y-63
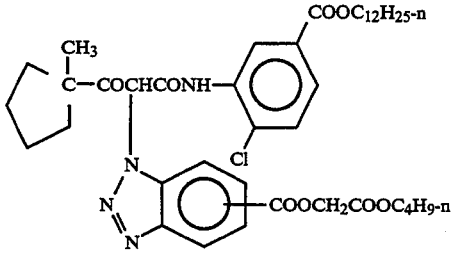
(substituted at the 5- or 6-position)
Y-64
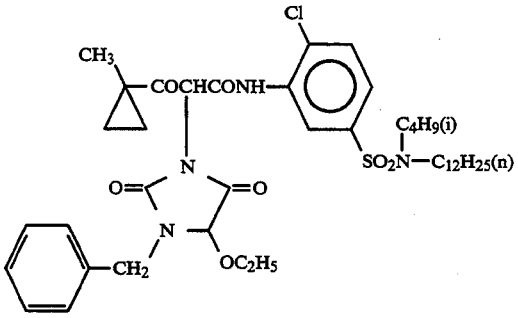
Y-65
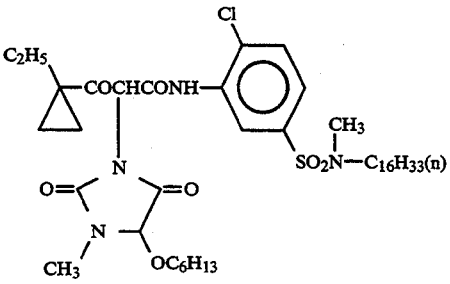
Y-66
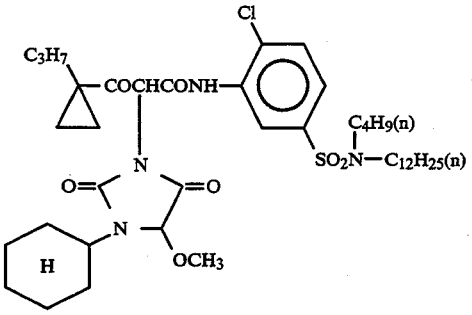
Y-67
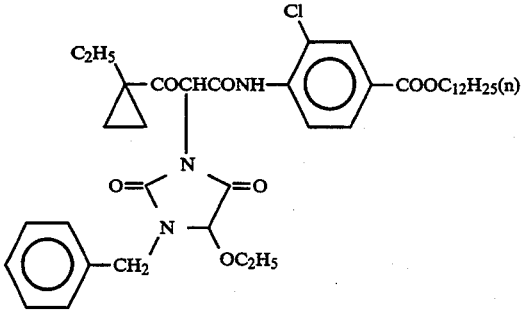

-continued
Y-68
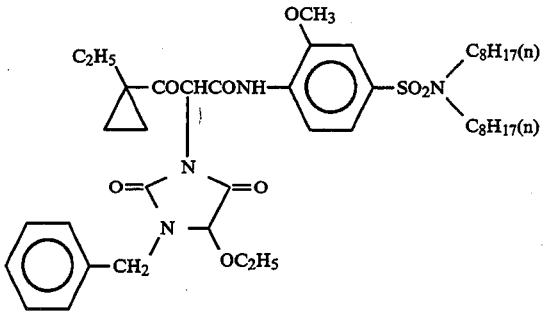
Y-69
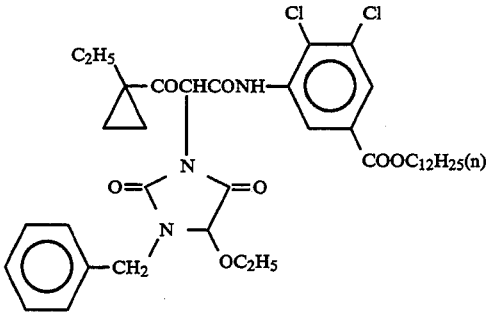
Y-70
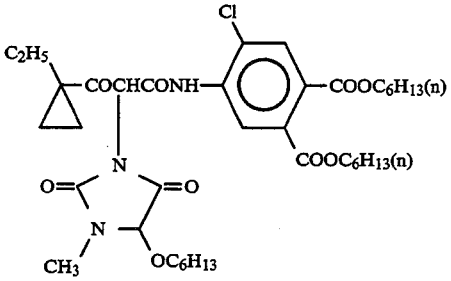
Y-71
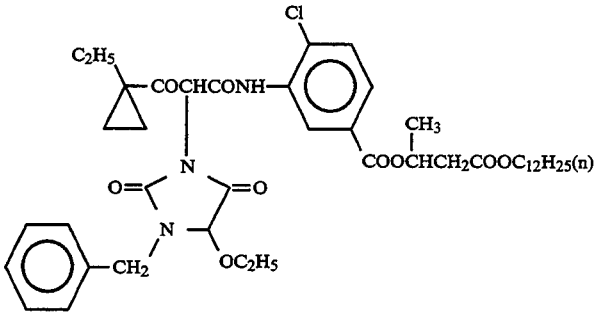
Y-72
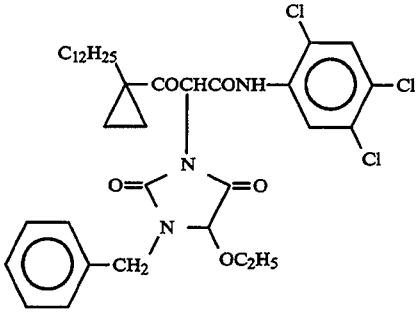

-continued

Y-73

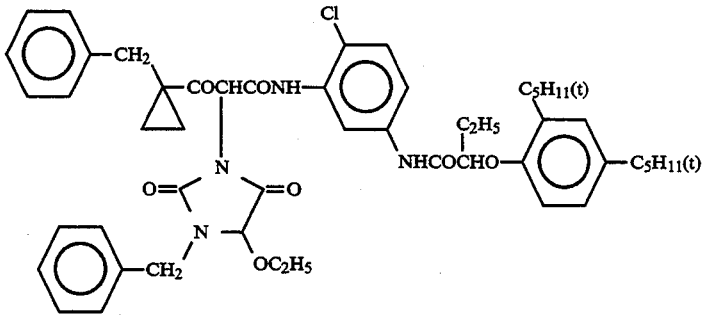

Y-74

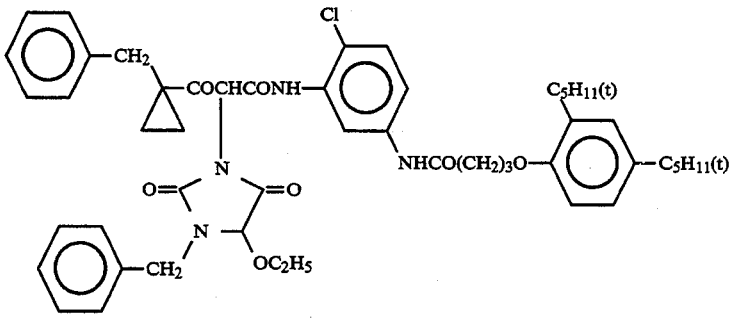

Yellow couplers of the present invention represented by formula (Y) can be prepared using the synthetic route indicated below.

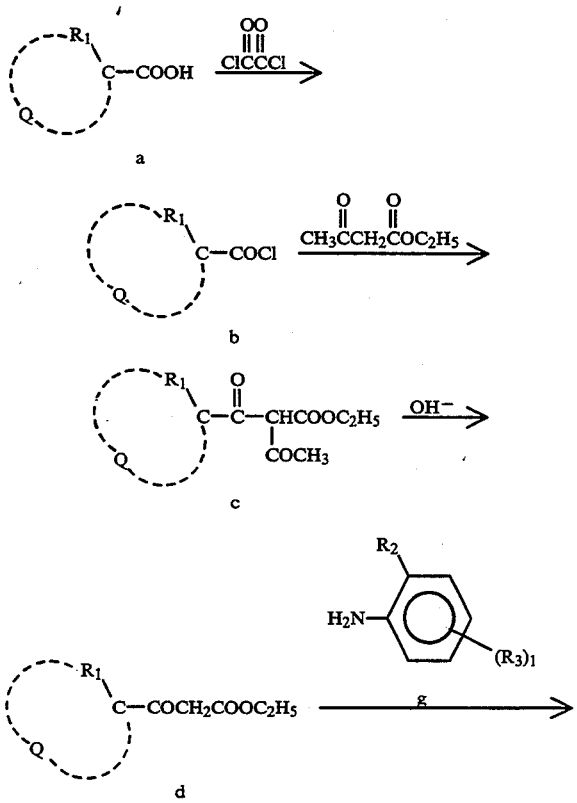

-continued

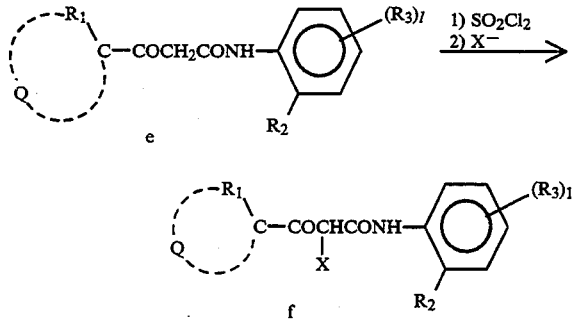

Here, the compound a can be prepared using the methods disclosed, for example, in *J. Chem. Soc.* (*C*) 1968, 2548, *J. Am. Chem. Soc.*, 1934, 56, 2710, *Synthesis*, 1971, 258, *J. Org. Chem.*, 1978, 43, 1729, and *CA*, 1960, 66, 18533y.

The preparation of compound b is carried out by a reaction without a solvent or in a solvent such as methylene chloride, chloroform, carbon tetrachloride, dichloroethane, toluene, N,N-dimethylformamide or N,N-dimethylacetamide, for example, using thionyl chloride or oxalyl chloride, for example, and the reaction temperature is normally within the range of from −20° C. to 150° C., and preferably within the range of from −10° C. to 80° C.

Compound c can be prepared by forming ethyl acetoacetate into the anion using magnesium methoxide, for example, and adding b to this. The reaction is carried out without a solvent or using tetrahydrofuran or ethyl ether, for example, and the reaction temperature is generally from −20° C. to 60° C., and preferably from −10° C. to 30° C. Compound d is prepared by a reaction without a solvent or in a solvent such as methanol, ethanol or acetonitrile, for example, using the compound c and aqueous ammonia, an aqueous solution of $NaHCO_3$ or an aqueous solution of sodium hydroxide as a base. The reaction temperature is generally from −20° C. to 50° C., and preferably from −10° C. to 30° C.

The compound e is prepared by reacting compounds d and g in the absence of a solvent. The reaction temperature is generally from 100° C. to 150° C., and preferably from 100° C. to 120° C. In cases where X is not H, compound f is prepared by introducing the leaving group X after chlorination or bromination. The compound e is converted to the chloro derivative by means of sulfuryl chloride or N-chlorosuccinimide, for example, in a solvent such as dichloroethane, carbon tetrachloride, chloroform, methylene chloride or tetrahydrofuran, for example, or to the bromo derivative using bromine or N-bromosuccinimide, for example. The reaction temperature at this time is from −20° C. to 70° C., and preferably from −10° C. to 50° C.

Next, coupler f of the present invention can be obtained by reacting the chloro derivative or bromo derivative and the protonated leaving group H-X in a solvent such as methylene chloride, chloroform, tetra-hydrofuran, acetone, acetonitrile, dioxane, N-methylpyrrolidone, N,N'-dimethylimidazolidine-2-one, N,N-dimethylformamide or N,N-dimethylacetamide, for example, at a reaction temperature of from −20° C. to 150° C., and preferably of from −10° C. to 100° C. At this time, a base such as triethylamine, N-ethylmorpholine, tetramethylguanidine, potassium carbonate, sodium hydroxide or sodium bicarbonate, for example, can be used.

Examples of the synthesis of couplers of the present invention are indicated below.

SYNTHESIS EXAMPLE 1—PREPARATION OF ILLUSTRATIVE COUPLER Y-30

Oxalyl chloride (38.1 gram) was drip fed over a period of 30 minutes at room temperature into a mixture comprised of 25 grams of 1-methylcyclopropane carboxylic acid which had been prepared using the method disclosed by Gotkis, D., et al., *J. Am. Chem. Soc.*, 1934, 56, 2710, 100 ml of methylene chloride and 1 ml of N,N-dimethylformamide. After the drip feed had been completed, the reaction was continued for 2 more hours at room temperature and then the methylene chloride and the excess oxalyl chloride were removed under reduced pressure with an aspirator and 1-methylcyclopropanecarbonyl chloride was obtained as an oily substance.

Methanol (100 ml) was drip fed over a period of 30 minutes at room temperature into a mixture comprised of 6 grams of magnesium and 2 ml of carbon tetrachloride and after subsequently heating the mixture for 2 hours under reflux, 32.6 grams of ethyl 3-oxobutanoate was added dropwise over a period of 30 minutes while heating under reflux. After the drip feed had been completed, the mixture was heated under reflux for a period of 2 hours and then the methanol was distilled off completely under low pressure using an aspirator. Tetrahydrofuran (100 ml) was added to the mixture which was then dispersed, and the 1-methylcyclopropanecarbonyl chloride prepared earlier was added dropwise at room temperature. After reacting for a period of 30 minutes, the mixture was extracted with 300 ml of ethyl acetate and dilute sulfuric acid solution and, after being washed with water, the organic layer was dried over anhydrous sodium sulfate and then the solvent was removed and 55.3 grams of ethyl 2-(1-methylcyclopropanecarbonyl)-3-oxobutanoate was obtained as an oily substance.

A solution of 55 grams of ethyl 2-(1-methylcyclopropanecarbonyl)-3-oxobutanoate and 160 ml of ethanol was stirred at room temperature and 60 ml of a 30% aqueous ammonia was added dropwise to this solution over a period of 10 minutes.

Subsequently, the mixture was stirred for 1 hour and extracted with 300 ml of ethyl acetate and dilute aqueous hydrochloric acid and, after neutralization and washing with water, the organic layer was dried over anhydrous sodium sulfate and then the solvent was removed and 43 grams of ethyl (1-methylcyclopropanecarbonyl)acetate was obtained as an oily material.

Ethyl (1-methylcyclopropanecarbonyl)acetate (34 grams) and 44.5 grams of N-(3-amino-4-chlorophenyl)-2-(2,4-di-tert-pentylphenoxy)butanamide were heated under reflux at an internal temperature of from 100° C. to 120° C. under reduced pressure using an aspirator. After reacting for 4 hours, the reaction mixture was refined using column chromatography with an n-hexane/ethyl acetate mixed solvent and 49 grams of illustrative compound Y-30 were obtained as a sticky oily material. The structure of the compound was confirmed by MS spectroscopy, NMR spectroscopy and elemental analysis.

SYNTHESIS EXAMPLE 2—PREPARATION OF ILLUSTRATIVE COMPOUND Y-1

Illustrative compound Y-30 (22.8 grams) was dissolved in 300 ml of methylene chloride and 5.4 grams of sulfuryl chloride was added dropwise over a period of 10 minutes with ice cooling. After reacting for 30 minutes, the reaction mixture was washed thoroughly with water and dried over anhydrous sodium sulfate and then concentrated to obtain the chloride of illustrative compound Y-30. The chloride of illustrative compound Y-30 prepared beforehand was dissolved in 50 ml of N,N-dimethylformaldehyde and added dropwise at room temperature over a period of 30 minutes to a solution of 18.7 grams of 1-benzyl-5-ethoxyhydantoin, 11.2 ml of triethylamine and 50 ml of N,N-dimethylformamide.

Subsequently, after reacting for 4 hours at 40° C., the reaction mixture was extracted with 300 ml of ethyl acetate and, after washing with water, the extract was washed with 300 ml of 2% triethylamine aqueous solution and then it was neutralized with dilute hydrochloric acid. The organic layer was dried over anhydrous sodium sulfate and then the solvent was distilled off and the oily material which was obtained was crystallized from an n-hexane/ethyl acetate mixed solvent. The crystals which precipitated out were recovered by filtration and, after washing with n-hexane/ethyl acetate mixed solvent, the crystals were dried and 22.8 grams of the crystals of illustrative compound Y-1 were obtained.

The structure of this compound was confirmed by MS spectroscopy, NMR spectroscopy and elemental analysis. The melting point was 132°-3° C.

The acylacetamide yellow coupler having an acyl group represented by general formula (A) of the present invention is generally used in amounts within the range of from 1.0 to $1.0\times10^{-3}$ mol per mol of silver halide. They are preferably used in amounts of from $5.0\times10^{-1}$ to $5.0\times10^{-2}$ mol, and most desirably in amounts of from $4.0\times10^{-1}$ to $2.0\times10^{-2}$ mol, per mol of silver halide.

Two or more of the acylacetamide yellow couplers having an acyl group represented by general formula (A) of the present invention can be used conjointly, and they can also be used conjointly with other known couplers.

The couplers of the present invention may be incorporated into a light-sensitive silver halide emulsion layer and/or a light-insensitive layer adjacent thereto. When the coupler is incorporated into the light-insensitive layer the above described amount is determined based on the amount of the silver halide in the silver halide emulsion layer adjacent thereto. When X in the general formula (Y) is a nonfunctional leaving group, the coupler is preferably incorporated into a blue-sensitive layer, and when X is a functional leaving group such as that which releases a development inhibiting agent or precursor thereof it is preferred to incorporate it into a light-sensitive silver halide emulsion layer.

The acylacetamide yellow couplers having an acyl group represented by general formula (A) of the present invention can be introduced into light-sensitive materials using a variety of known methods of dispersion.

In the oil in water dispersion method, methods in which a fine dispersion is coated using a low boiling point organic solvent (for example, ethyl acetate, butyl acetate, methyl ethyl ketone, isopropanol) and in which essentially no low boiling point organic solvent remains in the film may be used. In cases where a high boiling point organic solvent is used, any of the solvents which have a normal pressure boiling point of at least 175° C. (actual examples of these are described hereinafter) may be used, and these may be used individually or optionally mixtures of two of more types can be used. The ratio of coupler of the present invention and these high boiling point organic solvents extends over a wide range, but preferably the amount of the solvents is not more than 5.0 g per gram of coupler. The more preferred range of the amount is from 0 to 2.0 g, and the most desirable range is from 0.01 to 1.0 g.

Furthermore, the latex dispersion method described hereinafter can also be used.

Moreover, the various couplers and compounds disclosed hereinafter can be used in the form of mixtures, or they may be present along with the yellow couplers.

The acylacetamide yellow coupler having an acyl group represented by general formula (A) of the present invention have a high coupling activity and the colored dyes which are formed have a large molecular extinction coefficient and so high photographic speeds, large gradations (gamma values) and high color densities can be obtained and, moreover, they exhibit excellent photographic properties in that the processing fluctuations during color development are small. Furthermore, the colored image has excellent spectral absorption characteristics with little absorbance on the long wave length side (in the green region) and the fastness of the colored image is excellent. Moreover, even when the amount of high boiling point organic solvent added per unit weight of coupler is low, the performance is excellent in that the above mentioned photographic properties are retained.

The use of acylacetamide yellow couplers having an acyl group represented by general formula (A) of the present invention and the yellow colored cyan couplers described hereafter provide light-sensitive materials in which the excellent characteristics displayed by the individual couplers as described earlier and hereafter are retained, which have improved color reproduction properties as light-sensitive materials, wherein the processing fluctuation during continuous processing with high activity is small, the storage properties prior to color development of the sensitive material are improved and the colored image fastness is excellent.

The yellow colored cyan couplers used in the present invention are described below.

In the present invention, a yellow colored cyan coupler preferably is a cyan coupler in which the maximum absorption in the visible absorption range of the coupler is between about 400 nm and about 500 nm and which couples with the oxidized product of a primary aromatic amine developing agent and forms a cyan dye of which the maximum absorption in the visible absorption region is between about 630 nm and about 750 nm.

Among the yellow colored cyan couplers used in the present invention which, on undergoing a coupling reaction with the oxidized product of a primary aromatic amine developing agent, can release a water soluble compound residual group which contains a 6-hydroxy-2-pyridon-5-ylazo group, a pyrazolon-4-ylazo group, a 2-acylaminophenylazo group or a 2-sulfonamido-phenylazo group is preferred.

The preferred yellow colored cyan couplers used in the present invention can be represented by the general formulas (CI)–(CIV) indicated below.

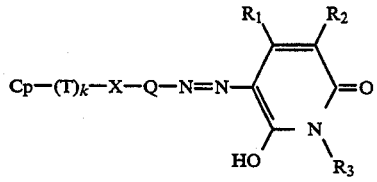
(CI)

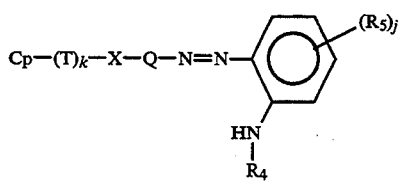
(CII)

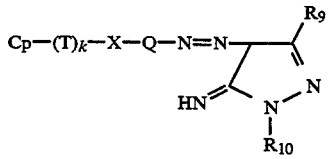
(CIII)

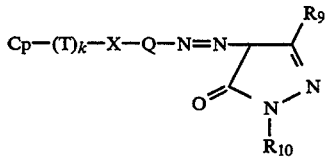
(CIV)

Cp in general formulae (CI) to (CIV) represents a cyan coupler residual group (a cyan coupler moiety; T is bonded to the coupling position of this group), T represents a timing group, k represents an integer of 0 or 1, X represents a divalent linking group, containing N, O or S, and which, by these, is bonded with $(T)_k$ and connected with Q, and Q represents an arylene group or a divalent heterocyclic group.

In general formula (CI), $R_1$ and $R_2$ each independently represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group or an alkylsulfonyl group, and $R_3$ represents a hydrogen atom, an alkyl group, a cycloalkyl group, an aryl group or a heterocyclic group. However, at least one of X, Q, $R_1$, $R_2$ and $R_3$ is a group which contains a water solubilizing group (which provides water solubility to the azo compound which is formed after the elimination; for example, hydroxyl, carboxyl, sulfo, amino, ammoniumyl, phosphono, phosphino, hydroxysulfonyloxy and salts thereof).

Moreover,

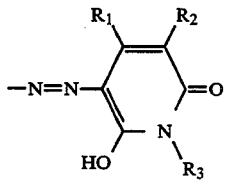

in general formula (CI) is well known to adopt tautomeric structural forms such as those indicated below, and these tautomeric structures are also included in the structure designated general formula (CI) of the present invention.

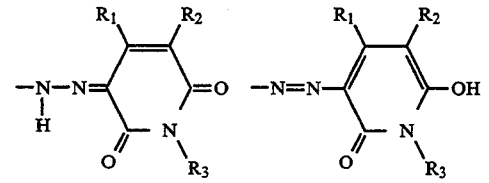

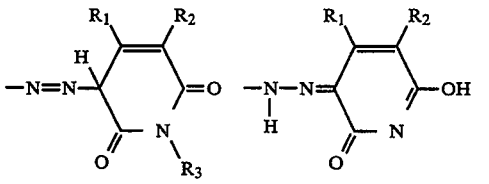

(When $R_3$ is a hydrogen atom)

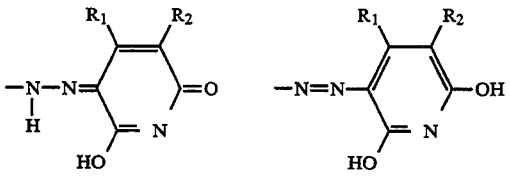

(When $R_3$ is a hydrogen atom) (When $R_3$ is a hydrogen atom)

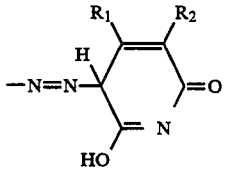

etc.

(When $R_3$ is a hydrogen atom)

$R_4$ in general formula (CII) represents an acyl group or an alkyl or aryl sulfonyl group, $R_5$ represents a group substitutable to the benzene ring, and j represents an integer from 0 to 4. When j is 2 or more, the $R_5$ groups may be the same or different. However, at least one of X, Q, $R_4$ and $R_5$ contains a water solubilizing group (for example, hydroxyl, carboxyl, sulfo, phosphono, phosphino, hydroxysulfonyloxy, amino, ammoniumyl and salts thereof).

In general formulae (CIII) and (CIV), $R_9$ represents a hydrogen atom, a carboxyl group, a sulfo group, a cyano group, an alkyl group, a cycloalkyl group, an aryl group, an alkoxy group, a cycloalkoxy group, an aryloxy group, a heterocyclic group, a carbamoyl group, a sulfamoyl group, a carbonamido group, a sulfonamido group or an alkylsulfonyl group, and $R_{10}$ represents a hydrogen atom, an alkyl group, a cycloalkyl group, an aryl group or a heterocyclic group. However, at least one of X, Q, $R_9$ and $R_{10}$ contains a water solubilizing group (for example, hydroxyl, carboxyl, sulfo, phosphono, phosphino, hydroxysulfonyloxy, amino, ammoniumyl). Furthermore,

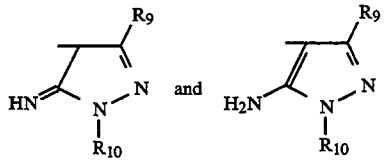

are related tautomerically and are the same compound.

The compounds which can be represented by general formulae (CI)–(CIV) are described in detail below.

The known cyan coupler residual groups (for example phenol and naphthol types) can be cited for the coupler residual groups represented by Cp.

The coupler residual groups represented by general formulae (Cp-6), (Cp-7) and (Cp-8) indicated below are preferred examples of Cp.

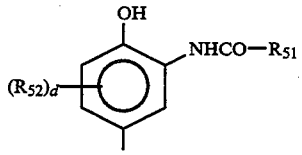

(Cp-6)

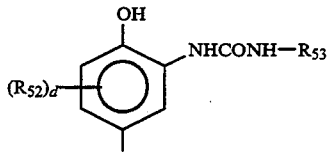

(Cp-7)

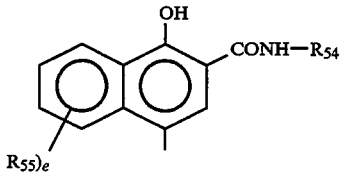

(Cp-8)

In these formulae, the free bond derived from the coupling position represents the bonding position of the coupling leaving group.

In these formulae, when $R_{51}$, $R_{52}$, $R_{53}$, $R_{54}$ or $R_{55}$ contains a ballast group the total number of carbon atoms is from 8 to 40, and preferably from 10 to 30, and in other cases the total number of carbon atoms is not more than 15. In the case of bis forms, telomeric and polymeric couplers, any of the above mentioned substituent groups represents a divalent group which connects the repeating units. In this case the number of carbon atoms may be outside the ranges specified above.

Below, $R_{41}$ represents an aliphatic group, an aromatic group or a heterocyclic group, $R_{42}$ represents an aromatic group or a heterocyclic group, and $R_{43}$, $R_{44}$ and $R_{45}$ each represents a hydrogen atom, an aliphatic group, aromatic groups or a heterocyclic group.

$R_{51}$, $R_{52}$, $R_{53}$, $R_{54}$, $R_{55}$, d and e are described in detail below.

$R_{51}$ has the same meaning as $R_{41}$; $R_{52}$ represents a group which has the same meaning as $R_{41}$, $R_{41}CON(R_{43})$—, $R_{41}OCON(R_{43})$—, $R_{41}SO_2N(R_{43})$—, $R_{43}NCON(R_{44})(R_{45})$—, $R_{41}O$—, $R_{41}S$—, a halogen atom or $R_{41}N(R_{43})$—.

Also, d represents an integer of from 0 to 3. Moreover, e represents an integer of from 1 to 4. When d is plural, the plural $R_{52}$ groups may be the same or different substituents. Furthermore, the $R_{52}$ groups may be divalent groups which are joined together to form ring structures. Typical examples of divalent groups for the formation of ring structures include the

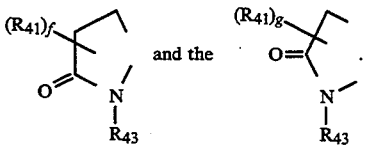

Here, f represents an integer of from 0 to 4 and g represents an integer of from 0 to 2. $R_{53}$ has the same meaning as $R_{41}$. When e is plural, the plural $R_{55}$ groups may be the same or different. $R_{54}$ has the same meaning as $R_{41}$, and $R_{55}$ represents a group which has the same meaning as $R_{41}$, $R_{41}OCONH$—, $R_{41}SO_2NH$—, $R_{43}NCON(R_{44})(R_{45})$—, $R_{43}NSO_2N(R_{44})(R_{45})$—, $R_{43}O$—, $R_{41}S$—, a halogen atom or $R_{41}N(R_{43})$—.

When there is a plurality of $R_{55}$ groups they may be the same or different groups.

The aliphatic groups referred above are saturated or unsaturated, chain like or cyclic, linear chain or branched, substituted or unsubstituted aliphatic hydrocarbon groups which have from 1 to 32, and preferably from 1 to 22 carbon atoms. Typical examples include methyl, ethyl, propyl, iso-propyl, butyl, tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl.

The aromatic groups preferably are substituted or unsubstituted naphthyl groups, or substituted or unsubstituted phenyl groups which preferably have from 6 to 20 carbon atoms.

The heterocyclic groups are preferably three to eight membered substituted or unsubstituted heterocyclic groups which have from 1 to 20, and preferably from 1 to 7 carbon atoms in which the hetero atoms are selected from among the nitrogen, oxygen and sulfur atoms. Typical examples of heterocyclic groups include 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl.

Typical substituent groups in those cases where the aforementioned aliphatic groups, aromatic groups and heterocyclic groups have substituents include halogen atoms, $R_{47}O$—, $R_{46}S$—, $R_{47}CON(R_{48})$—, $R_{47}NCO(R_{48})$—, $R_{46}OCON(R_{47})$—, $R_{46}SO_2N(R_{47})$—, $R_{47}NSO_2(R_{48})$—, $R_{46}SO_2$—, $R_{47}OCO$—, $R_{47}NCON(R_{48})(R_{49})$—, groups which have the same meaning as

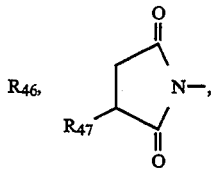

$R_{46}COO$—, $R_{47}OSO_2$—, cyano groups and nitro groups. Here, $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The meaning of the aliphatic groups, aromatic groups and heterocyclic groups is the same as that defined earlier.

In general formula [Cp-6], $R_{51}$ is preferably an aliphatic group or an aromatic group. $R_{52}$ is preferably a chlorine atom, an aliphatic group or $R_{41}CONH$—. Moreover, d is preferably 1 or 2. $R_{53}$ is preferably an aromatic group.

In general formula (Cp-7), $R_{52}$ is preferably an $R_{41}CONH$—. Preferably d is 1. $R_{53}$ is preferably an aliphatic group or an aromatic group.

In general formula (Cp-8), e is preferably 0 or 1. $R_{55}$ is preferably $R_{41}OCONH$—, $R_{41}CONH$— or $R_{41}SO_2NH$—, and these are preferably substituted in the 5-position of the naphthol ring.

The timing group represented by T is a group with which the bond with X is cleaved after the bond with Cp has been cleaved by a coupling reaction of the coupler with the oxidized product of a primary aromatic amine developing agent, and it is used for various purposes, for example to control the coupling reactivity, to stabilize the coupler and to control the release timing of X etc. The known groups indicated below can be cited as timing groups. Here, * signifies the bond with Cp and ** signifies the bond with X, or * signifies the bond with Cp and ** signifies the bond with Q. Preferably * signifies the bond with Cp and ** signifies the bond with X.

(T-1)

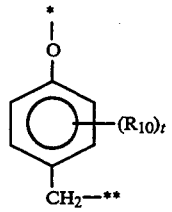

(T-2)

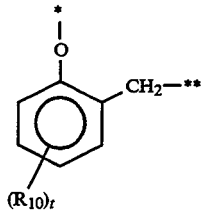

(T-3)

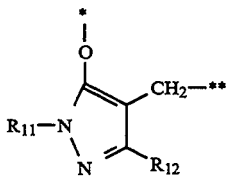

(T-4)

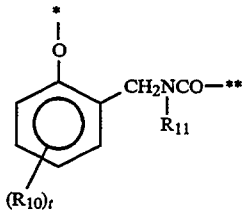

(T-5)

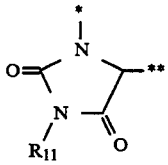

(T-6) *—$OCH_2$—**

(T-7) *—OC(=O)—**

In these formulae, $R_{10}$ represents a group which can be substituted on a benzene ring, $R_{11}$ has the same meaning as described for $R_{41}$, and $R_{12}$ represents a hydrogen atom or a substituent group. Moreover, t represents an integer of from 0 to 4. Substituent groups for $R_{10}$ and $R_{12}$ include, $R_{41}$, halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{43}CO$—, $R_{41}COO$—, $R_{41}SO$—, a nitro group, $R_{43}(R_{44})NCON(R_{45})$—, a cyano group, $R_{41}OCON(R_{43})$—, $R_{43}OSO_2$—, $R_{43}(R_{44})N$—, $R_{43}(R_{44})NSO_2N(R_{45})$— and

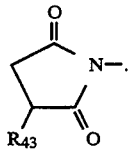

Moreover, k is an integer of 0 or 1 but, in general, cases where k is 0, which is to say cases in which Cp is bonded directly to X, are preferred.

X is a divalent group which is bonded to $(T)_k$ via N, O or S, and the preferred linking groups include

—O—, —S—, —OC(=O)—, —OCO—, —OCS—,

—OC(=O)NH—, —$OSO_2$—, —$OSO_2NH$— or a heterocyclic group which is bonded with $(T)_k$ via N (for example, a group derived from pyrrolidine, piperidine, morpholine, piperazine, pyrrole, pyrazole, imidazole, 1,2,4-triazole, benzotriazole, succinimide, phthalimide, oxazolidin-2,4-dione, imidazolidin-2,4-dione, 1,2,4-triazolidin-3,5-dione), and complex groups of these groups with alkylene groups (for example, methylene, ethylene, propylene), cycloalkylene groups (for example, 1,4-cyclohexylene), arylene groups (for example, o-phenylene, p-phenylene), divalent heterocyclic groups (for example, groups derived from pyridine and thiophene), —CO—, —$SO_2$—, —COO—, —CONH—, —$SO_2NH$—, —$SO_2O$—, —NHCO—, —$NHSO_2$—, —NHCONH—. —$NHSO_2NH$— and —NHCOO—. The most desirable X groups can be represented by general formula (II).

*—$X_1$-(L-$X_2$)$_m$—** (II)

In general formula (II), * indicates the position which is bonded with $(T)_k$, ** indicates the position which is bonded with Q, $X_1$ represents —O— or —S—, L represents an alkylene group, $X_2$ represents a single bond,

—O—, —S—, —CO—, —$SO_2$—, —OC(=O)—,

—CO(=O)—, —NHC(=O)—, —CNH(=O)—, —$SO_2NH$—,

—$NHSO_2$—, —$SO_2O$—, —$OSO_2$—, —OCO(=O)—,

—OCNH(=O)—, —NHCO(=O)—, —NHCNH(=O)—,

—$NHSO_2NH$—, —OCS(=O)—, —SCO(=O)—,

—$OSO_2NH$— or —$NHSO_2O$—, and m represents an integer of from 0 to 3. The total number of carbon atoms (referred to hereinafter as the C-number) of X is preferably from 0 to 12, and most desirably from 0 to 8. X is most desirably —$OCH_2CH_2O$—.

Q represents an arylene group or a divalent heterocyclic group. When Q is an arylene group it may have a condensed ring and it may have substituent groups (for example, halogen atoms, hydroxyl, carboxyl, sulfo, nitro, cyano, amino, ammonium, phosphono, phosphino, alkyl, cycloalkyl, aryl, carbonamido, sulfonamido, alkoxy, aryloxy, acyl, alkyl- or aryl sulfonyl, carboxyl, carbamoyl, sulfamoyl), and the C-number is preferably from 6 to 15, and most desirably from 6 to 10. When Q is a divalent heterocyclic group, the heterocyclic group is a three to eight membered, and preferably a five to seven membered, single ring or condensed ring heterocyclic group with at least one hetero atom selected from among N, O, S, P, Se and Te contained within the ring (for example, groups derived from pyridine, thiophene, furan, pyrrole, pyrazole, imidazole, thiazole, oxazole, benzothiazole, benzoxazole, benzofuran, benzothiophene, 1,3,4-thiadiazole, indole or quinoline), and it may have substituent groups (the same substituent groups as in those cases where Q is an arylene group), and the C-number is preferably from 2 to 15, and most desirably from 2 to 10. Q is most desirably

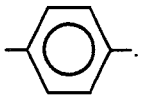

Hence, in the present invention —$(T)_k$—X—Q— most desirably represents

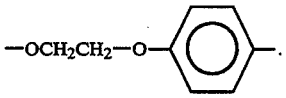

When $R_1$, $R_2$ or $R_3$ is an alkyl group, the alkyl group may be a linear chain or a branched chain alkyl group, it may contain unsaturated bonds, and it may have substituents (for example, halogen atoms, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, sulfonyl).

When $R_1$, $R_2$ or $R_3$ is a cycloalkyl group, the cycloalkyl group has a three to eight membered ring, it may have a crosslinking group, it may include unsaturated bonds and it may have substituents (the same substituents as when $R_1$, $R_2$ or $R_3$ is an alkyl group).

When $R_1$, $R_2$ or $R_3$ is an aryl group, the aryl group may be a condensed ring and it may have substituents (for example, alkyl groups and cycloalkyl groups in addition to the substituents when $R_1$, $R_2$ or $R_3$ is an alkyl group).

When $R_1$, $R_2$ or $R_3$ is a heterocyclic group, it is a three to eight membered (and preferably five to seven membered) single ring or condensed ring heterocyclic group which has at least one hetero atom selected from among N, S, O, P, Se and Te within the ring (for example, imidazolyl, thienyl, pyrazolyl, thiazolyl, pyridyl, quinolinyl), and it may have substituents (the same substituent groups as when $R_1$, $R_2$ or $R_3$ is an aryl group).

Here, a carboxyl group includes the carboxylate group, a sulfo group includes the sulfonate group, a phosphino group includes the phosphinate group, and a phosphono group includes the phosphonate group, and in such cases the counter ion is, for example, $Li^+$, $Na^+$, $K^+$ or ammonium.

$R_1$ is preferably a hydrogen atom, a carboxyl group, an alkyl group of C-number from 1 to 10 (for example, methyl, t-butyl, sulfomethyl, 2-sulfoethyl, carboxymethyl, 2-carboxyethyl, 2-hydroxyethyl, benzyl, ethyl, iso-propyl), or an aryl group of C-number from 6 to 12 (for example, phenyl, 4-methoxyphenyl, 4-sulfophenyl), and it is most desirably a hydrogen atom, a methyl group or a carboxyl group.

$R_2$ is preferably a cyano group, a carboxyl group, a carbamoyl group of C-number from 1 to 10, a sulfamoyl group of C-number from 0 to 10, a sulfo group, an alkyl group of C-number from 1 to 10 (for example, methyl, sulfomethyl), a sulfonyl group of C-number from 1 to 10 (for example, methylsulfonyl, phenylsulfonyl), a carbonamido group of C-number from 1 to 10 (for example, acetamido, benzamido) or a sulfonamido group of C-number from 1 to 10 (for example, methanesulfonamido, toluenesulfonamido), and it is most desirably a cyano group, a carbamoyl group or a carboxyl group.

$R_3$ is preferably a hydrogen atom, an alkyl group of C-number from 1 to 12 (for example, methyl, sulfomethyl, carboxymethyl, 2-sulfoethyl, 2-carboxyethyl, ethyl, n-butyl, benzyl, 4-sulfobenzyl) or an aryl group of C-number from 6 to 15 (for example, phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl), and it is most desirably an alkyl group of C-number from 1 to 7 or an aryl group of C-number from 6 to 10.

$R_4$ is, in practical terms, an acyl group represented by general formula (III) or a sulfonyl group which can be represented by general formula (IV).

$$R_{11}\underset{\underset{O}{\|}}{C}- \qquad \text{(III)}$$

$$R_{11}SO_2- \qquad \text{(IV)}$$

When $R_{11}$ is an alkyl group it may be either a linear chain or a branched chain form, it may contain unsaturated bonds, and it may have substituents (for example, halogen atom, hydroxyl, carboxyl, sulfo, phosphono, phosphino, cyano, alkoxy, aryl, aryloxycarbonyl, amino, ammoniumyl, acyl, carbonamido, sulfonamido, carbamoyl, sulfamoyl, sulfonyl).

When $R_{11}$ is a cycloalkyl group, it is a three to eight membered cycloalkyl group, and it may have a crosslinking group, it may have unsaturated bonds, and it may have substituents (the same as the substituents when $R_{11}$ is an alkyl group).

When $R_{11}$ is an aryl group, it may be a condensed ring and it may have substituents (for example, alkyl and cycloalkyl groups in addition to the substituents when $R_{11}$ is an alkyl group).

When $R_{11}$ is a heterocyclic group, it is a three to eight membered (and preferably a five to seven membered) single ring or condensed ring heterocyclic group which has at least one hetero atom selected from among N, S, O, P, Se and Te within the ring (for example, imidazolyl, thienyl, pyrazolyl, thiazolyl, pyridyl, quinolinyl), and it may have substituents (the same substituents as when $R_{11}$ is an aryl group).

Here, a carboxyl group includes the carboxylate group, a sulfo group includes the sulfonate group, a phosphino group includes the phosphinate group and a phosphono group includes the phosphonate group, and in such cases the counter ion is, for example, $Li^+$, $Na^+$, $K^+$ or ammonium.

$R_{11}$ is preferably an alkyl group of C-number from 1 to 10 (for example, methyl, carboxymethyl, sulfoethyl, cyanoethyl), a cycloalkyl group of C-number from 5 to 8 (for example, cyclohexyl, 2-carboxycyclohexyl, or an aryl group of C-number from 6 to 10 (for example, phenyl, 1-naphthyl, 4-sulfophenyl), and it is most desirably an alkyl group of C-number from 1 to 3 or an aryl group of C-number 6.

$R_5$ is a substitutable group, preferably an electron donating group, and most desirably an $—NR_{12}R_{13}$ group or an $—OR_{14}$ group. Substitution in the 4-position is preferred. $R_{12}$, $R_{13}$ and $R_{14}$ are hydrogen atoms, alkyl groups, cycloalkyl groups, aryl groups or heterocyclic groups (having the same meaning as the heterocyclic groups represented by $R_{11}$). Furthermore, a ring can be formed between $R_{12}$ and $R_{13}$ and it is preferred for the nitrogen containing heterocyclic ring that the ring is formed by alkyl groups represented by $R_2$ and $R_3$.

Moreover, j represents an integer of from 0 to 4, preferably 1 or 2, and most desirably 1.

When $R_9$ or $R_{10}$ is an alkyl group, it may be either a linear chain or a branched chain form, it may contain unsaturated bonds, and it may have substituents (for example, halogen atom, hydroxyl, carboxyl, sulfo, phosphono, phosphino, cyano, alkoxy, aryl, alkoxycarbonyl, amino, ammoniumyl, acyl, carbonamido, sulfonamido, carbamoyl, sulfamoyl, sulfonyl).

When $R_9$ or $R_{10}$ is a cycloalkyl group, it is a three to eight membered ring, it may have a crosslinking group, it may have unsaturated bonds, and it may have substituents (the same as the substituents when $R_9$ or $R_{10}$ is an alkyl group).

When $R_9$ or $R_{10}$ is an aryl group, it may be a condensed ring group and it may have substituents (for example, alkyl and cycloalkyl groups in addition to the substituents when $R_9$ or $R_{10}$ is an alkyl group).

When $R_9$ or $R_{10}$ is a heterocyclic group, it is a three to eight membered (and preferably a five to seven membered) single ring or condensed heterocyclic group which has at least one hetero atom selected from among N, S, O, P, Se and Te within the ring (for example, imidazolyl, thienyl, pyrazolyl, thiazolyl, pyridyl, quinolinyl), and it may have substituents (the same substituents as when $R_9$ or $R_{10}$ is an aryl group).

Here, a carboxyl group includes the carboxylate group, a sulfo group includes the sulfonate group, a phosphino group includes the phosphinate groups and a phosphono group includes the phosphonate group, and in such cases the counter ion is, for example, $Li^+$, $Na^+$, $K^+$ or ammonium.

$R_9$ is preferably a cyano group, a carboxyl group, a carbamoyl group of C-number from 1 to 10, an alkoxycarbonyl group of C-number from 2 to 10, an aryloxycarbonyl group of C-number from 7 to 11, a sulfamoyl group of C-number from 0 to 10, a sulfo group, an alkyl group of C-number from 1 to 10 (for example, methyl, carboxymethyl, sulfomethyl), a sulfonyl group of C-number from 1 to 10 (for example, methylsulfonyl, phenylsulfonyl), a carbonamido group of C-number from 1 to 10 (for example, acetamido, benzamido), a sulfonamido group of C-number from 1 to 10 (for example, methanesulfonamido, toluenesulfonamido), an alkoxy group (for example, methoxy, ethoxy) or an aryloxy group (for example, phenoxy), and it is most desirably a cyano group, a carbamoyl group, an alkoxycarbonyl group or a carboxyl group.

$R_{10}$ is preferably a hydrogen atom, an alkyl group of C-number from 1 to 12 (for example, methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl) or an aryl group of C-number from 6 to 15 (for example, phenyl, 4-carboxyphenyl, 3-carboxyphenyl, 2,4-dicarboxyphenyl, 4-sulfophenyl, 3-sulfophenyl, 2,5-disulfophenyl, 2,4-disulfophenyl), and it is most desirably an alkyl group of C-number from 1 to 7 or an aryl group of C-number from 6 to 10.

Examples of Cp, X, Q,

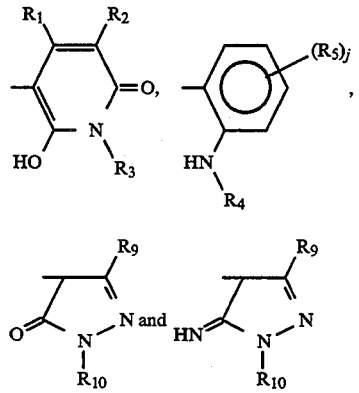

in general formulae (CI) to (CIV) are indicated below.

Examples of Cp

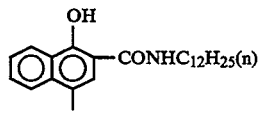

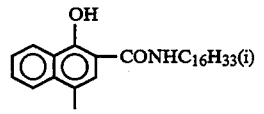

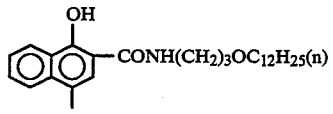

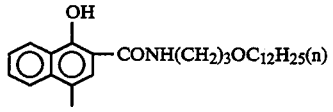

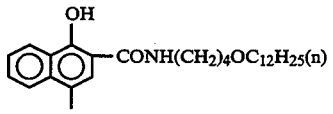

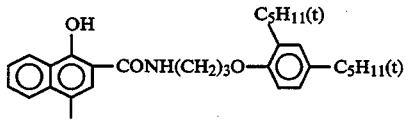

-continued
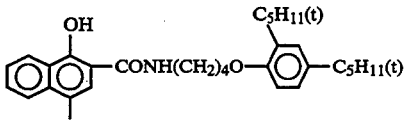
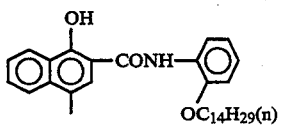
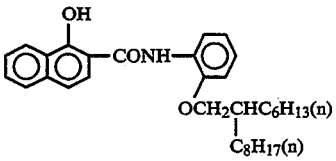
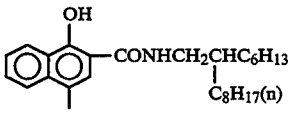
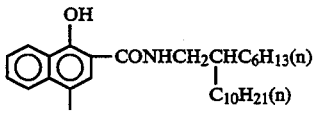
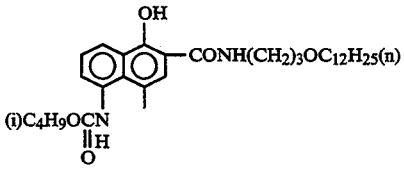
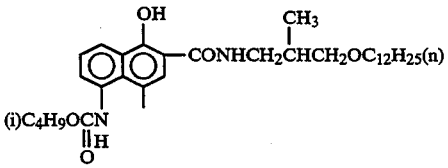
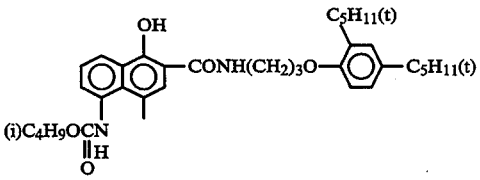
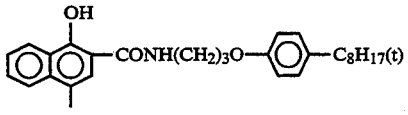
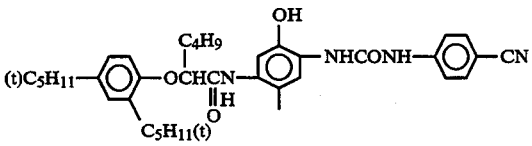
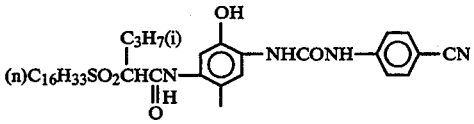
-continued
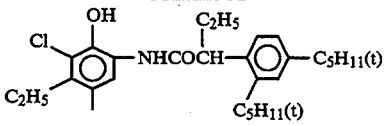
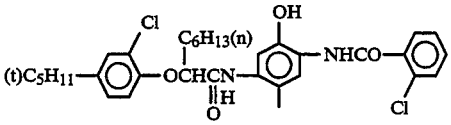
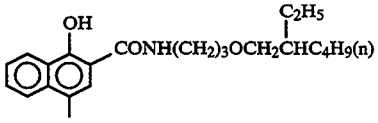
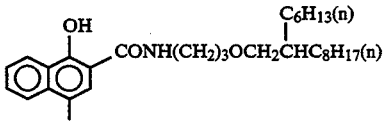
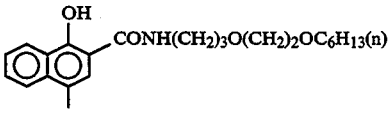
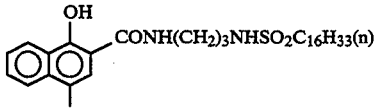
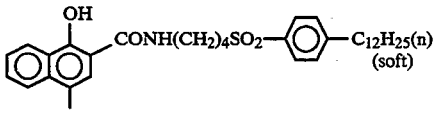
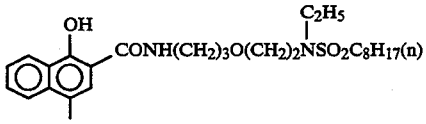
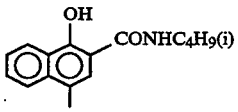
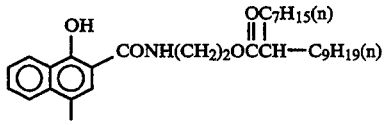
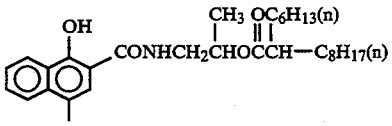
Examples of X
—O—, —S—, —$OCH_2$—, —$OCH_2CH_2$—, —$OCH_2CH_2O$—, —$OCH_2CH_2CH_2O$—, —$O(CH_2CH_2O)_2$—, —$OCH_2CH_2S$—, -continued
$-OCH_2CH_2NHCO-$, $-OCH_2CH_2NHSO_2-$,
$-OCH_2CH_2SO_2-$, $-OCH_2CH_2OCO-$,
$-OCH_2CH_2CO-$, $-SCH_2CONH-$,
$-SCH_2COO-$, $-OCH(CH_3)CONH-$,
$-OCH_2CH_2OSO_2-$, $-OCO-$, $-OCH_2CH(CO_2H)-$,
$-OCH_2CH(CO_2H)CH_2-$, $-OCH_2CH(CO_2H)O-$, $-OCH(CO_2H)CH_2O-$,
$-OCH_2CH(CO_2H)S-$, $-OCH_2CH(SO_3Na)O-$,
Example of Q
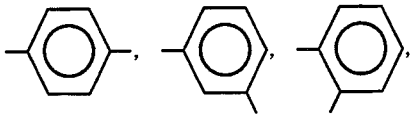
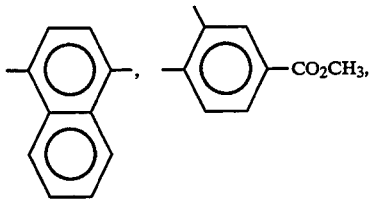
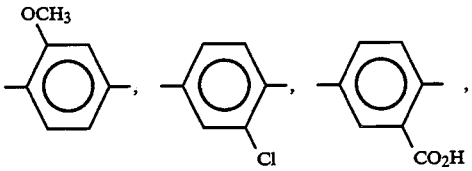
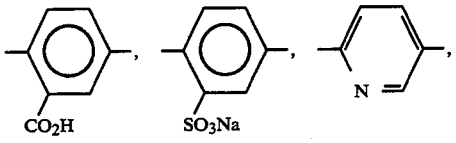
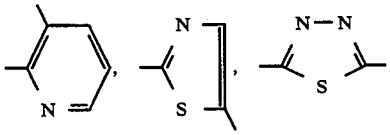
Examples of
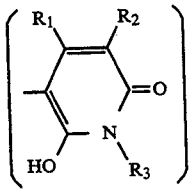
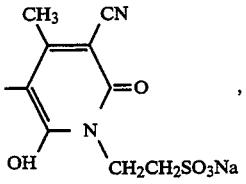
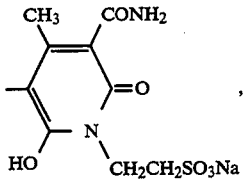
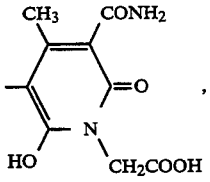
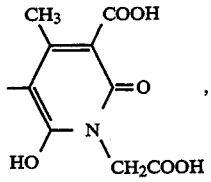
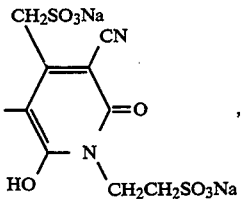
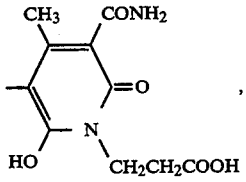

-continued
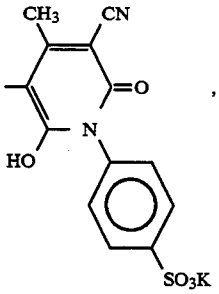
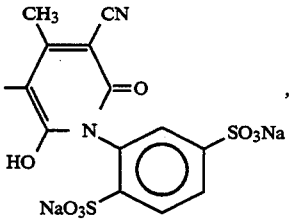
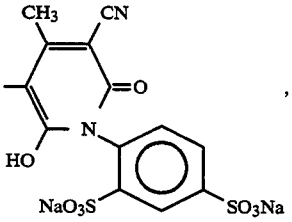
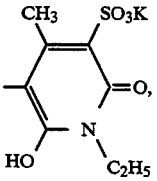
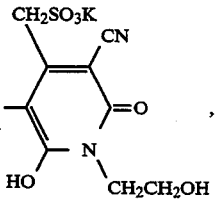
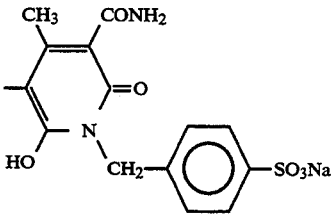
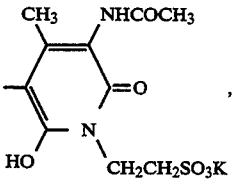
-continued
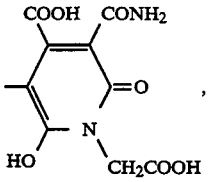
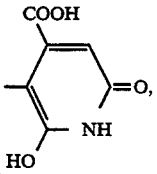
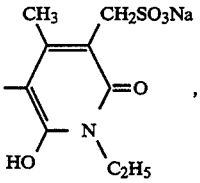
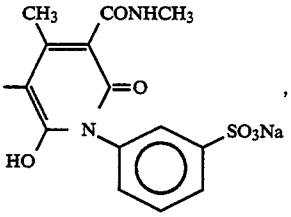
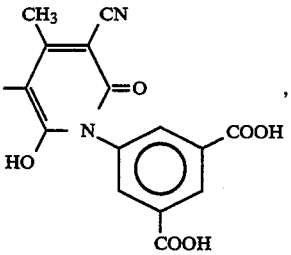
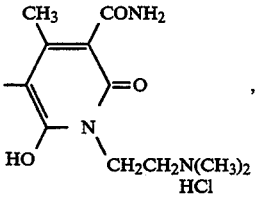
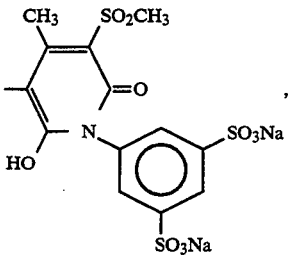
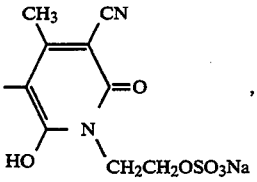

-continued
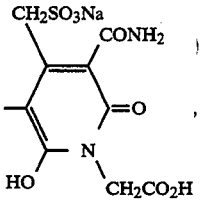
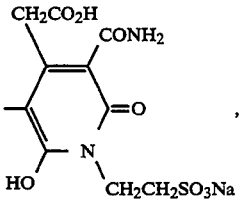
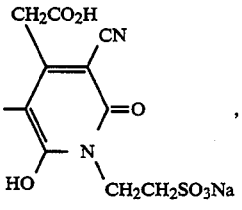
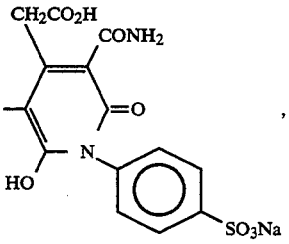
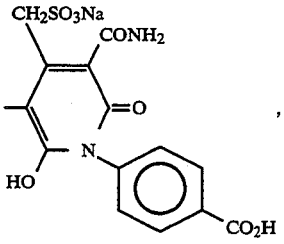
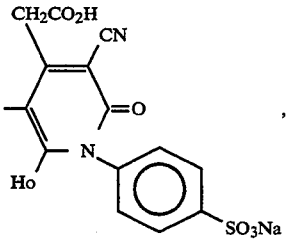
-continued
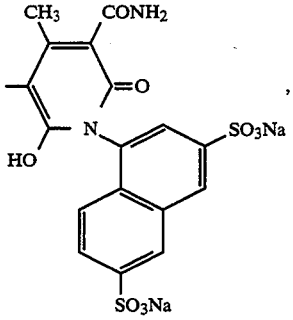
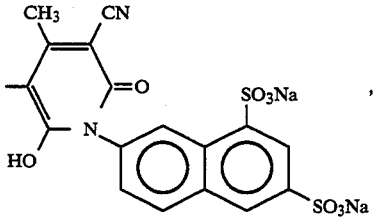
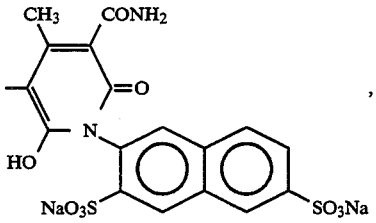
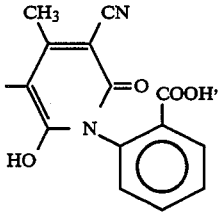
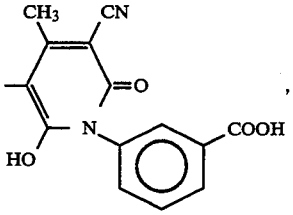
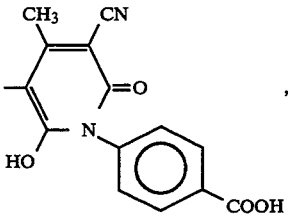

-continued
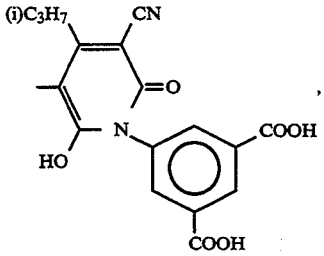
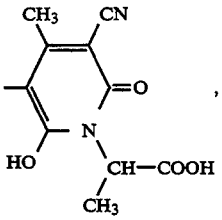
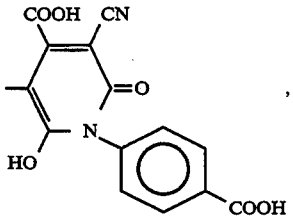
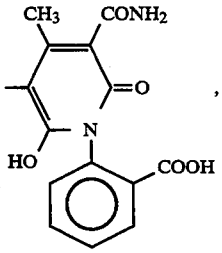
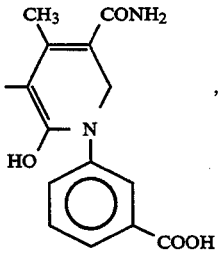
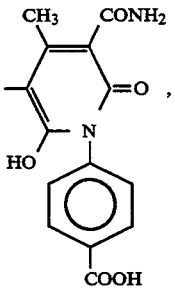
-continued
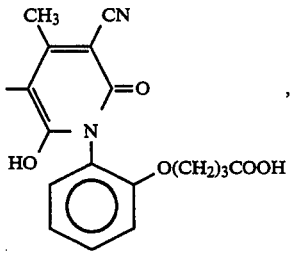
Examples of
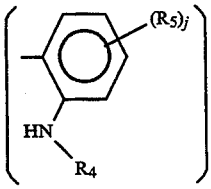
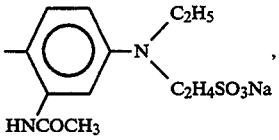
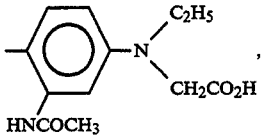
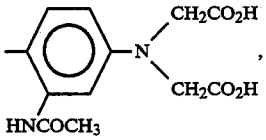
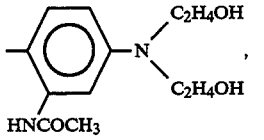
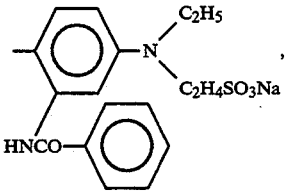
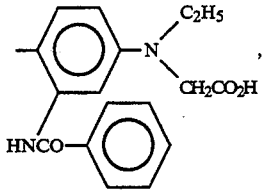
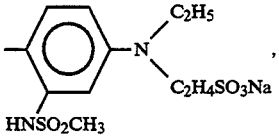
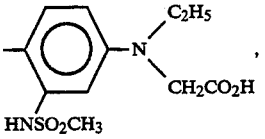
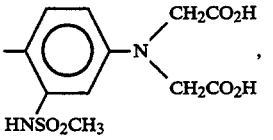
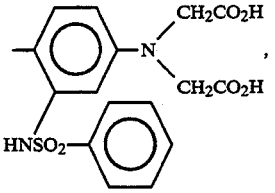

-continued
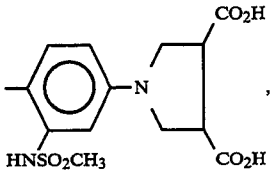
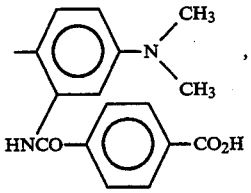
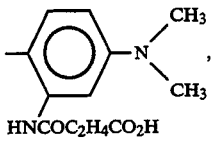
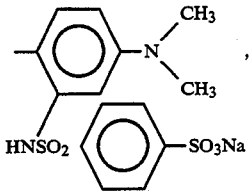
Examples of
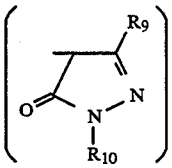
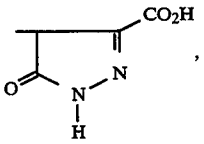
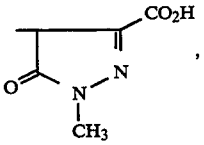
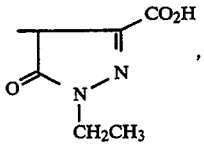
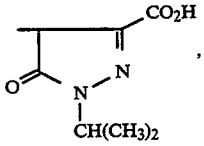
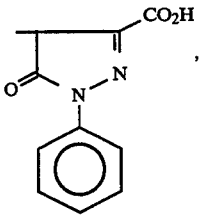
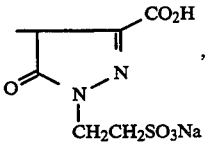
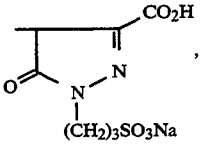
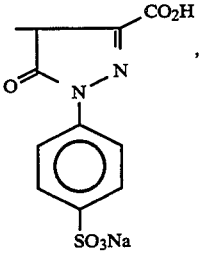
-continued
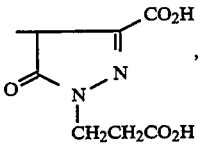
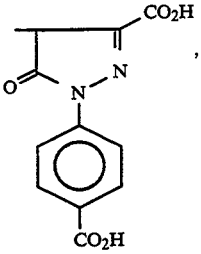
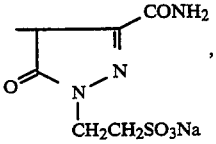
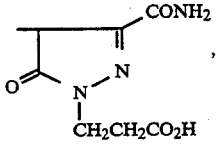
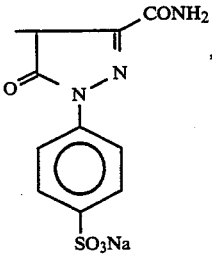
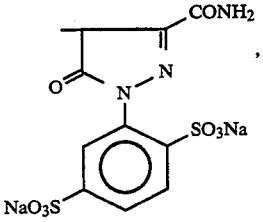
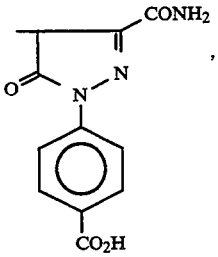
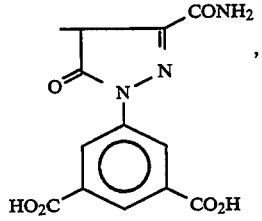
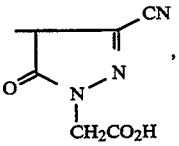
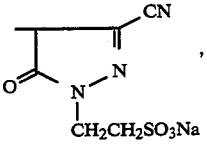
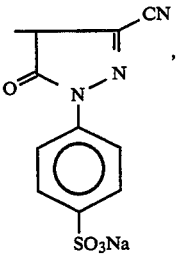
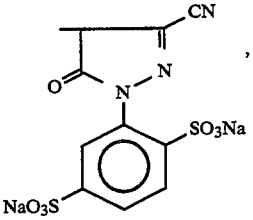
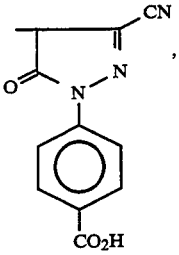
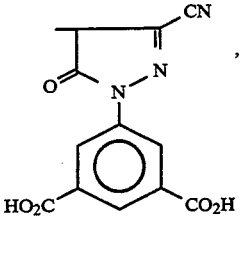

-continued
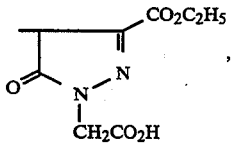
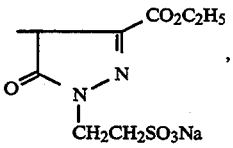
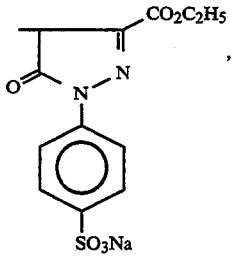
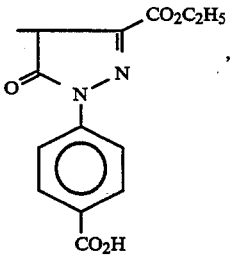
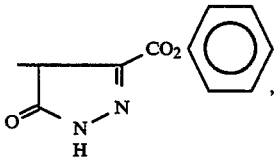
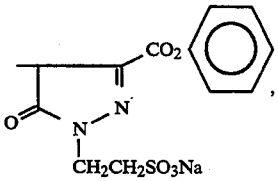
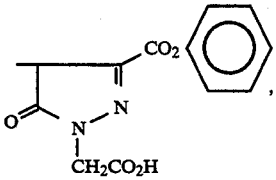
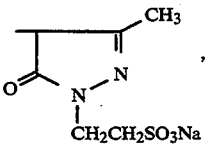
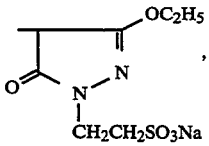
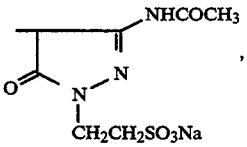
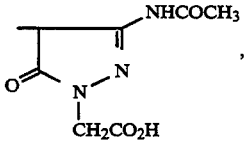
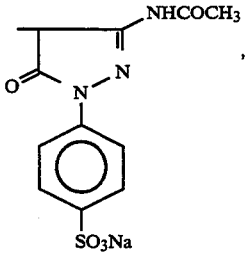
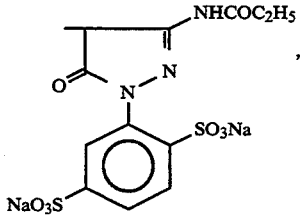
-continued
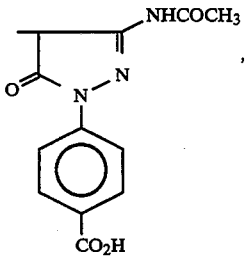
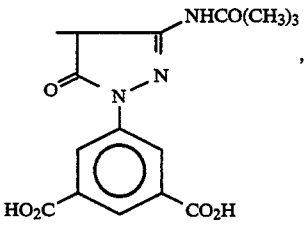
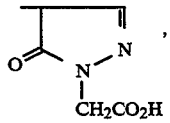
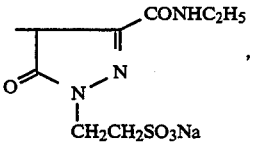
Examples of
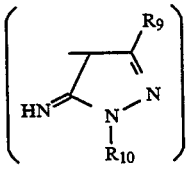
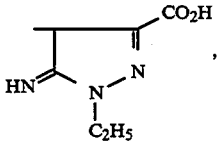
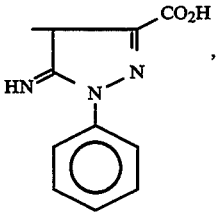
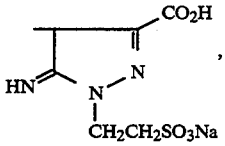
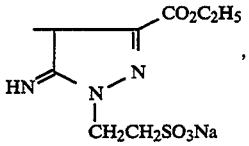
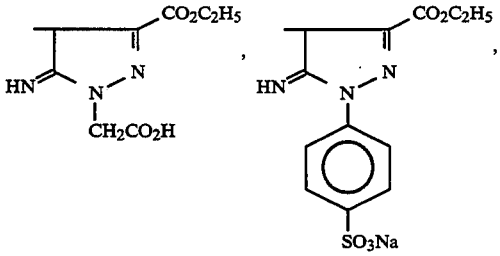
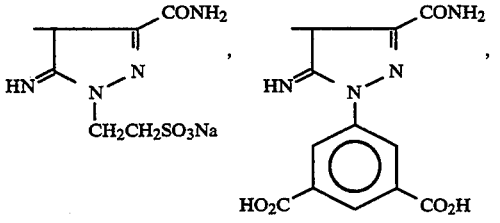

-continued
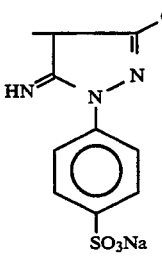
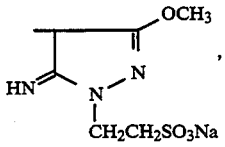
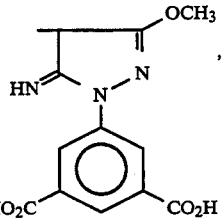
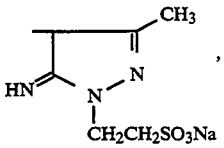
-continued
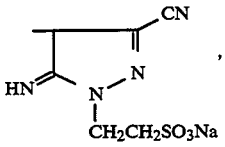
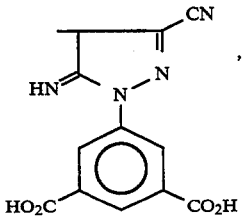
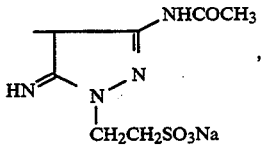
Actual examples of yellow colored cyan couplers used in the present invention are indicated below, but the couplers are not limited by these examples.
(YC-1)
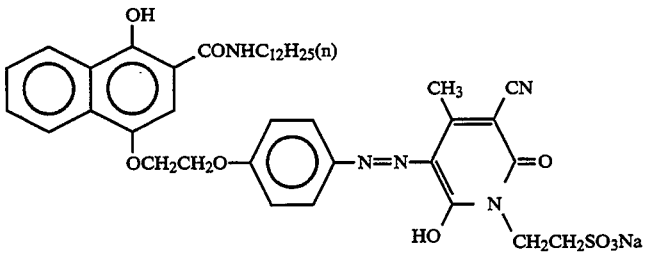
(YC-2)
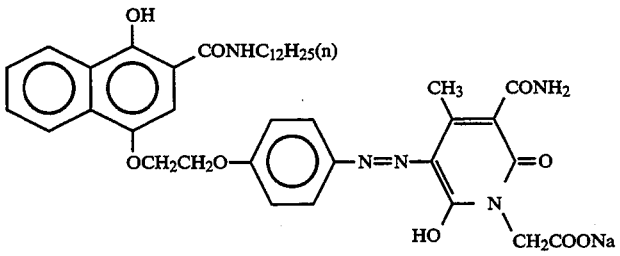
(YC-3)
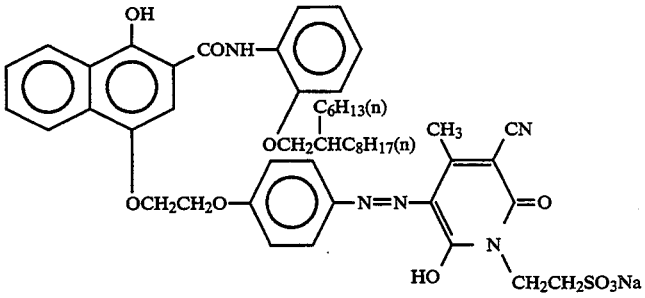
(YC-4)
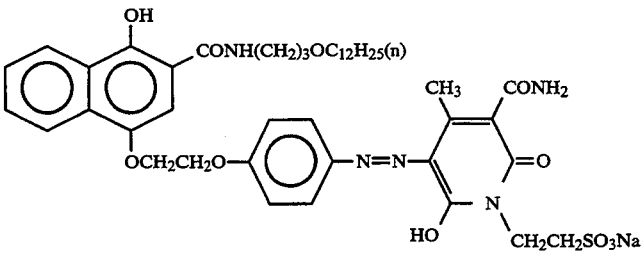

-continued
(YC-5)
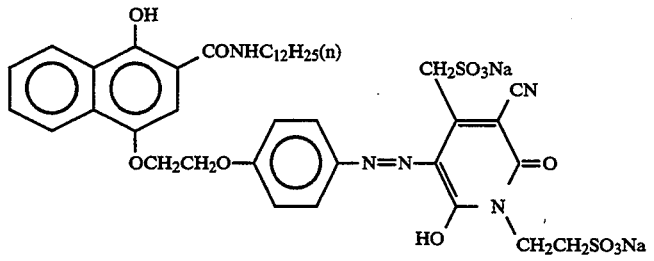
(YC-6)
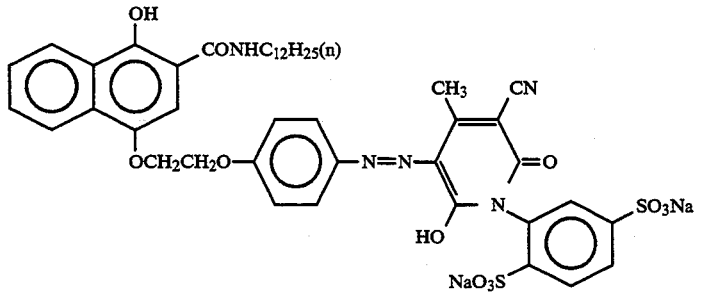
(YC-7)
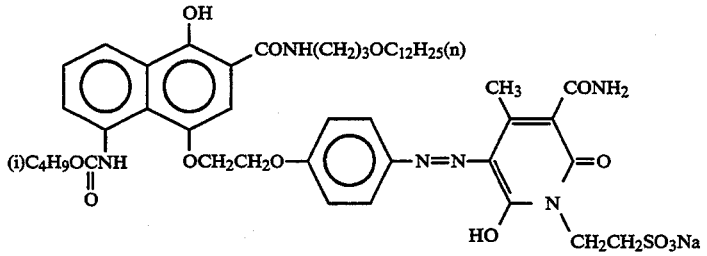
(YC-8)
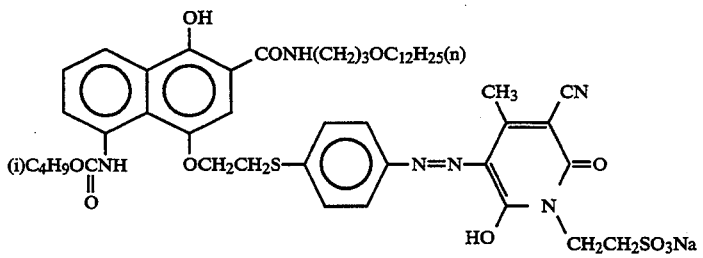
(YC-9)
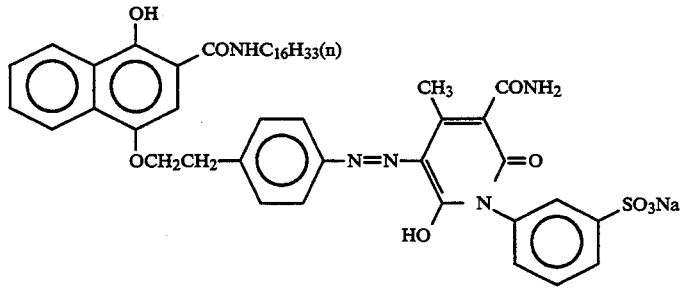
(YC-10)
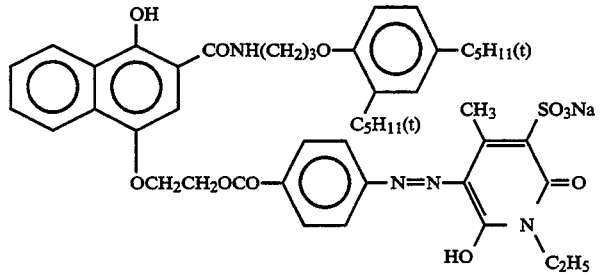

-continued
(YC-11)
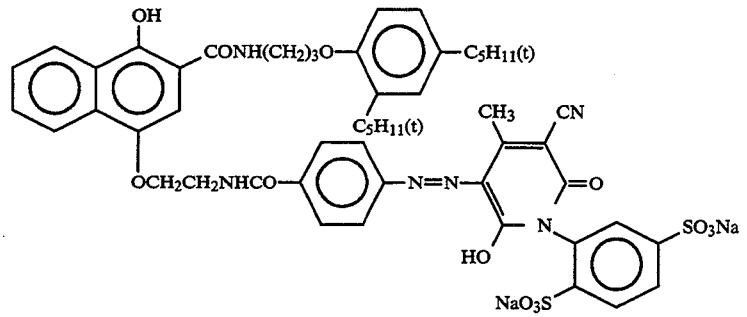
(YC-12)
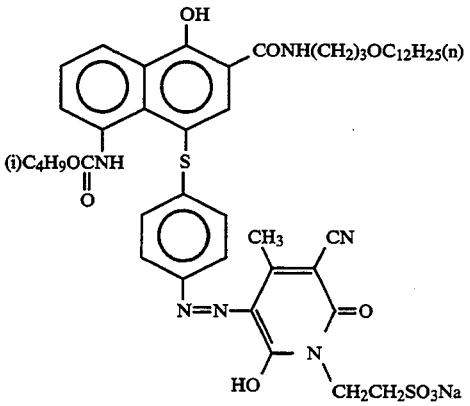
(YC-13)
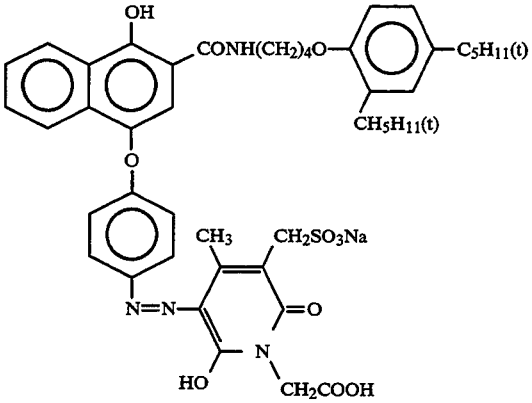
(YC-14)
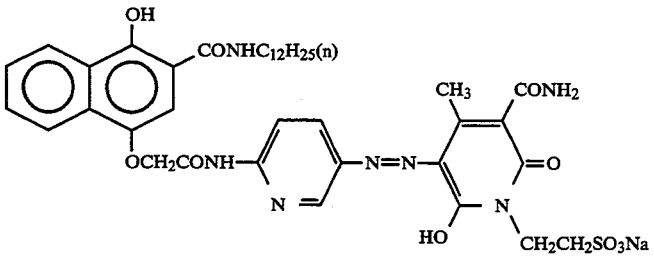
(YC-15)
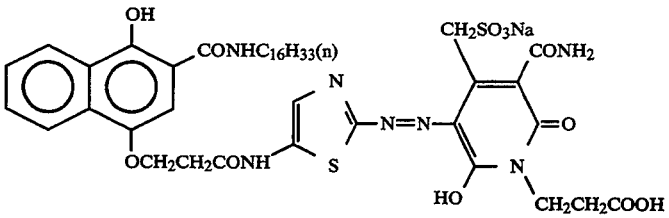

-continued
(YC-16)
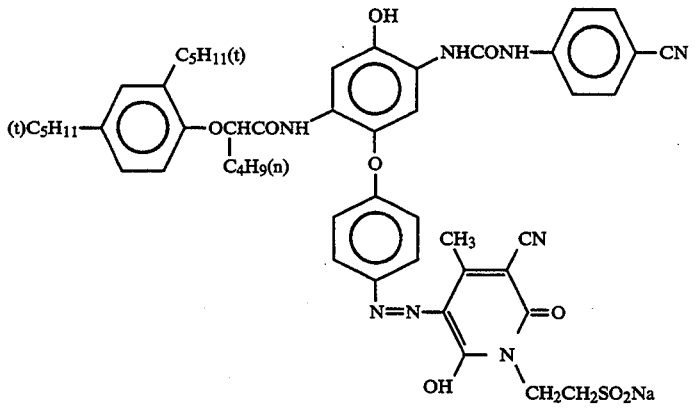
(YC-17)
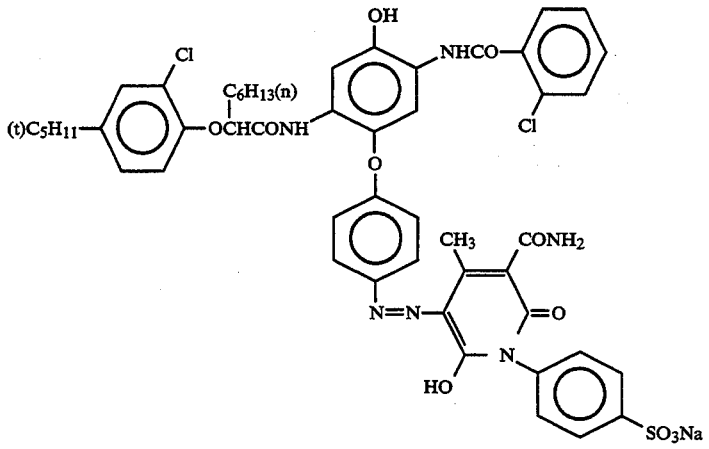
(YC-18)
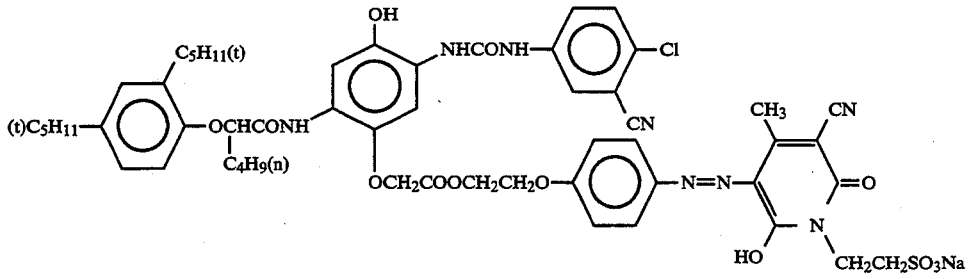
(YC-19)
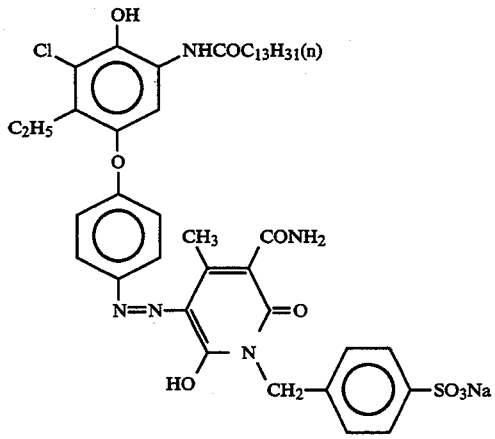

-continued
(YC-20)
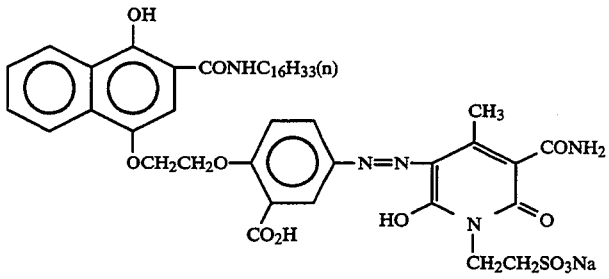
(YC-21)
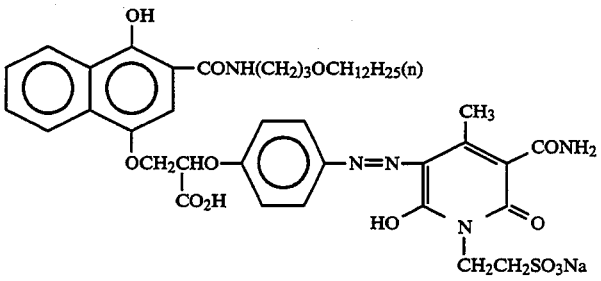
(YC-22)
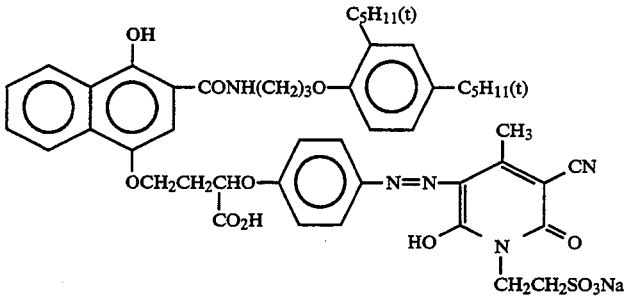
(YC-23)
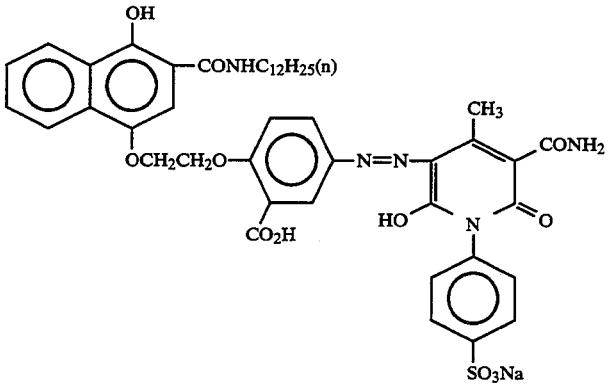
(YC-24)
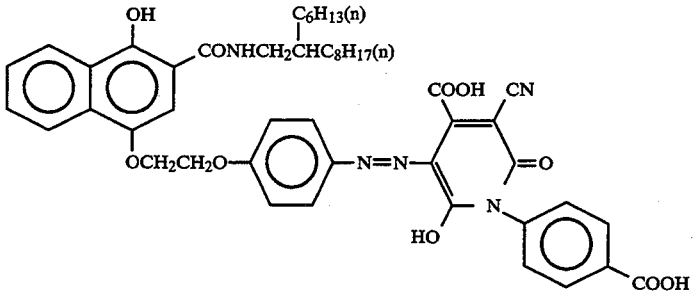

-continued
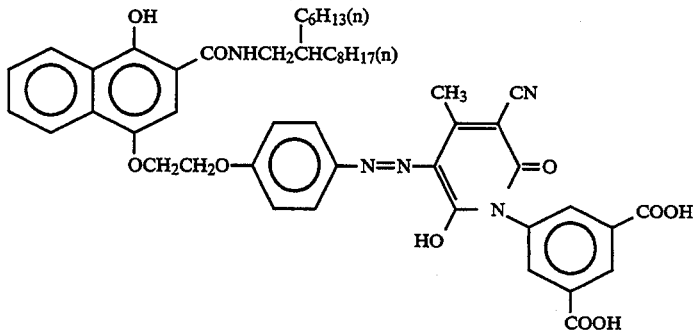
(YC-25)
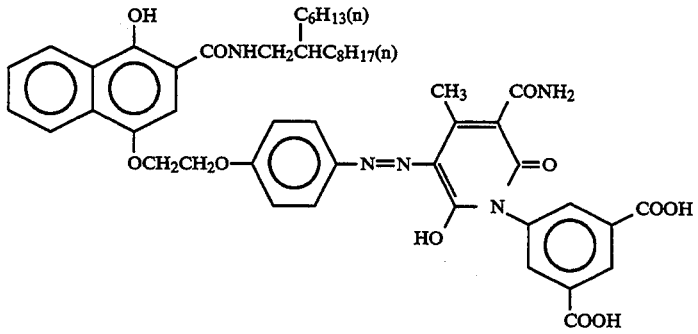
(YC-26)
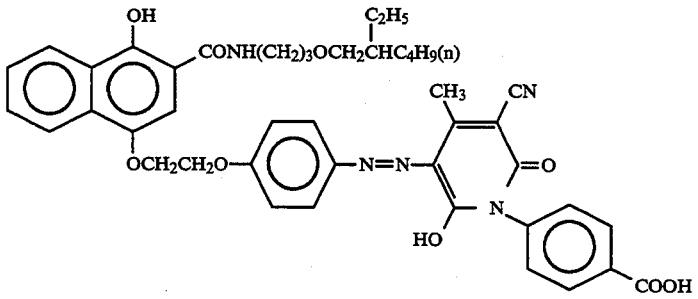
(YC-27)
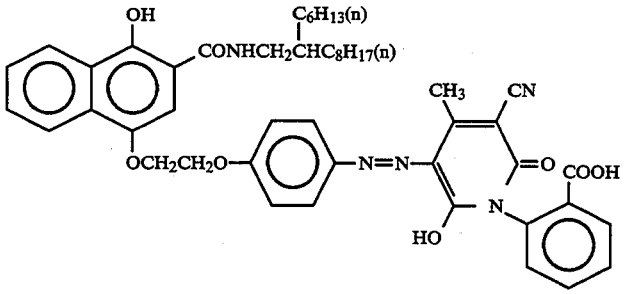
(YC-28)
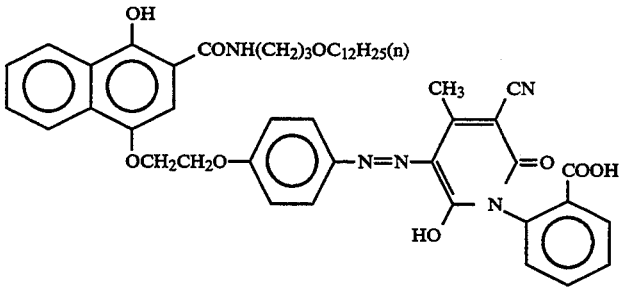
(YC-29)

-continued
(YC-30)
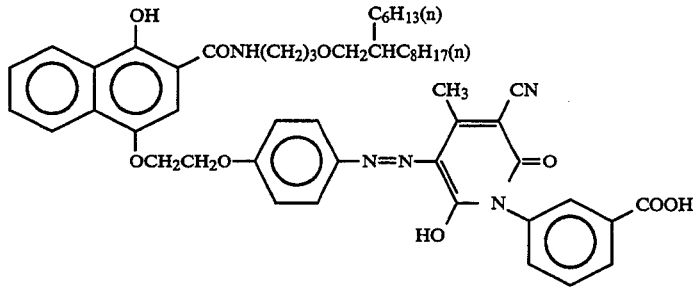
(YC-31)
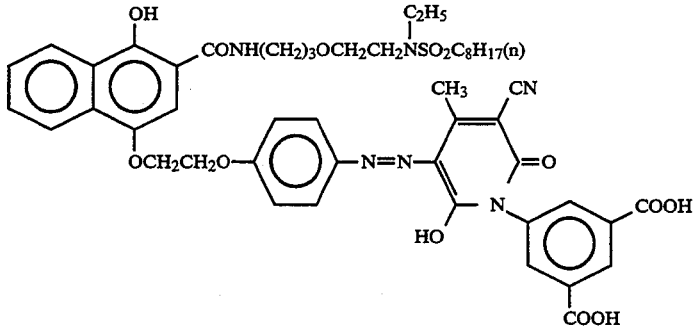
(YC-32)
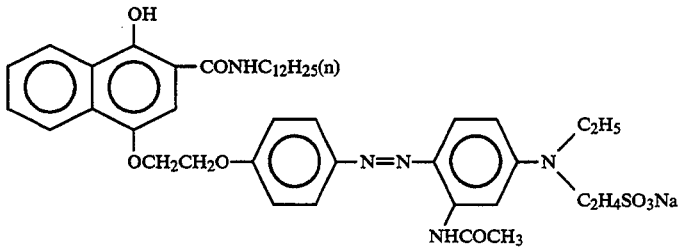
(YC-33)
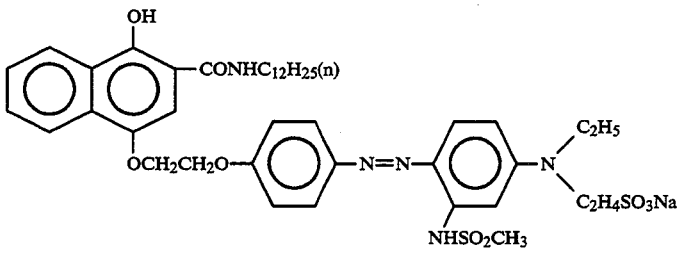
(YC-34)
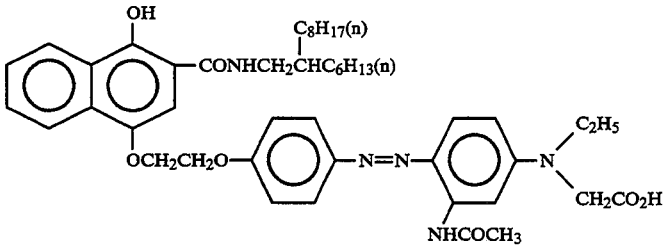
(YC-35)
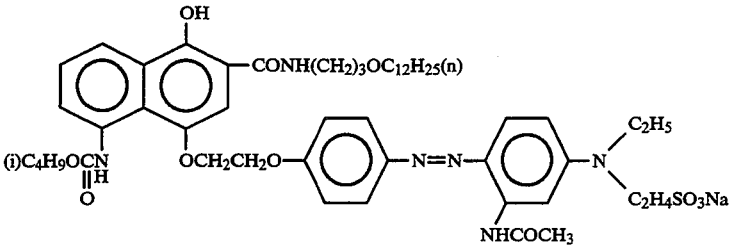

-continued
(YC-36)
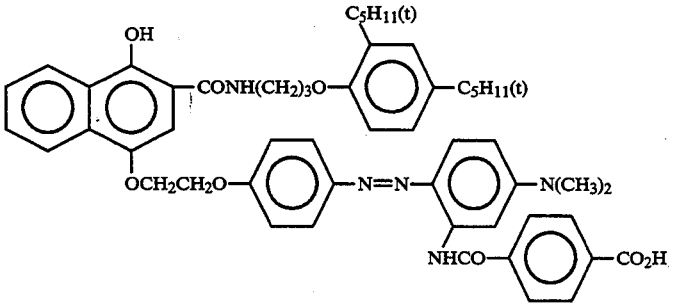
(YC-37)
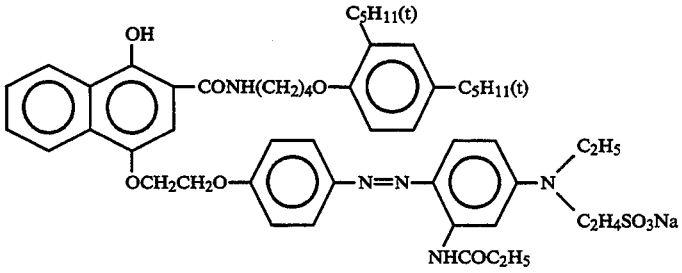
(YC-38)
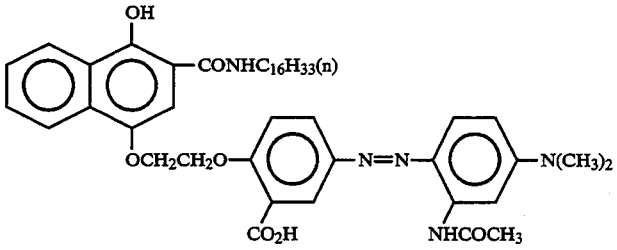
(YC-39)
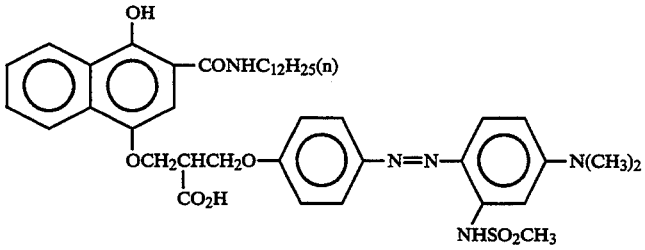
(YC-40)
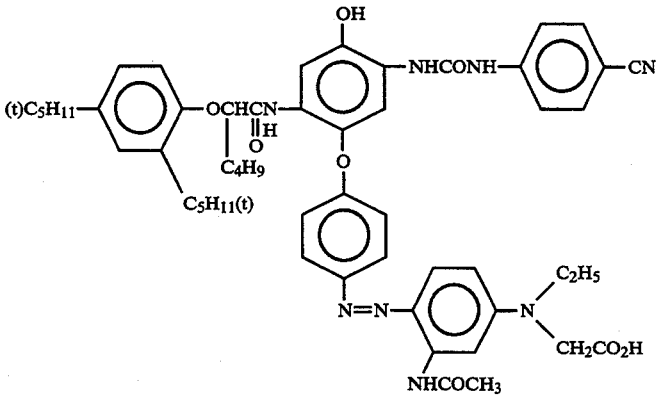

-continued
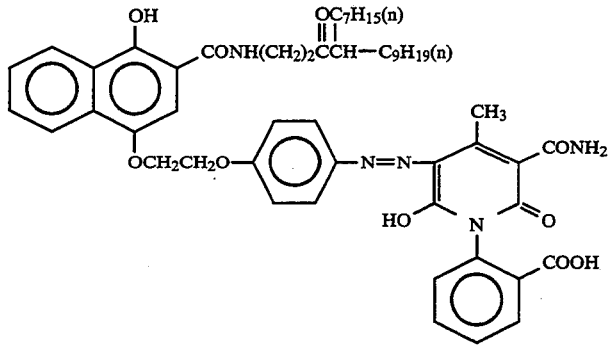
(YC-41)
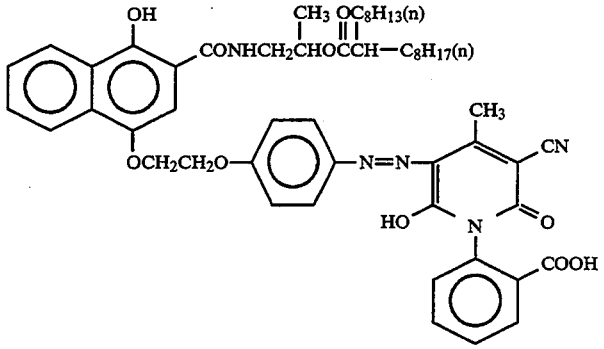
(YC-42)
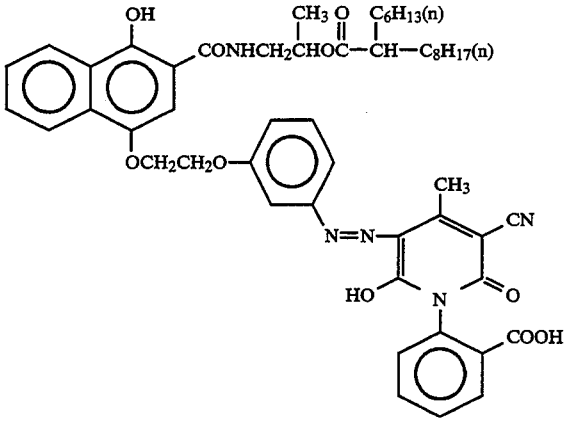
(YC-43)
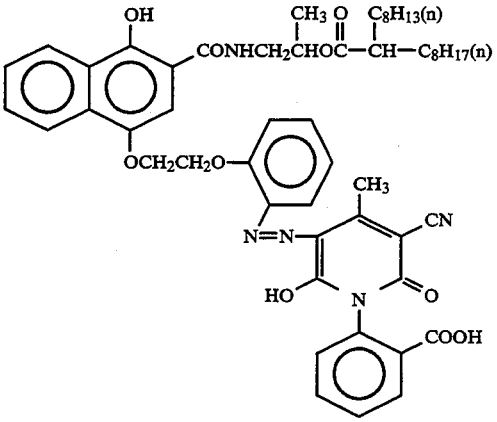
(YC-44)

-continued
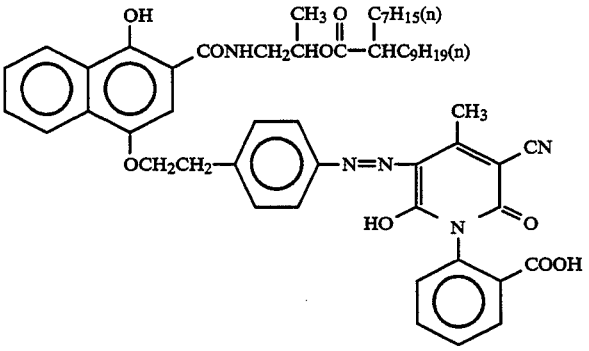
(YC-45)
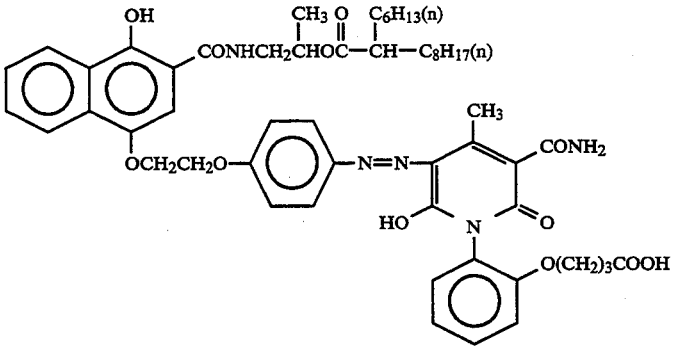
(YC-46)
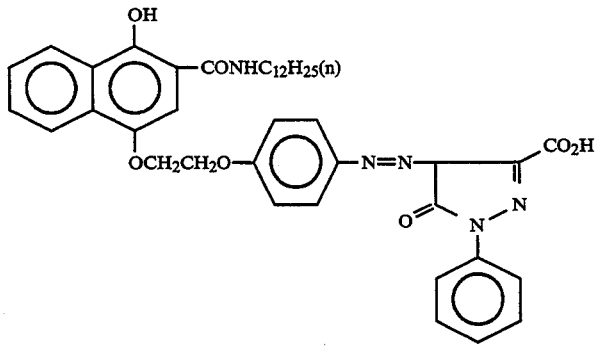
(YC-47)
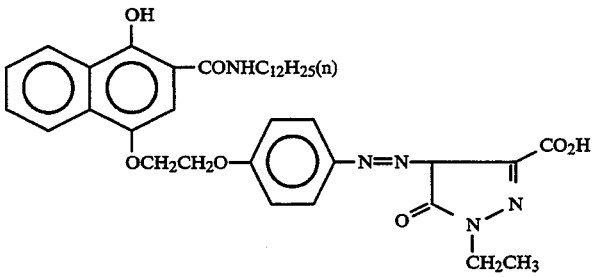
(YC-48)

-continued
(YC-49)
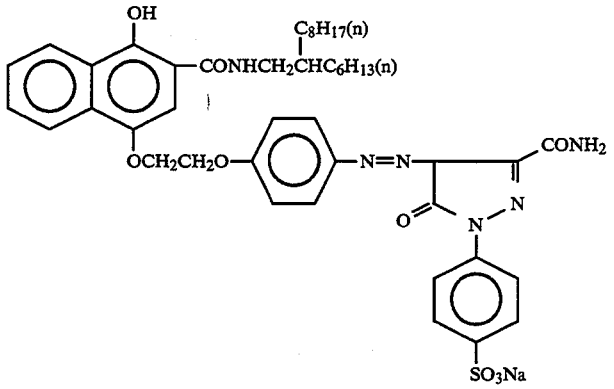
(YC-50)
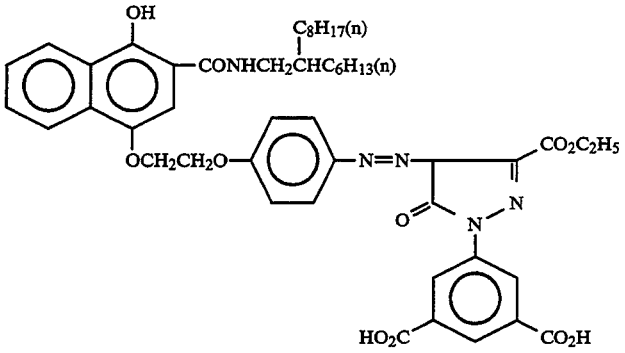
(YC-51)
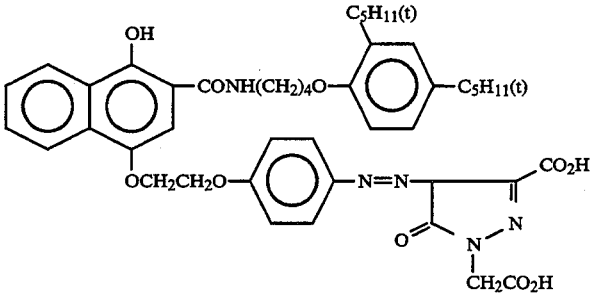
(YC-52)
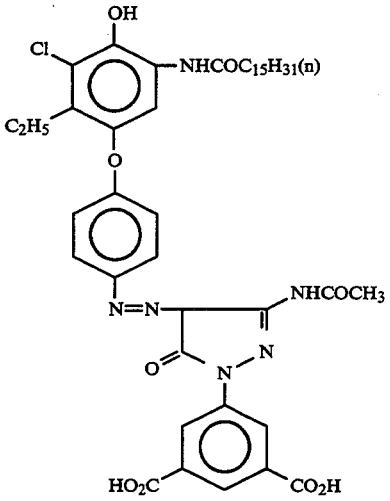

-continued

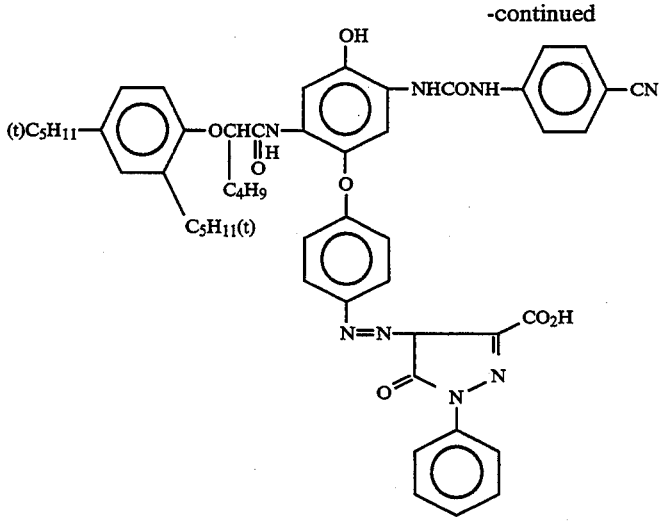

(YC-53)

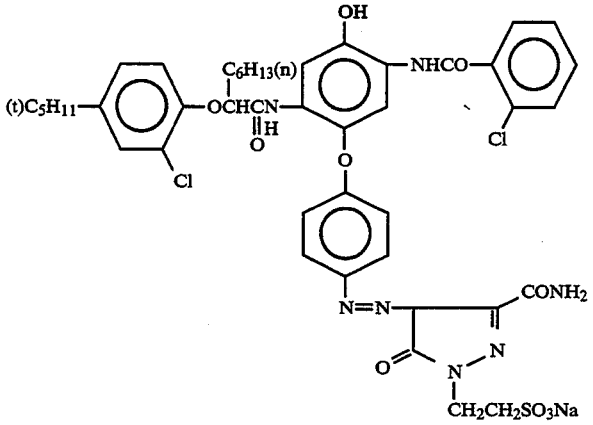

(YC-54)

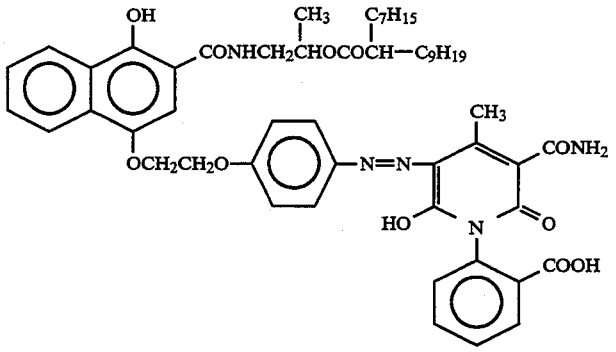

YC-55

Yellow colored couplers represented by general formula (CI) used in the present invention can in general be prepared by means of a diazo coupling reaction between a 6-hydroxy-2-pyridone and an aromatic diazonium salt or a heterocyclic diazonium salt which contains the coupler structure.

The 6-hydroxy-2-pyridones can be prepared, for example, using the methods disclosed in *Heterocyclic Compounds-Pyridine and Its Derivatives,* Part 3, edited by Grinsberg (Interscience Publishers, 1962), *J. Am Chem. Soc.,* 1943, Vol. 65, page 449, *J. Chem. Tech. Biotechnol.,* 1986, Vol. 36, page 410, *Tetrahedron,* 1966, Vol. 22, page 445, JP-B-61-52827, West German Patents 2,162,612, 2,349,709 and 2,902,486, and U.S. Pat. No. 3,763,170 for example. (The term "JP-B" as used herein signifies an "examined Japanese patent publication".)

The diazonium salts can be prepared using the methods disclosed, for example, in U.S. Pat. Nos. 4,004,929 and 4,138,258, JP-A-61-72244 and JP-A-61-273543. The diazo coupling reaction between a 6-hydroxy-2-pyridone and a diazonium salt can be carried out in a solvent such as methanol, ethanol, methylcellosolve, acetic acid, N,N-dimethylformamide, N,N-dimethylacetamide, tetrahydrofuran, dioxane or water, or in a mixture of such solvents. At this time sodium acetate, potassium acetate, sodium carbonate, potassium carbonate, sodium bicarbonate, sodium hydroxide, potassium hydroxide, pyridine, triethylamine, tetramethylurea, and tetramethylguanidine, for example, can be used as a base. The reaction temperature is normally between −78° C. and 60° C., and preferably between −20° C. and 30° C.

Examples of the synthesis of yellow colored couplers used in the present invention are described below.

Example of Synthesis 1-Preparation of Illustrative Coupler (YC-1)

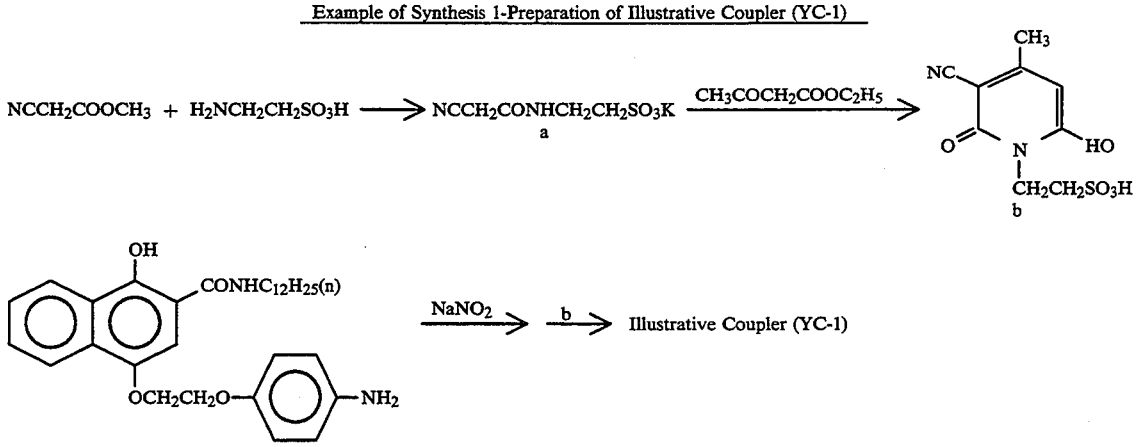

Preparation of Compound a

Methanol (500 ml) was added to 125.2 grams of taurine and 66 grams of potassium hydroxide and the mixture was heated and stirred, and 110 grams of methyl cyanoacetate was added dropwise over a period of about 1 hour. The mixture was then heated under reflux for 5 hours, after which it was left to stand overnight and the crystals which precipitated out were recovered by filtration, washed with ethanol and dried, whereupon 202.6 grams of crystals of compound a were obtained.

Preparation of Compound b

Water (11.5 ml) was added to 11.5 grams of compound a and 3.5 grams of potassium carbonate and 7.8 grams of ethyl acetoacetate was added dropwise while stirring the mixture which was being heated on a steam bath, and then the mixture was stirred for a period of 7 hours. After cooling, 9.2 ml of concentrated hydrochloric acid was added and crystals precipitated out on stirring. The crystals were recovered by filtration and washed with methanol and dried, whereupon 10.4 grams of crystals of compound b were obtained.

Preparation of Illustrative Coupler (YC-1)

Compound c (10.1 grams) which had been prepared using the method disclosed in U.S. Pat. No. 4,138,258 was dissolved in 60 ml of N,N-dimethylformamide and 60 ml of methylcellosolve, after which, with ice cooling, 4.3 ml of concentrated hydrochloric acid was added and then a solution comprised of 5 ml of water and 1.84 grams of sodium nitrite was added dropwise to obtain a diazonium solution. Next, 60 ml of methylcellosolve and 20 ml of water were added to 7.8 grams of compound b and 8.2 grams of sodium acetate and the above mentioned diazonium solution was added dropwise while stirring and cooling the mixture in ice. After completing the drip feed, the mixture was stirred for 1 hour and then for two hours at room temperature, and the crystals which precipitated out were recovered by filtration. After washing with water and drying, the crystals were dispersed in 500 ml of methanol, heated under reflux for 1 hour and then cooled. The crystals were recovered by filtration, washed with methanol and dried, whereupon 13.6 grams of red colored crystals of the expected illustrative coupler (YC-1) were obtained. The melting point of this compound was 269°-272° C. (with decomposition) and its structure was confirmed using $^1$HNMR spectroscopy, mass spectroscopy and elemental analysis. Moreover, the maximum absorption wavelength of this compound in methanol was 457.7 nm and the molecular extinction coefficient was 41300, and it exhibited good spectral absorbance characteristics as a yellow colored coupler.

SYNTHESIS EXAMPLE 2—PREPARATION OF ILLUSTRATIVE COUPLER (YC-3)

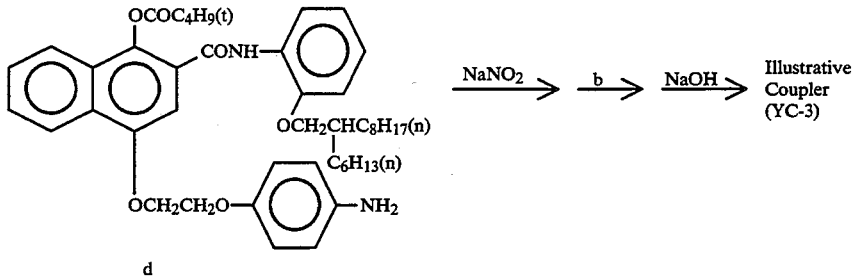

N,N-Dimethylformamide (75 ml) and 75 ml of methylcellosolve were added to 19.2 grams of compound d which had been prepared using the method disclosed in JP-A-62-85242 and then, while cooling in ice and stirring, 5.6 ml of concentrated hydrochloric acid was added, followed by the dropwise addition of a solution comprised of 5 ml of water and 2.5 grams of sodium nitrite. After the dropwise addition, the mixture was stirred for 1 hour and then stirred for 1 hour at room temperature and a diazonium solution was obtained.

Methylcellosolve (75 ml) and 26 ml of water were added to 10.1 grams of compound b and 10.7 grams of sodium acetate and the above mentioned diazonium solution was added dropwise while stirring and ice cooling the mixture. After the drip feed, the mixture was stirred for 1 hour and then for 2 hours at room temperature and the crystals which precipitated out were recovered by filtration. Next, the crystals were dispersed in 200 ml of methanol, a solution comprised of 10 ml of water and 2.2 grams of sodium hydroxide was added dropwise and the mixture was stirred for 3 hours. The mixture was then neutralized with concentrated hydrochloric acid and the crystals which precipitated out were washed with water and methanol and then dried. The crude crystals obtained were refined with hot methanol in the same way as in Synthesis Example 1 and 14.8 grams of the expected illustrative coupler (YC-3) were obtained. The melting point of this compound was 246°–251° C. (with decomposition), and its structure was confirmed using $^1$HNMR spectroscopy, mass spectroscopy and elemental analysis. Moreover, the maximum absorption wavelength of this compound in methanol was 457.6 nm, the molecular absorption coefficient was 42700, and it exhibited good spectral absorption characteristics as a yellow colored coupler.

SYNTHESIS EXAMPLE 3—THE PREPARATION OF ILLUSTRATIVE COUPLER (YC-28)

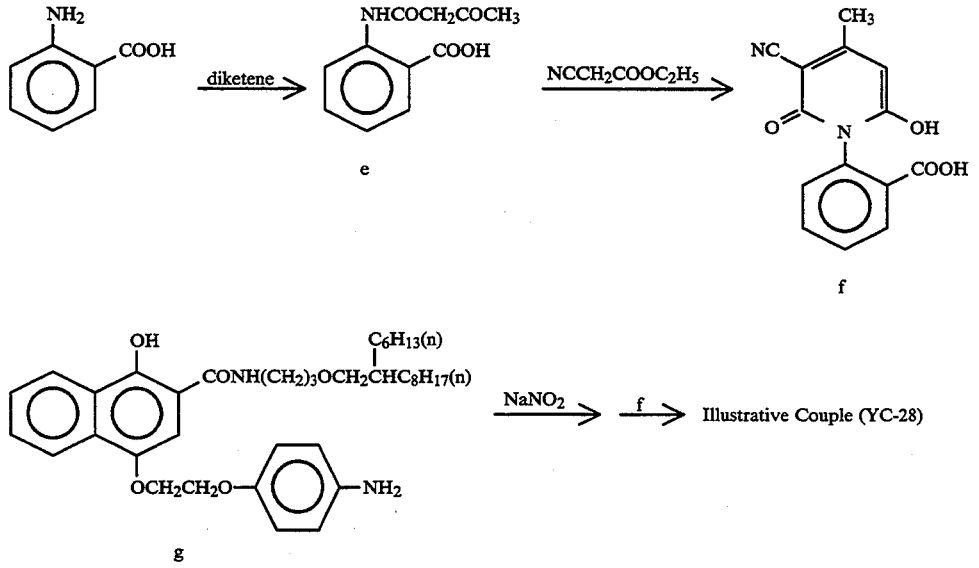

Preparation of Compound e

Anthranilic acid (137.1 grams) was added to 600 ml of acetonitrile and 92.5 grams of diketene was added dropwise over a period of about 1 hour while heating and stirring the mixture. After heating under reflux for 1 hour the mixture was cooled to room temperature, the crystals which precipitated out were recovered by filtration, washed with acetonitrile and dried, and 200.5 grams of crystals of compound e were obtained.

Preparation of Compound f

Compound e (199.1 grams), 89.2 grams of ethyl cyanoacetate and 344 grams of 28% methanol solution of sodium methoxide were added to 0.9 liter of methanol and reacted for 8 hours at 120° C. in an autoclave. After standing overnight, the reaction mixture was concentrated under reduced pressure, 700 ml of water was added and the mixture was rendered acidic with 230 ml of concentrated hydrochloric acid. The crystals which precipitated out were recovered by filtration and the crude crystals obtained were heated and washed in a mixture of ethyl acetate and acetonitrile and 152 grams of compound f was obtained.

Preparation of Illustrative Compound (YC-30)

Compound g (13.0 grams) prepared in accordance with the method disclosed in U.S. Pat. No. 4,138,258 was dissolved in 40 ml of N,N-dimethylformamide, 4.5 ml of concentrated hydrochloric acid was added with ice cooling and then a solution comprised of 5 ml of water and 1.48 grams of sodium nitrite was added dropwise and a diazonium solution was obtained. Next, 20 ml of N,N-dimethylformamide and 15 ml of water were added to 6.0 grams of compound f and 8 grams of sodium acetate, and the above mentioned diazonium solution was added dropwise while stirring and ice cooling the mixture. After completion of the drip feed the mixture was stirred for 30 minutes at room temperature. The mixture was acidified with hydrochloric acid, extracted with ethyl acetate and washed with water, after which the mixture was concentrated under reduced pressure and the concentrate was recrystallized from a mixed ethyl acetate/methanol solvent and 13 grams of yellow crystals of illustrative coupler (YC-30) were obtained. The melting point of this coupler (YC-30) was 154°–6° C. and the structure was confirmed using $^1$HNMR spectroscopy, mass spectroscopy and elemental analysis. Moreover, the maximum absorption wavelength of this compound in methanol was 458.2 nm and the molecular extinction coefficient was 42800, and it exhibited good spectral absorption characteristics as a yellow colored coupler.

SYNTHESIS EXAMPLE 4—THE PREPARATION OF ILLUSTRATIVE COUPLER 42
(1) Preparation of Compound 3
The phenyl ester 1 (445.5 grams) and 290.1 grams of isopropanolamine 2 were heated under reflux for 2 hours in 600 ml of acetonitrile. After cooling in water,
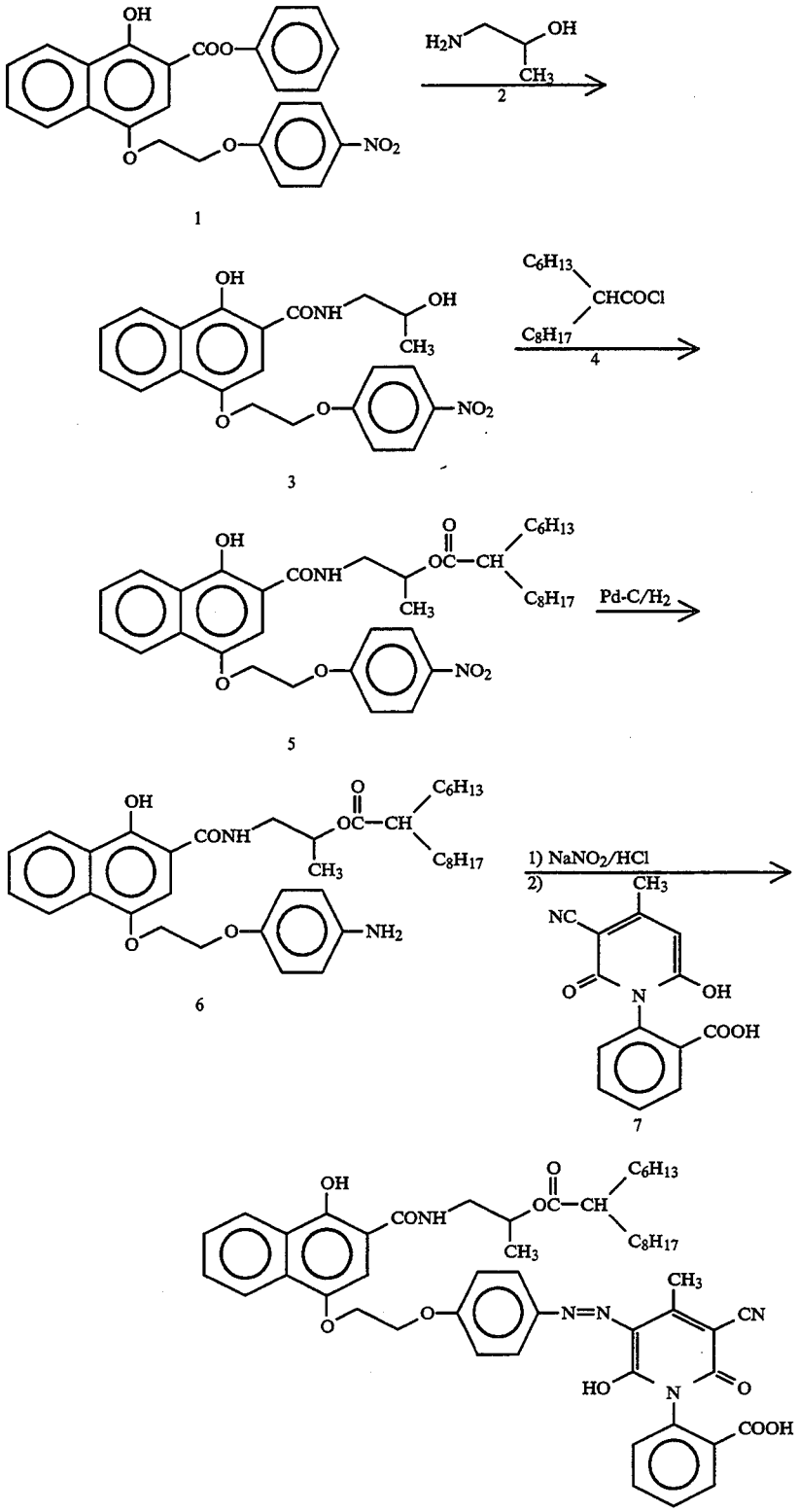
Illustrative Coupler YC-42 the crystals which precipitated out were recovered by filtration and 342 grams of compound 3 were obtained. m.p. 162°-5° C.

(2) Preparation of Compound 5

The hydroxyl compound 3 (341 grams) and 231 grams of 2-hexyldecanoyl chloride were heated under reflux for 2 hours in 880 ml of acetonitrile and, after cooling with water, the crystals which precipitated out were recovered by filtration and dried whereupon 437 grams of compound 5 were obtained. m.p. 97°-100° C.

(3) Preparation of Compound 6

The nitro compound 5 (370 grams), 6 grams of 10% Pd-C catalyst and 1 liter of ethyl acetate were introduced into an autoclave and hydrogenated at 50° C. for 3 hours. After completing the reduction, the catalyst was removed by filtration and the filtrate was concentrated under reduced pressure, the residue so obtained was crystallized from n-hexane and the crystals which precipitated out were recovered by filtration and dried, whereupon 327 grams of the amine 6 were obtained. m.p. 95°-7° C.

(4) Preparation of Illustrative Coupler YC-42

The amine compound 6 (20.8 grams) was dissolved in 60 ml of dimethylformamide and 7.6 nl of concentrated hydrochloric acid was added with water cooling. Moreover, an aqueous solution of 2.7 grams of sodium nitrite in 10 ml of water was added dropwise over a period of 20 minutes and then the mixture was stirred for a further 30 minutes and a diazo solution was obtained.

On the other hand, 9.7 grams of the pyridone 7 and 13 grams of sodium acetate were added to a mixture of 30 ml of water and 30 ml of dimethylformamide and the mixture was heated to form a solution, after which the mixture was water cooled and the above mentioned diazo solution was added slowly with stirring at a temperature not exceeding 10° C. Moreover, after stirring for a further 15 minutes the mixture was extracted with ethyl acetate and washed three times with water. The organic layer was then concentrated under reduced pressure and the residue was crystallized from methanol/ethyl acetate. The crystals which precipitated out were recovered by filtration and dried, whereupon 21.1 grams of illustrative coupler YC-42 was obtained. m.p. 117°-9° C.

Yellow colored cyan couplers represented by general formula (CII)-(CIV) can be prepared using the methods disclosed in JP-B-58-6939 and JP-A-1-197563, and using the methods disclosed in the aforementioned patents as methods for the preparation of couplers represented by general formula (CI).

In the present invention, the use of yellow colored cyan couplers represented by general formulae (CI) and (CII) is preferred, and the use of those represented by general formula (CI) is especially desirable.

The yellow colored cyan couplers used in the present invention are preferably added to a light-sensitive silver halide emulsion layer and/or a layer adjacent thereto in the light-sensitive material, and they are most desirably added to a red sensitive emulsion layer. The total amount added to a light-sensitive material is from 0.005 to 0.30 g/m$^2$, preferably from 0.02 to 0.20 g/m$^2$, and most desirably from 0.03 to 0.15 g/m$^2$.

The yellow colored cyan couplers described above can be added to the sensitive material in the same way as the usual couplers as described hereinafter.

Since the yellow colored cyan couplers described above have high molecular extinction coefficients, the coating amount can be reduced as compared with the other yellow colored cyan coupler. The couplers are stable on aging, have characteristics that fastness of the color image obtained is excellent, and have improved color reproduction.

The yellow colored cyan couplers used in the present invention are preferably used cojointly with uncolored cyan couplers. Phenol couplers and naphthol couplers can be cited as uncolored cyan couplers, and those disclosed, for example in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent laid open 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-24658 are preferred.

When the yellow colored cyan coupler is used in combination with an uncolored cyan coupler, the amount of the yellow colored cyan coupler is generally 0.1 to 50 mol %, preferably 1 to 30 mol % and more preferably 2 to 20 mol % based on the amount of the uncolored coupler.

The yellow colored cyan couplers used in the present invention are preferably used conjointly with the naphthol cyan couplers from among the aforementioned cyan couplers, and most desirably they are used cojointly with naphthol cyan couplers represented by the general formula (C) indicated below.

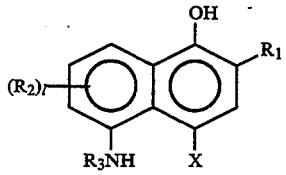

(C)

In formula (C), $R_1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$, $R_2$ represents a group which can be substituted on a naphthalene ring, l represents an integer of from 0 to 3, $R_3$ represents a substituent, and X represents a hydrogen atom or a group which can be eliminated by a coupling reaction with the oxidized product of a primary aromatic amine developing agent. Furthermore, $R_4$ and $R_5$ may be the same or different, each represents a hydrogen atom, an alkyl group, an aryl group or a heterocyclic group, and $R_6$ represents an alkyl group, an aryl group or a heterocyclic group. When l represents 2 or more, the $R_2$ groups may be the same or different, or they may be joined together to form rings. $R_2$ and $R_3$, or $R_3$ and X, may be joined together to form a ring. Furthermore, biscompounds, dimers or polymers (including oligomers) which are formed by joining via a single bond or a divalent or higher valent group at $R_1$, $R_2$, $R_3$ or X may also be formed.

Each of the substituents in formula (C) is described in detail below.

$R_1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$, and $R_4$, $R_5$ and $R_6$ each represents an alkyl group of which the total number of carbon atoms (referred to hereinafter as the C-number) is from 1 to 30, an aryl group of which C-number is from 6 to 30, or a heterocyclic group of which the C-number is from 2 to 30. $R_4$ and $R_5$ may also be hydrogen atoms.

$R_2$ represents a group (including atoms, same hereinbelow) which can be substituted on a naphthalene ring, and typical examples include halogen atoms (F, Cl, Br, I), a hydroxyl group, a carboxyl group, an amino group, a sulfo group, a cyano group, alkyl groups, aryl groups, heterocyclic groups, carbonamido groups, sulfonamido groups, carbamoyl groups, sulfamoyl groups, ureido groups, acyl groups, acyloxy groups, alkoxy groups, aryloxy groups, alkylthio groups, arylthio groups, alkylsulfonyl groups, arylsulfonyl groups, sulfamoylamino groups, alkoxycarbonylamino groups, a nitro group and imido groups. The dioxymethylene group and the trimethylene group, for example, may be cited as examples where $l=2$. The C-number of $(R_2)_l$ is from 0 to 30.

$R_3$ represents a substituent group, and it is preferably represented by formula (C-1):

$$R_7(Y)_m- \qquad \text{(C-1)}$$

wherein Y represents >NH, >CO or $>SO_2$, m represents an integer value of 0 or 1, $R_7$ represents a hydrogen atom, an alkyl group of C-number from 1 to 30, an aryl group of C-number from 6 to 30, a heterocyclic group of C-number from 2 to 30,

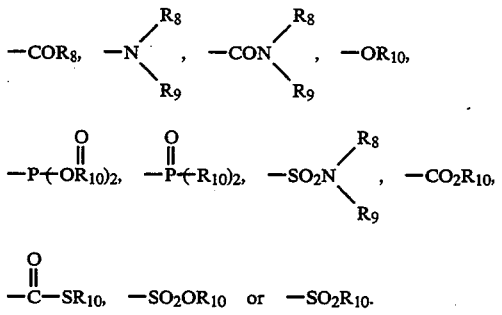

Here, $R_8$, $R_9$ and $R_{10}$ have the same meaning as $R_4$, $R_5$ and $R_6$ described earlier, respectively.

In $R_1$ or $R_7$, $R_4$ and $R_5$ in

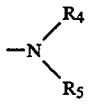

or $R_8$ and $R_9$ in

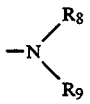

may be joined together to form a nitrogen-containing heterocyclic ring (for example, a pyrrolidine ring, a piperidine ring or a morpholine ring).

X represents a hydrogen atom or a group which can be eliminated by a coupling reaction with the oxidized product of a primary aromatic amine developing agent (known as a leaving group, and including a leaving atom, same hereinbelow), and typical leaving groups include halogen atoms,

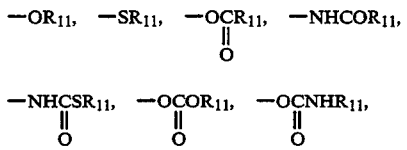

a thiocyanato group, heterocyclic groups of C-number from 1 to 30 which are bonded to the coupling active site with a nitrogen atom (for example, succinimido, phthalimido, pyrazolyl, hydantoinyl, 2-benzotriazolyl). Here, $R_{11}$ has the same meaning as the aforementioned $R_6$.

In the above, an alkyl group may be a linear chain, branched chain or cyclic group, and it may contain unsaturated bonds and it may have substituents (for example, halogen atoms, hydroxyl group, aryl groups, heterocyclic groups, alkoxy groups, aryloxy groups, alkylsulfonyl groups, arylsulfonyl groups, alkoxycarbonyl groups, acyloxy groups and acyl groups), and typical examples include methyl, iso-propyl, isobutyl, tert-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-tert-pentylphenoxy) propyl.

Furthermore, the aryl groups may have condensed rings (for example, naphthyl), and they may have substituents (for example, halogen atoms and alkyl, aryl, alkoxy, aryloxy, cyano, acyl, alkoxycarbonyl, carbonamido, sulfonamido, carbamoyl, sulfamoyl, alkylsulfonyl and arylsulfonyl groups), and typical examples include phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl and 4-tertbutylphenyl.

Furthermore, the heterocyclic groups are three to eight membered single ring or condensed ring heterocyclic groups which contain within the ring at least one O, N, S, P, Se or Te hetero atom, and they may have substituents (for example, halogen atoms, carboxyl groups, hydroxyl groups, a nitro group, alkyl groups, aryl groups, alkoxy groups, aryloxy groups, alkoxcarbonyl groups, aryloxycarbonyl groups, amino groups, carbamoyl groups, sulfamoyl groups, alkylsulfonyl groups and arylsulfonyl groups), and typical examples include 2-pyridyl, 4-pyridyl, 2-furyl, 4-thienyl, benzotriazol-1-yl, 5-phenyltetrazol-1-yl, 5-methylthio-1,3,4-thiadiazol-2-yl and 5-methyl-1,3,4-oxadiazol-2-yl.

Examples of the substituents preferred in the present invention are described below.

$R_1$ is preferably $-CONR_4R_5$ or $-SO_2NR_4R_5$, and actual examples include carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-tert-pentylphenoxy) propyl]carbamoyl, N-hexadecylcarbamoyl, N-[4-(2,4-di-tert-pentylphenoxy)-butyl]carbamoyl, N-(3-dodecyloxy-2-methylpropyl)-carbamoyl, N-[3-(4-tert-octylphenoxy) propyl]carbamoyl, N-hexadecyl-N-methylcarbamoyl, N-(3-dodecyloxypropyl)sulfamoyl and N-[4-(2,4-di-tertpentylphenoxy)butyl]sulfamoyl. $R_1$ is most desirably a $-CONR_4R_5$ group.

With $R_2$ and l, the case in which $l=0$, which is to say where there is no substituent, is most desirable, followed in preference by the case in which l=1. $R_2$ is preferably a halogen atom, an alkyl group (for example, methyl, iso-propyl, tert-butyl, cyclopentyl), a carbonamido group (for example, acetamido, pivalamido, trifluoroacetamido, benzamido), a sulfonamido group (for example, methanesulfonamido, toluenesulfonamido) or a cyano group.

$R_3$ is preferably a group in which m=0 in formula [C-1], and most desirably $R_7$ is a —$COR_8$ group [for example, formyl, acetyl, trifluoroacetyl, 2-ethylhexanoyl, pivaloyl, benzoyl, pentafluorobenzoyl, 4-(2,4-di-tert-pentylphenoxy)butanoyl], a —$COOR_{10}$ group [for example, methoxycarbonyl, ethoxycarbonyl, iso-butoxycarbonyl, 2-ethylhexyloxycarbonyl, n-dodecyloxycarbonyl, 2-methoxyethoxycarbonyl] or an —$SO_2R_{10}$ group [for example, methylsulfonyl, n-butylsulfonyl, n-hexadecylsulfonyl, phenylsulfonyl, p-tolylsulfonyl, p-chlorophenylsulfonyl, trifluoromethylsulfonyl], and most desirably $R_7$ is a —$COOR_{10}$ group.

X is preferably a hydrogen atom, a halogen atom, an —$OR_{11}$ group [for example, alkoxy groups such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-carboxytridecyloxy, 2-methanesulfonamidoethoxy, 2-carboxymethylthio)ethoxy and 2-(1-carboxytridecylthio)ethoxy and aryloxy groups such as 4-cyanophenoxy, 4-carboxyphenoxy, 4-methoxyphenoxy, 4 -tert-octylphenoxy, 4-nitrophenoxy, 4-(3-carboxypropanamido)-phenoxy and 4-acetamidophenoxy], or an —$SR_{11}$ group [for example, an alkylthio group such as carboxymethylthio, 2-carboxyethylthio, 2-methoxyethylthio, ethoxycarbonyl-methylthio, 2,3-dihydroxypropylthio and 2-(N,N-dimethylamino)ethylthio and arylthio groups such as 4-carboxyphenylthio, 4-methoxyphenylthio and 4-(3-carboxypropanamido)phenylthio], and it is most desirably a hydrogen atom, a chlorine atom, an alkoxy group or an alkylthio group.

The couplers represented by general formula (C) may take the form of dimers or polymers (including oligomers) which are bonded together via a single bond, or group of valency two or more in the substituent groups $R_1$, $R_2$, $R_3$ or X. In this case, the C-number may be outside the range shown for each of the aforementioned substituent groups.

In those cases where the couplers represented by general formula (C) form polymers they are typically homopolymers or copolymers of addition polymerizable ethylenic unsaturated compounds which have cyan dye forming coupler residual groups (cyan color forming monomers), and those represented by the formula (C-2) are preferred.

$$-(G_i)_{gi}-(H_j)_{hj}- \quad \text{(C-2)}$$

In formula (C-2), $G_i$ is a repeating unit derived from a coloring monomer, being a group represented by formula (C-3), and $H_j$ is a repeating unit derived from a non-color forming monomer, i represents a positive integer, j represents 0 or a positive integer, and gi and hi indicate the fractions by weight of $G_i$ and $H_i$ respectively. Here, when i or j is 2 or more then $G_i$ or $H_j$ include a plurality of types of repeating units.

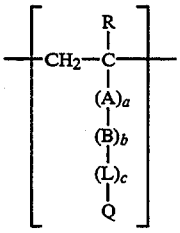

(C-3)

In formula [C-3], R represents a hydrogen atom, an alkyl group which has from 1 to 4 carbon atoms or a chlorine atom, A represents —CONH—, —COO— or a substituted or unsubstituted phenylene group, B represents a divalent group which has a carbon atom at both ends, such as a substituted or unsubstituted alkylene group, phenylene group or oxydialkylene group, and L represents —CONH—, —NHCONH—, —NHCOO—, —NHCO—, —OCONH—, —NH—, —COO—, —OCO—, —CO—, —O—, —$SO_2$—, —$NHSO_2$— or —$SO_2NH$—. Moreover, a, b and c each represents integer of 0 or 1. Q represents a cyan coupler residual group for which one hydrogen atom has been removed from $R_1$, $R_2$, $R_3$ or X in a compound represented by general formula [C].

Non-coloring ethylenic monomers which do not couple with the oxidation products of primary aromatic amine developing agents and which provide the repeating units $H_j$ include acrylic acid, α-chloroacrylic acid, α-alkylacrylic acids (for example methacrylic acid), amides and esters derived from these acrylic acids (for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (for example, vinyl acetate, vinyl propionate and vinyl laurate), acrylonitrile, methacrylonitrile, aromatic vinyl compounds (for example, styrene and derivatives thereof, such as vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid esters, N-vinyl-2-pyrrolidone, N-vinylpyridine and 2- and 4-vinylpyridine.

The acrylic acid esters, methacrylic acid esters and maleic acid esters are especially desirable. Two or more of the non-coloring ethylenic type monomers can be used conjointly. For example, use can be made of methyl acrylate and butyl acrylate, butyl acrylate and styrene, butyl methacrylate and methacrylic acid, and methyl acrylate and diacetoneacrylamide.

As is well known in the field of polymeric couplers, ethylenic unsaturated monomers for copolymerization with vinyl monomers corresponding to the aforementioned formula (C-3) can be selected in such a way as to provide the preferred effects with respect to the state of the copolymer which is obtained, e.g., a solid state, a liquid state or a micelle state, or its physical and/or chemical properties, such as its solubility (in water or in organic solvents), its compatibility with the binders of photographic colloid compositions, for example, gelatin, and flexibility, thermal stability, coupling reactivity with the oxidized product of a developing agent and non-diffusibility in photographic colloids. These polymers may be random copolymers or copolymers which have a specified sequence (for example, block copolymers or alternating copolymers).

The number average molecular weight of the cyan polymeric couplers which can be used in the present invention is generally of the order of from a several thousand to a several million, but oligomeric polymer couplers of number average molecular weight not more than 5000 can also be used.

The cyan polymeric couplers used in the present invention may be lipophilic polymers which are soluble in organic solvents (for example, ethyl acetate, butyl acetate, ethanol, methylene chloride, cyclohexanone, dibutyl phthalate, tricresyl phosphate), hydrophilic polymers which are miscible with hydrophilic colloids such as aqueous gelatin solutions for example, or they may have a structure and nature which can form micelles in a hydrophilic colloid.

The selection of lipophilic non-coloring ethylenic monomers (for example acrylic acid esters, methacrylic acid esters, maleic acid esters, vinylbenzenes) in the main for the copolymer component is desirable for obtaining lipophilic couplers which are soluble in organic solvents.

Lipophilic polymeric couplers obtained by the polymerization of vinyl monomers which provide coupler units represented by the aforementioned general formula (C-3) may be formed by dissolution in an organic solvent and emulsification and dispersion in the form of a latex in an aqueous gelatin solution, or using a direct emulsion polymerization method.

The method for the emulsification and dispersion of lipophilic polymeric couplers in the form of a latex in an aqueous gelatin solution disclosed in U.S. Pat. No. 3,451,820, and the methods of emulsion polymerization disclosed in U.S. Pat. Nos. 4,080,211 and 3,370,952 can be used.

The use of a hydrophilic non-coloring monomer, such as N-(1,1-dimethyl-2-sulfonatoethyl)acrylamide, 3-sulfonatopropyl acrylate, sodium styrenesulfonate, potassium styrenesulfinate, acrylamide, methacrylamide, acrylic acid, methacrylic acid, N-vinylpyrrolidone and N-vinylpyridine for example, as a copolymer component is desirable for obtaining hydrophilic polymeric couplers which are soluble in neutral or alkaline water.

Hydrophilic polymeric couplers can be added to a coating liquid as an aqueous solution, and they can also be added after dissolution in a mixture of water and an organic solvent which is miscible with water, such as a lower alcohol, tetrahydrofuran, acetone, ethyl acetate, cyclohexanone, ethyl lactate, dimethylformamide or dimethylacetamide. Moreover, they may be added after dissolution in an aqueous alkaline solution or an organic solvent which contains an aqueous alkali. Furthermore, a small quantity of surfactant can also be added.

The various substituents in formula (C) and actual examples of cyan couplers represented by formula (C) are indicated below.

Examples of $R_1$ $-CONH(CH_2)_3O-A$ $-CONH(CH_2)_4O-A$ $-CONH(CH_2)_3OC_{12}H_{25}\text{-n}$ $-CONH(CH_2)_3OC_{10}H_{21}\text{-n}$ $-CONH(CH_2)_3OCH_2\overset{C_2H_5}{\overset{|}{C}}HC_4H_9\text{-n}$ $-CONHC_{16}H_{33}\text{-n}$ -continued $-CONHCH_2\overset{CH_3}{\overset{|}{C}}HCH_2C_{12}H_{25}\text{-n}$ $-CONH(CH_2CH_2O)_2C_{12}H_{25}\text{-n}$ $-CONHCH_2CH_2OC_{12}H_{25}\text{-n}$

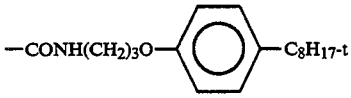

$-CONH(CH_2)_3O-$ $-C_8H_{17}\text{-t}$ $-CONHCH_2\overset{C_6H_{13}}{\overset{|}{C}}HC_8H_{17}\text{-n}$

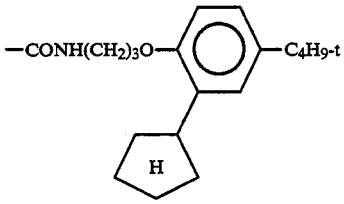

$-CONH(CH_2)_3O-$ $-C_4H_9\text{-t}$

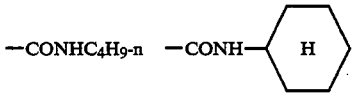

$-CONHC_4H_9\text{-n}$ $-CONH-$

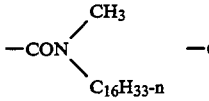

$-CON(CH_3)(C_{16}H_{33}\text{-n})$ $-CONH(CH_2)_3OC_{14}H_{29}\text{-n}$ $-CONH(CH_2)_3OC_{11}H_{23}\text{-n}$ $-SO_2NH(CH_2)_3OC_{12}H_{25}\text{-n}$

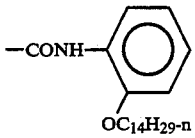

$-CONH-$ $OC_{14}H_{29}\text{-n}$

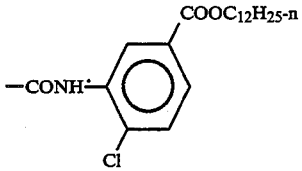

$-CONH-$ $COOC_{12}H_{25}\text{-n}$ Cl

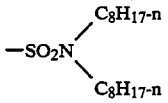

$-SO_2N(C_8H_{17}\text{-n})(C_8H_{17}\text{-n})$ $-NHCO(CH_2)_3O-A$

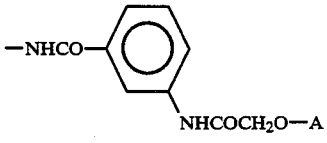

$-NHCO-$ $NHCOCH_2O-A$ $-NHSO_2C_{16}H_{33}\text{-n}$

-continued
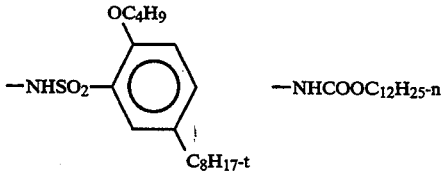
Examples of $R_2$
$-F$ $-Cl$ $-CN$ $-CH_3$ $-CF_3$ $-C_4H_{9}$-t
$-C_8H_{17}$-t $-NHCOCH_3$ $-NHSO_2CH_3$
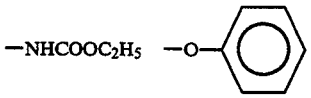
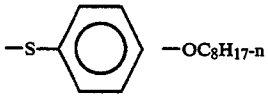
Examples of $R_3NH$—
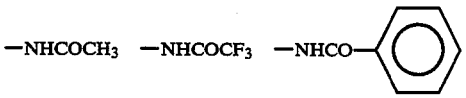
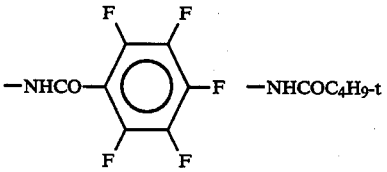
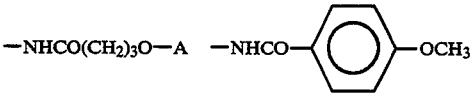
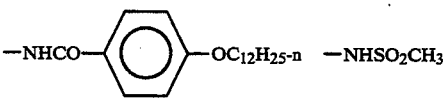
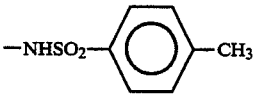
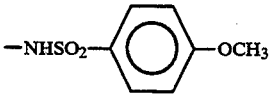
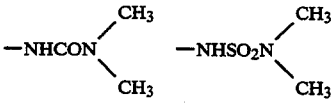
-continued
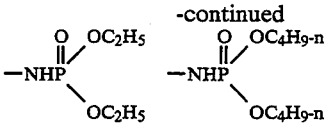
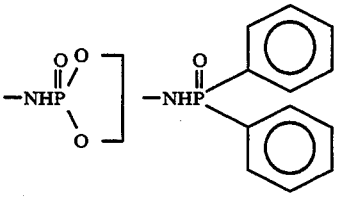
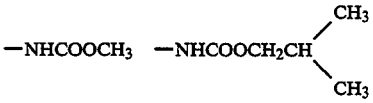
$-NHCOOC_4H_{9}$-n $-NHCOOCH_2CH_2OCH_3$
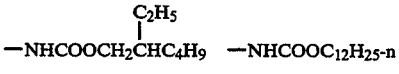
$-NHCOOCH_2CH_2O-A$ $-NHCOCOCH_3$
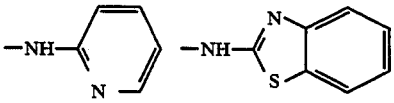
Examples of X
$-OC_2H_5$ $-OCH_2CH_2OH$ $-OCH_2CH_2SO_2CH_3$
$-O(CH_2CH_2O)_2H$ $-OCH_2COOH$
$-O(CH_2)_3COOH$ $-OCH_2COOC_2H_5$
$-OCH_2CONHCH_2CH_2OCH_3$
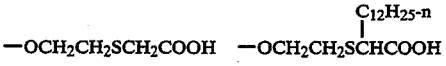
$-OCH_2CH_2OCH_3$ $-OCH_2CH_2NHSO_2CH_3$
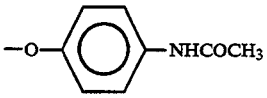
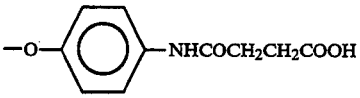
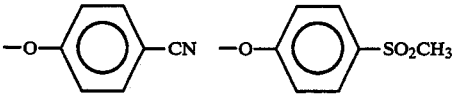
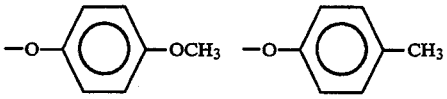
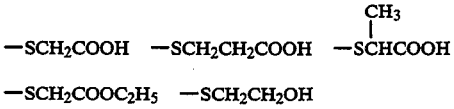
$-SCH_2COOC_2H_5$ $-SCH_2CH_2OH$ -continued

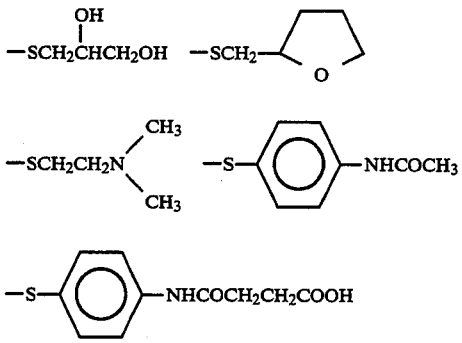

-continued

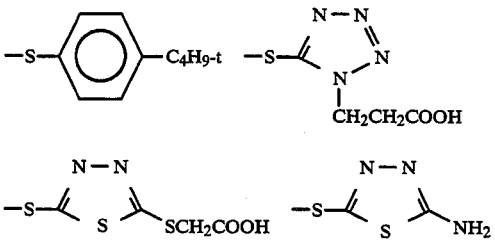

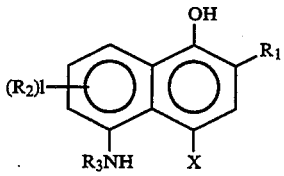

Couplers in which l = 0

| 番号 | $R_1$ | $R_3$ | X |
|---|---|---|---|
| C-1 | $-CONH(CH_2)_3O-A$ | $CH_2CO-$ | H |
| C-2 | $-CONH(CH_2)_3O-A$ | $CF_3CO-$ | H |
| C-3 | $-CONH(CH_2)_3O-A$ | $CH_3SO_2-$ | H |
| C-4 | $-CONH(CH_2)_3O-A$ | $C_2H_5OCO-$ | H |
| C-5 | $-CONH(CH_2)_4O-A$ | $t\text{-}C_4H_9CO-$ | H |
| C-6 | $-CONH(CH_2)_3O-C_{12}H_{25}\text{-}n$ | $C_2H_5OCO-$ | H |
| C-7 | $-CONH(CH_2)_3O-C_{12}H_{25}\text{-}n$ | $i\text{-}C_4H_9OCO-$ | H |
| C-8 | $-CONH(CH_2)_3OC_{10}H_{21}\text{-}n$ | $i\text{-}C_4H_9OCO-$ | H |
| C-9 | $-CONH(CH_2)_3OC_{10}H_{21}\text{-}n$ | $n\text{-}C_4H_9CH(C_2H_5)CH_2OCO-$ | H |
| C-10 | $-CONH(CH_2)_3O-A$ | $i\text{-}C_4H_9OCO-$ | H |
| C-11 | $-CONH(CH_2)_3O-C_6H_4-C_8H_{17}\text{-}t$ | $i\text{-}C_4H_9OCO-$ | H |
| C-12 | $-CONHCH_2CH(CH_3)CH_2OC_{12}H_{25}\text{-}n$ | $i\text{-}C_4H_9OCO-$ | H |
| C-13 | $-CONH(CH_2)_3OCH_2CH(C_2H_5)C_4H_9$ | $n\text{-}C_8H_{17}OCO-$ | H |
| C-14 | $-CONH(CH_2)_3O-C_6H_4-C_8H_{17}\text{-}t$ | $n\text{-}C_4H_9SO_2-$ | H |
| C-15 | $-CONH(CH_2)_3OC_{12}H_{25}\text{-}n$ | $(C_2H_5O)_2P(=O)-$ | H |
| C-16 | $-CONH(CH_2)_3O-A$ | 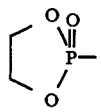 | H |
| C-17 | $-CONHCH_2CH_2OC_{12}H_{25}\text{-}n$ | $i\text{-}C_4H_9OCO-$ | H |

-continued

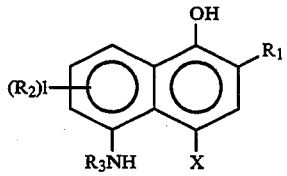

Couplers in which l = 0

| 番号 | $R_1$ | $R_3$ | X |
|---|---|---|---|
| C-18 | $-CON(CH_3)C_{16}H_{33}$-n | $C_2H_5OCO-$ | H |
| C-19 | $-CONHCH_2CH_2OCOC_{11}H_{23}$-n | i-$C_4H_9OCO-$ | H |
| C-20 | $-CONHC_{12}H_{25}$-n | n-$C_4H_9CH(CH_3)CH_2OCO-$ | H |
| C-21 | $-SO_2NH(CH_2)_3OC_{12}H_{25}$-n | i-$C_4H_9OCO-$ | H |
| C-22 | $-SO_2N(CH_3)C_{18}H_{37}$-n | $C_2H_5OCO-$ | H |
| C-23 | $-CONHCH_2CH(C_6H_{13}$-n$)C_8H_{17}$-n | i-$C_4H_9OCO-$ | H |
| C-24 | $-CONH(CH_3)_3OC_{12}H_{25}$-n | 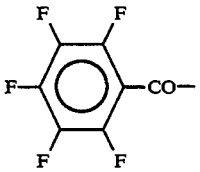 | H |
| C-25 | 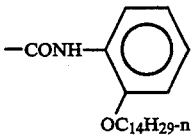 | $CH_3SO_2-$ | H |
| C-26 | 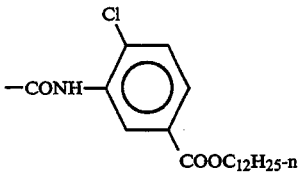 | 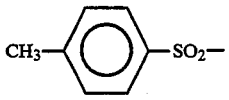 | H |
| C-27 | $-CONH(CH_2)_3OC_{12}H_{25}$-n | i-$C_4H_9OCO-$ | Cl |
| C-28 | $-CONH(CH_2)_3OC_{12}H_{25}$-n | n-$C_4H_9OCO-$ | Cl |
| C-29 | $-CONH(CH_2)_3OC_{12}H_{25}$-n | t-$C_4H_9CO-$ | Cl |
| C-30 | $-CONH(CH_2)_3OC_{12}H_{25}$-n | i-$C_4H_9OCO-$ | $-OCH_2CH_2OH$ |
| C-31 | $-CONH(CH_2)_3OC_{12}H_{25}$-n | i-$C_4H_9OCO-$ | $-O(CH_2CH_2O)_2H$ |
| C-32 | $-CONH(CH_2)_3OC_{12}H_{25}$-n | i-$C_4H_9OCO-$ | $-OCH_2CH_2OCH_3$ |
| C-34 | $-CONH(CH_2)_3OC_{12}H_{25}$-n | i-$C_4H_9OCO-$ | $-OCH_2CH_2SCH_2COOH$ |
| C-35 | $-CONHC_4H_9$-n | i-$C_4H_9OCO-$ | $-OCH_2CH_2SCH(COOH)C_{12}H_{25}$-n |
| C-36 | $-CONHCH_2CH(CH_3)CH_2OC_{12}H_{25}$-n | i-$C_4H_9OCO-$ | $-O(CH_2)_3COOH$ |
| C-37 | $-CONH(CH_2)_4O-A$ | i-$C_4H_9OCO-$ | 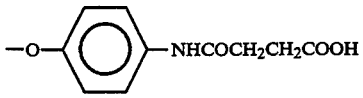 |

-continued

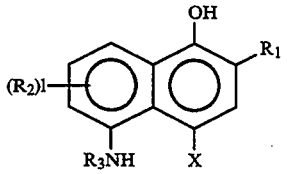

Couplers in which l = 0

| 號号 | $R_1$ | $R_3$ | X |
|---|---|---|---|
| C-38 | $-CONH(CH_2)_3O-A$ | $i\text{-}C_4H_9OCO-$ | 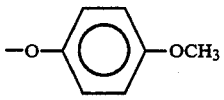 |
| C-39 | 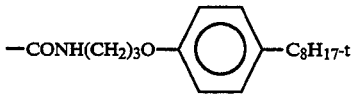 | $i\text{-}C_4H_9OCO-$ | $-SCH_2COOH$ |
| C-40 | $-CONH(CH_2)_3OC_{12}H_{25}\text{-}n$ | $i\text{-}C_4H_9OCO-$ | $-SCH_2CH_2COOH$ |
| C-41 | $-CONH(CH_2)_3OC_{12}H_{25}\text{-}n$ | $i\text{-}C_4H_9OCO-$ | $-SCH_2CH_2OH$ |
| C-42 | $-CONH(CH_2)_4O-A$ | $CH_3SO_2-$ | 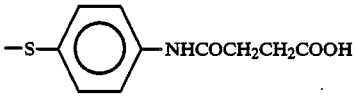 |
| C-43 | $-SO_2NH(CH_2)_3O-A$ | $n\text{-}C_4H_9SO_2-$ | $-OCH_2CH_2OH$ |
| C-44 | $-CONHCH_2\overset{CH_3}{\overset{\vert}{C}}HCH_2OC_{12}H_{25}\text{-}n$ | $i\text{-}C_4H_9OCO-$ | $-OCH_2CH_2OH$ |
| C-45 | $-CONH(CH_2CH_2O)C_{12}H_{25}\text{-}n$ | $(C_2H_5O)_2\overset{O}{\overset{\Vert}{P}}-$ | $-OCH_2CH_2OCH_3$ |
| C-46 | $-CONH(CH_2)_4O-A$ | $t\text{-}C_4H_9CO-$ | $-OCH_2COOC_2H_5$ |

Other Couplers

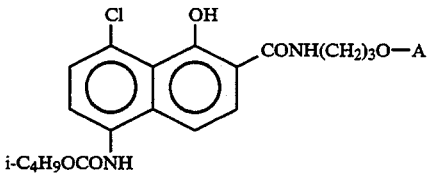

C-47

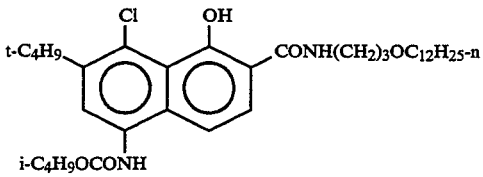

C-48

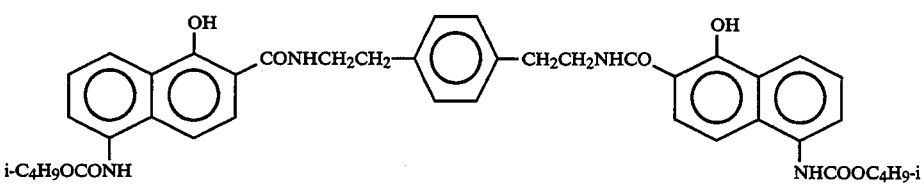

C-49

-continued

C-50

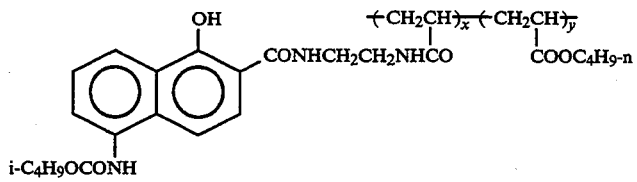

x:y = 60:40 (by weight)
Number Average Molecular Weight about 60,000

C-51

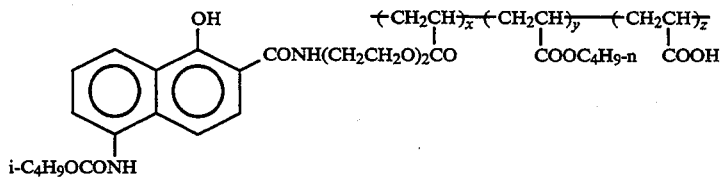

x:y:z = 50:40:10 (by weight)
Number Average Molecular Weight about 50,000

C-52

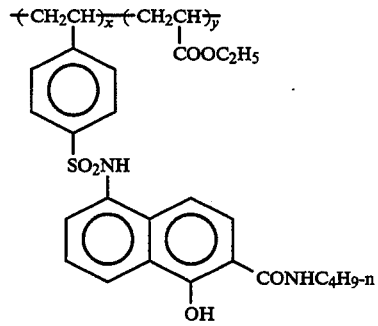

x:y = 70:30 (by weight)
Number Average Molecular Weight about 55,000

Here, A represents

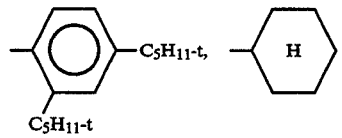

represents a cyclohexyl group,

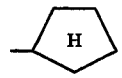

represents a cyclopentyl group, and $C_8H_{17}$-t represents

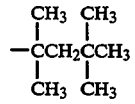

Actual examples of cyan couplers which can be represented by formula (C) other than those aforementioned and/or methods for the preparation of these compounds are disclosed, for example, in U.S. Pat. No. 4,690,889, JP-A-60-237448, JP-A-61-153640, JP-A-61-145557, JP-A-63-208042, JP-A-64-31159 and West German Patent 3,823,049A.

It is possible to further improve the color reproduction properties, the processing fluctuations during continuous processing, the storage properties prior to color development processing of the sensitive material and the fastness of the colored image as mentioned earlier by using naphthol cyan couplers of formula (C) described above in combination with yellow colored cyan couplers of the present invention, and also using an acylacetamide yellow coupler having an acyl group represented by formula (A).

A light-sensitive material of the present invention should have provided, on a support, at least one blue sensitive silver halide emulsion layer, at least one green sensitive silver halide emulsion layer and at least one red sensitive silver halide emulsion layer, but no particular limitation is imposed upon the number or order of the silver halide emulsion layers and light-insensitive layers. Typically, a silver halide photographic light-sensitive material has, on a support, at least one light-sensitive layer comprised of a plurality of silver halide emulsion layers which have essentially the same color sensitivity but different photographic speeds. This light-sensitive layer is a unit light-sensitive layer which is color sensitive to blue light, green light or red light. In a multi-layer silver halide color photographic material the arrangement of the unit light-sensitive layers is in the order, from the support side, of red sensitive layer, green sensitive layer, blue sensitive layer. However, this order may be reversed, as required, and the layers may be arranged in such a way that a layer which has a different color sensitivity is sandwiched between layers which have the same color sensitivity.

Various light-insensitive layers, such as intermediate layers, may be established between the above mentioned silver halide light-sensitive layers, and as uppermost and lowermost layers.

The intermediate layers may contain couplers and DIR compounds such as those disclosed in the specifications of JP-A-61-43748, JP-A-59-113438, JP-A-59-113440, JP-A-61-20037 and JP-A-61-20038, and they may also contain the generally used anti-color mixing compounds.

The plurality of silver halide emulsion layers constituting each unit light-sensitive layer is preferably a double layer structure comprised of a high speed emulsion layer and a low speed emulsion layer as disclosed in West German Patent 1,121,470 or British Patent 923,045. Generally, arrangements in which the photographic speed is lower in the layer closer to the support are preferred, and light-insensitive layers may be provided between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and 62-206543.

In practical terms, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers can be arranged in order, from the side furthest from the support, of blue sensitive layer/GH/RH/GL/RL as disclosed in JP-B-55-34932. Furthermore, the layers can also be arranged in the order, from the side furthest away from the support, of blue sensitive layer/GL/RL/GH/RH, as disclosed in JP-A-56-25738 and JP-A-62-63936.

Furthermore, there are arrangements in which there are three layers which have different speeds with the photosensitivity falling towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495. In the case of structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order high speed emulsion layer/low speed emulsion layer/intermediate speed emulsion layer, or low speed emulsion layer/intermediate speed emulsion layer/high speed emulsion layer, for example.

Furthermore, the arrangement may be varied in the ways indicated above in cases where there are four or more layers.

As described above, various layer structures and arrangements can be selected respectively according to the purpose of use of the light-sensitive material.

The preferred silver halides for inclusion in the photographic emulsion layers of a photographic light-sensitive material of the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or tabular form, a form which has crystal defects such as twinned crystal planes, or a form which is a composite of these forms.

The grain size of the silver halide may be very fine of not more than about 0.2 microns, or large with a projected area diameter of up to about 10 microns, and the emulsions may be poly-disperse emulsions or mono-disperse emulsions.

Silver halide photographic emulsions which can be used in the present invention can be prepared, for example, using the methods disclosed in *Research Disclosure* (RD) No. 17643 (December, 1978), pages 22–23, "I. Emulsion Preparation and Types", *Research Disclosure* No. 18716 (November 1979), page 648, and *Research Disclosure,* No. 307105 (November 1989), pages 863–865, by P. Glafkides in *Chimie et Physique Photographique,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964.

The mono-disperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, by Gutoff in *Photographic Science and Engineering,* Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type with which the latent image is formed principally on the surface, the internal latent image type in which the latent image is formed within the grains, or of a type with which the latent image is formed both at the surface and within the grains, but a negative type emulsion is essential. From among the internal latent image types the emulsion may be a core/shell internal latent image type emulsion as disclosed in JP-A-63-264740. A method for the preparation of such a core/shell internal latent image type emulsion has been disclosed in JP-A-59-133542. The thickness of the shell of this emulsion differs according to the development processing, for example, but is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution or halogen composition of the light-sensitive silver halide emulsion, the grain form or photographic speed can be used in the form of a mixture in the same layer in a light-sensitive material of the present invention.

The use of essentially light-insensitive hydrophilic colloid layers and/or light-sensitive silver halide emulsion layers containing silver halide grains in which the grain surface has been fogged as disclosed in U.S. Pat. No. 4,082,553, silver halide grains of which the grain interior has been fogged as disclosed in U.S. Pat. No. 4,626,498 and JP-A-59-214852 or colloidal silver is desirable. Silver halide grains in which the grain interior or surface has been fogged are silver halide grains which can be developed uniformly (not in the form of the image) irrespective of whether they are in an unexposed part or an exposed part of the light-sensitive material. Methods for the preparation of silver halide grains in which the interior or surface of the grains has been fogged have been disclosed in U.S. Pat. No. 4,626,498 and JP-A-59-214852.

The silver halide which forms the internal nuclei of core/shell type silver halide grains of which the grain interior has been fogged may have the same halogen composition or a different halogen composition. The silver halide in which the grain interior or surface has been fogged may be silver chloride, a silver chlorobromide, a silver iodobromide or a silver chloroiodobromide. No particular limitation is imposed upon the grain size of these fogged silver halide grains, but an average grain size from 0.01 to 0.75 μm, and especially from 0.05 to 0.6 μm, is preferred. Furthermore, no particular limitation is imposed upon the form of the grains and they may be regular grains, and they may be poly-disperse emulsions, but mono-disperse emulsions (in which at least 95% in terms of the weight or number of silver halide grains have a grain size within ±40% of the average grain size) are preferred.

The use of light-insensitive fine grain silver halides is desirable in the present invention. Light-insensitive fine grain silver halides are not light-sensitive at the time of the imagewise exposure for obtaining the dye image and which undergo essentially no development during development processing, and those which have not been pre-fogged are preferred.

The fine grain silver halide has a silver bromide content from 0 to 100 mol %, containing silver chloride and/or silver iodide as required. Those which have a silver iodide content of from 0.5 to 10 mol % are preferred.

The fine grain silver halide has an average grain size (the average value of the diameters of the circles corresponding to the projected areas) preferably from 0.01 to 0.5 μm, and most desirably from 0.02 to 0.2 μm.

The fine grain silver halide can be prepared using the same methods as used in general for the preparation of light-sensitive silver halides. In this case, the surface of the silver halide grains does not need to be optically sensitized and neither is there any need for spectral sensitization. However, the pre-addition of known stabilizers such as triazole, azaindene, benzothiazolium or mercapto compounds or zinc compounds before addition to the coating liquid is desirable. Colloidal silver can also be included desirably in the layer which contains these fine grain silver halide grains.

The coated weight of silver in a light-sensitive material of the present invention is preferably not more than 6.0 g/m$^2$, and most desirably not more than 4.5 g/m$^2$. It is preferred that the coated weight is not less than about 1.0 g/m$^2$.

Known photographically useful additives which can be used in the present invention have also been disclosed in the three *Research Disclosures* referred to above, and the locations of these disclosures are also indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column - page 649 right hand column | Pages 866–868 |
| 4. Bleaching Agents | Page 24 | Page 647, right hand column | Page 868 |
| 5. Anti-foggants, stabilizers | Pages 24–25 | Page 649, right hand column | Pages 868–870 |
| 6. Light Absorbers, filter Dyes and ultraviolet absorbers | Pages 25–26 | Page 649, right hand column - page 650, left hand column | Page 873 |
| 7. Anti-staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating promotors | Pages 26–27 | Page 650, right hand column | Pages 875–876 |

-continued

| Type of Additive | RD17643 (December 1978) | RD18716 (November 1979) | RD307105 (November 1989) |
|---|---|---|---|
| Surfactants | | | |
| 13. Anti-static agents | Page 27 | Page 650, right hand column | Pages 876–877 |
| 14. Matting Agents | | | Pages 878–879 |

Furthermore, addition of the compounds which can react with and fix formaldehyde disclosed in U.S. Pat. Nos. 4,411,987 and 4,435,503 to the light-sensitive material is desirable for preventing deterioration of photographic performance due to formaldehyde gas.

The inclusion of the mercapto compounds disclosed in U.S. Pat. Nos. 4,740,454 and 4,788,132, JP-A-62-18539 and JP-A-1-283551 in a light-sensitive material of the present invention is desirable.

The inclusion of compounds which release fogging agents, development accelerators, silver halide solvents or precursors of these materials irrespective of the amount of developed silver produced by development processing disclosed in JP-A-1-106052 in a light-sensitive material of the present invention is desirable.

The inclusion of the dyes dispersed using the methods disclosed in International Patent laid open WO88/04794 and JP-A-1-502912, or the dyes disclosed in EP 317,308A, U.S. Pat. No. 4,420,555 and JP-A-1-259358 in a light-sensitive material of the present invention is desirable.

Various color couplers can be used in the present invention, and actual examples have been disclosed in the patents cited in the aforementioned *Research Disclosure* No. 17643, sections VII-C–G, and No. 307105, sections VII-C–G.

Those disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred as yellow couplers.

5-Pyrazolone compounds and pyrazoloazole compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially desirable.

The phenol and naphthol couplers disclosed earlier can be cited as cyan couplers, and the pyrazoloazole couplers disclosed in JP-A-64-553, JP-A-64-554. JP-A-64-555 and JP-A-556, and the imidazole couplers disclosed in U.S. Pat. No. 4,818,672 can also be used.

Typical examples of polymerized dye forming couplers are disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers in which the colored dyes have a suitable degree of diffusibility.

The colored couplers for correcting the unwanted absorptions of colored dyes disclosed, for example, in section VII-G of *Research Disclosure* No. 17643, section VII-G of *Research Disclosure* No. 307105, U.S. Pat. No. 4,163,670, JP-B-57-39413, U.S. Pat. Nos. 4,004,929 and 4,138,258, and British Patent 1,146,368 are desirable in addition to the yellow colored cyan couplers described above. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent as disclosed in U.S. Pat. No. 4,777,120 is also desirable.

The use of couplers which release photographically useful residual groups on coupling is also desirable in the present invention. The DIR couplers which release development inhibitors disclosed in the patents cited in section VII-F of the aforementioned *Research Disclosure* 17643, section VII-F of *Research Disclosure* No. 307105, JP-A-57-151944, JP-A-57-154234, JP-A-60-184248, JP-A-63-37346, JP-A-63-37350 and U.S. Pat. Nos. 4,248,962 and 4,782,012 are desirable.

The couplers disclosed in British Patents 2,097,140 and 2,131,188, JP-A-59-157638 and JP-A-59-170840 are preferred as couplers which release nucleating agents or development accelerators in the form of the image during development. Furthermore, the compounds which release fogging agents, development accelerators, silver halide solvents etc. by means of a redox reaction with the oxidized product of a developing agent disclosed in JP-A-60-107029, JP-A-60-252340, JP-A-1-44940 and JP-A-1-45687 are also desirable.

Other compounds which can be used in light-sensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes in which the color is restored after elimination disclosed in European Patents 173,302A and 313,308A, the bleach accelerator releasing couplers disclosed, for example, in *Research Disclosure* No. 11449, ibid, No. 24241, and JP-A-61-201247, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the light-sensitive material using a variety of known methods.

Examples of high boiling point solvents which can be used in the oil in water dispersion method is disclosed, for example, in U.S. Pat. No. 2,322,027.

Actual examples of high boiling point organic solvents which have a boiling point of at least 175° C. at normal pressure which can be used in the oil in water dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl-)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, iso-stearyl alcohol and 2,4-di-tertamylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point above about 30° C., and preferably of at least 50° C., but below about 160° C. can be used as auxiliary solvents, and typical examples of these solvents include ethyl acetate, butyl acetate, ethyl propionate, methyl ethyl ketone, cyclohexanone, 2-ethoxyethyl acetate and dimethylformamide. The processes and effects of the latex dispersion method and actual examples of latexes for loading purposes have been disclosed, for example, in U.S. Pat. Nos. 4,199,363, and in West German Patent Applications (OLS) 2,541,274 and 2,541,230.

The addition to the color light-sensitive materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-272248 and JP-A-1-80941 is desirable.

The present invention can be applied to a variety of color light-sensitive materials. Typical examples include color negative films for general and cinematographic purposes, color reversal films for slides and television purposes, color papers, color positive films and color reversal papers. Preferred examples include color negative films for general and cinematographic purposes.

Suitable supports which can be used in the present invention have been disclosed, for example, on page 28 of the aforementioned *Research Disclosure* No. 17643, from the right hand column of page 647 to the left hand column of page 648 of *Research Disclosure* No. 18716, and on page 879 of *Research Disclosure* No. 307105.

The light-sensitive materials of the present invention are such that the total film thickness of all the hydrophilic colloid layers on the side where the emulsion layers are located is preferably not more than 28 μm, more desirably not more than 23 μm, even more desirably not more than 18 μm, most desirably not more than 16 μm and desirably not less than about 8 μm. Furthermore, the film swelling rate $T_{\frac{1}{2}}$ is preferably not more than 30 seconds and most desirably not more than 20 seconds. Here, the film thickness signifies the film thickness measured under conditions of 25° C., 55% relative humidity (2 days), and the film swelling rate $T_{\frac{1}{2}}$ is that measured using the methods well known to those in the industry. For example, measurements can be made using a swellometer of the type described by A. Green in *Photogr. Sci. Eng.*, Volume 19, Number 2, pages 124–129, and $T_{\frac{1}{2}}$ is defined as the time taken to reach half the saturated film thickness, taking 90% of the maximum swollen film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the aging conditions after coating. Furthermore, a swelling factor from 150% to 400% is preferred. The swelling factor can be calculated from the maximum swollen film thickness obtained under the conditions described above using the expression (maximum swollen film thickness minus film thickness)/film thickness.

The establishment of a hydrophilic colloid layer (known as a backing layer) of total dry film thickness from 2 μm to 20 μm on the opposite side from the emulsion layers is desirable in a light-sensitive material of the present invention. The inclusion of light absorbing agents, filter dyes, ultraviolet absorbers, anti-static agents, film hardening agents, binders, plasticizers, lubricants, coating promotors and surfactants, for example, as described before, in this backing layer is desirable. The swelling factor of the backing layer is preferably from 150% to 500%.

Color photographic light-sensitive materials which are in accordance with the present invention can be developed and processed using the general methods disclosed on pages 28–29 of the aforementioned *Research Disclosure* No. 17643, from the left hand column to the right hand column of page 615 of the aforementioned *Research Disclosure* No. 18716, and on pages 880 to 881 of *Research Disclosure* No. 307105.

The color developers used for the development processing of light-sensitive materials of the present invention are preferably aqueous alkaline solutions which contain a primary aromatic amine based color developing agent as the principal component. Aminophenol compounds are also useful as color developing agents, but the use of p-phenylenediamine compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. From among these compounds, 3-methyl-4-amino-N-ethyl-N-β-hydroxyethylaniline sulfate is especially desirable. Two or more of these compounds can be used conjointly, according to the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts of these acids.

Color development is carried out after a normal black and white development in the case of reversal processing. Known black and white developing agents including dihydroxybenzenes such as hydroquinone, 3 -pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. Furthermore, the replenishment rate for these developers depends on the color photographic light-sensitive material which is being processed but, in general, it is not more than 3 liters per square meter of light-sensitive material, and it can be set to not more than 500 ml by reducing the bromide ion concentration in the replenisher. In those cases where the replenishment rate is low it is desirable that evaporation and aerial oxidation of the liquid should be prevented by minimizing the area of contact with the air in the processing tank.

The contact area between the air and the photographic processing bath in a processing tank can be represented by the "open factor" which is defined below.

$$\text{Open Factor} = \frac{\text{Processing bath and Air Contact Area (cm}^2\text{)}}{\text{Processing Bath Volume (cm}^3\text{)}}$$

The above mentioned open factor is preferably not more than 0.1, and most desirably from 0.001 to 0.05. As well as the establishment of a shielding material such as a floating lid, for example, on the surface of the photographic processing bath in the processing tank, the method involving the use of a movable lid as disclosed in JP-A-1-82033 and the method involving slit development processing disclosed in JP-A-63-216050 can be used as means of reducing the open factor. Reduction of the open factor is preferably applied not only to the processes of color development and black and white development but also to all the subsequent processes, such as the bleaching, bleach-fixing, fixing, water washing and stabilizing processes. Furthermore, the replenishment rate can be reduced by using a means of suppressing the accumulation of bromide ion in the development bath.

The color development processing time is generally set between 2 and 5 minutes, but shorter processing times can be devised by increasing the pH or by increasing the concentration of the color developing agent.

The photographic emulsion layer is generally subjected to a bleaching process after color development. The bleaching process may be carried out at the same time as a fixing process (in a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as required. Compounds of multivalent metals, such as iron(III) for example, peracids, quinones and nitro compounds can be used as bleaching agents. Typical bleaching agents include organic complex salts of iron(III), for example complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid. From among these materials, the use of aminopolycarboxylic acid iron(III) complex salts, and principally of ethylenediamine tetra-acetic acid iron(III) complex salts and 1,3-diaminopropane tetra-acetic acid iron(III) salts, is preferred from the points of view of both rapid processing and the prevention of environmental pollution. Moreover, the aminopolycarboxylic acid iron(III) complex salts are especially useful in both bleach baths and bleach-fix baths. The pH value of the bleach baths and bleach-fix baths in which these aminopolycarboxylic acid iron(III) salts are used is generally from 4.0 to 8, but lower pH values can be used in order to speed up processing.

Bleaching accelerators can be used, as required, in the bleach baths, bleach-fix baths or bleach or bleach-fix pre-baths. Actual examples of useful bleach accelerators are disclosed in the following specifications and also, there are the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; other compounds disclosed in JP-A-49-40943, JP-A-49-59644, JP-A-53-94927, JP-A-54-35727, JP-A-55-26506 and JP-A-58-163940; and the bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the sensitive materials. These bleaching accelerators are especially effective when bleach-fixing color light-sensitive materials for photographing.

The inclusion of organic acids as well as the compounds indicated above in the bleach baths and bleach-fix baths is desirable for preventing the occurrence of bleach staining. Compounds which have an acid dissociation constant (pKa) of from 2 to 5 are especially desirable for the organic acids, and in practice acetic acid, propionic acid and hydroxyacetic acid, for example, are preferred.

Thiosulfate, thiocyanate, thioether compounds, thioureas and large amounts of iodide can be used, for example, as the fixing agent which is used in a fixing bath or bleach-fix bath, but thiosulfate is generally used, and ammonium thiosulfate in particular can be used in the widest range of applications. Furthermore, the conjoint use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable for stabilizing these baths.

The addition of compounds of pKa from 6.0 to 9.0, and preferably imidazoles such as imidazole, 1-methylimidazole, 1-ethylimidazole and 2-methylimidazole, in amounts from 0.1 to 10 mol/liter to the fixing bath or bleach-fixing baths is desirable in the present invention.

A short total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved and the occurrence of staining after processing is effectively prevented within the preferred temperature range.

Agitation as strongly as possible during the de-silvering process is desirable. Actual examples of methods of strong agitation include the methods in which a jet of processing liquid is made to impinge on the emulsion surface of the light-sensitive material as disclosed in JP-A-62-183460, the method in which the agitation effect is increased using a rotary device as disclosed in JP-A-62-183461, the method in which the light-sensitive material is moved with a wiper blade which is established in the bath in contact with the emulsion surface and the agitation effect is increased by the generation of turbulence at the emulsion surface, and the method in which the circulating flow rate of the processing bath as a whole is increased. These means of increasing agitation are effective in bleach baths, bleach-fix baths and fixing baths. It is thought that increased agitation increases the rate of supply of bleaching agent and fixing agent to the emulsion film and consequently increases the de-silvering rate. Furthermore, the aforementioned means of increasing agitation are more effective in cases where a bleaching accelerator is being used, and they sometimes provide a marked increase in the accelerating effect and eliminate the fixer inhibiting action of the bleaching accelerator.

The automatic processors which are used for the light-sensitive materials of the present invention preferably have light-sensitive material transporting devices as disclosed in JP-A-60-191257, JP-A-60-191258 or JP-A-60-191259. With such a transporting device, such as that disclosed in the aforementioned JP-A-60-191257, the carry-over of processing liquid from one bath to the next is greatly reduced and this is very effective for preventing deterioration in processing solution performance. These effects are especially useful for shortening the processing time in each process and for reducing the replenishment rate of each processing bath.

The silver halide color photographic light-sensitive materials of this invention are generally subjected to a water washing process and/or stabilizing process after the de-silvering process. The amount of wash water used in the washing process can be fixed within a wide range, depending on the application and the nature (depending on the materials such as couplers which have been used) of the light-sensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multi-stage counter-flow system can be obtained using the method outlined on pages 248–253 of the *Journal of the Society of Motion Picture and Television Engineers,* Volume 64 (May 1955).

The amount of wash water used can be greatly reduced by using the multi-stage counter-flow system noted in the aforementioned literature, but bacteria proliferate due to the increased residence time of the water in the tanks and problems arise with the suspended matter which is produced becoming attached to the light-sensitive material. The method in which the calcium ion and magnesium ion concentrations are reduced, disclosed in JP-A-62-288838, is very effective as a means of overcoming this problem when processing color light-sensitive materials of the present invention. Furthermore, the isothiazolone compounds and thiabendazoles disclosed in JP-A-57-8542, the chlorine containing disinfectants such as chlorinated sodium isocyanurate, and benzotriazole, for example, and the disinfectants disclosed in *The Chemistry of Biocides and Fungicides* by Horiguchi, (1986, Sankyo Shuppan), in *Killing Micro-organisms, Biocidal and Fungicidal Techniques* (1982) published by the Health and Hygiene Technology Society, and in *A Dictionary of Biocides and Fungicides* (1986) published by the Japanese Biocide and Fungicide Society, can also be used in this connection.

The pH value of the washing water when processing light-sensitive materials of the present invention is from 4 to 9, and preferably from 5 to 8. The washing water temperature and the washing time can be set variously in accordance with the nature and application of the light-sensitive material but, in general, washing conditions of from 20 seconds to 10 minutes at a temperature from 15° C. to 45° C., and preferably from 30 seconds to 5 minutes at a temperature from 25° C. to 40° C., are selected. Moreover, the light-sensitive materials of this invention can be processed directly in a stabilizing bath instead of being subjected to a water wash as described above. The known methods disclosed in JP-A-57-8543, JP-A-58-14834 and JP-A-60-220345 can be used for a stabilization process of this type.

Furthermore, there are also cases in which a stabilization process is carried out following the aforementioned water washing process, and the stabilizing baths which contain dye stabilizing agents and surfactants which are used as final baths with color light-sensitive materials for photographing are an example of such a process. Aldehydes such as formalin and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above mentioned water washing or stabilizing baths can be reused in other processes, such as the de-silvering process, for example.

Concentration correction with the addition of water is desirable in cases where the above-mentioned processing baths become concentrated due to evaporation when processing in an automatic processor, for example.

Color developing agents can be incorporated into a silver halide color light-sensitive material of the present invention with a view to simplifying and speeding up processing. The incorporation of various color developing agent precursors is preferred. For example, the indoaniline compounds disclosed in U.S. Pat. No. 3,342,597, the Shiff's base compounds disclosed in U.S. Pat. No. 3,342,599, *Research Disclosure* No. 14850 and *Research Disclosure* No. 15159, the aldol compounds disclosed in *Research Disclosure* No. 13924, the metal salt complexes disclosed in U.S. Pat. No. 3,719,492 and the urethane compounds disclosed in JP-A-53-135628 can be used for this purpose.

Various 1-phenyl-3-pyrazolidones may be incorporated, as required, into a silver halide color light-sensitive material of the present invention with a view for accelerating color development. Typical compounds are disclosed, for example, in JP-A-56-64339, JP-A-57-144547 and JP-A-58-115438.

The various processing baths in the present invention are used at a temperature from 10° C. to 50° C. The standard temperature is generally from 33° C. to 38° C., but accelerated processing and shorter processing times can be realized at higher temperatures while, on the other hand, increased picture quality and better processing bath stability can be achieved at lower temperatures.

Furthermore, the silver halide light-sensitive materials of the present invention can also be used as the heat developable light-sensitive materials disclosed, for example, in U.S. Pat. No. 4,500,626, JP-A-60-133449, JP-A-59-218443, JP-A-61-238056 and European Patent 210,660A2.

The invention is described in detail below by means of illustrative examples, but the invention is not limited by these examples.

EXAMPLE 1

Sample 101, a multi-layer color light-sensitive material comprised of a cellulose triacetate film support on which an under-layer had been established and multi-coated thereon with the layers in which the compositions are indicated below, was prepared.

Composition of the Photographic Layer

The numerical value corresponding to each component indicates the coated weight in units of g/m$^2$, the coated weight being shown as the calculated weight of silver in the case of the silver halides. Furthermore, with the sensitizing dyes the coated weight is indicated in units of mol per mol of silver halide in the same layer.

| Sample 101 | |
|---|---|
| First Layer (Anti-halation Layer) | |
| Black colloidal silver | as silver 0.18 |
| Gelatin | 1.40 |
| Second Layer (Intermediate Layer) | |
| 2,5-Di-tert-pentadecylhydroquinone | 0.18 |
| EX-1 | 0.070 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third Layer (First Red Sensitive Emulsion Layer) | |

-continued

| Sample 101 | |
|---|---|
| Emulsion A | as silver 0.25 |
| Emulsion B | as silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.30 |
| EX-10 | 0.020 |
| U-1 | 0.070 |
| U-2 | 0.050 |
| U-3 | 0.070 |
| HBS-1 | 0.060 |
| Gelatin | 0.87 |
| Fourth Layer (Second Red Sensitive Emulsion Layer) | |
| Emulsion G | as silver 1.00 |
| Sensitizing dye I | $5.1 \times 10^{-1}$ |
| Sensitizing dye II | $1.4 \times 10^{-5}$ |
| Sensitizing dye III | $2.3 \times 10^{-4}$ |
| EX-2 | 0.35 |
| EX-3 | 0.050 |
| EX-10 | 0.015 |
| U-1 | 0.070 |
| U-2 | 0.050 |
| U-3 | 0.070 |
| Gelatin | 1.30 |
| Fifth Layer (Third Red Sensitive Emulsion Layer) | |
| Emulsion D | as silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.085 |
| EX-3 | 0.010 |
| EX-4 | 0.072 |
| HBS-1 | 0.22 |
| HBS-2 | 0.10 |
| Gelatin | 1.63 |
| Sixth Layer (Intermediate Layer) | |
| EX-5 | 0.040 |
| HBS-1 | 0.020 |
| Gelatin | 0.80 |
| Seventh Layer (First Green Sensitive Emulsion Layer) | |
| Emulsion A | as silver 0.15 |
| Emision B | as silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.13 |
| EX-14 | 0.17 |
| EX-7 | 0.030 |
| EX-8 | 0.025 |
| HBS-1 | 0.30 |
| HBS-3 | 0.005 |
| Gelatin | 0.63 |
| Eighth Layer (Second Green Sensitive Emulsion Layer) | |
| Emulsion C | as silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.060 |
| EX-14 | 0.045 |
| EX-7 | 0.026 |
| EX-8 | 0.018 |
| HBS-1 | 0.16 |
| HBS-3 | $5.0 \times 10^{-3}$ |
| Gelatin | 0.50 |
| Ninth Layer (Third Green Sensitive Emulsion Layer) | |
| Emulsion E | as silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.025 |
| EX-11 | 0.10 |
| EX-13 | 0.015 |
| HBS-1 | 0.25 |
| HBS-2 | 0.10 |

-continued

| Sample 101 | |
|---|---|
| Gelatin | 1.54 |
| Tenth Layer (Yellow Filter Layer) | |
| Yellow colloidal silver | as silver 0.050 |
| EX-5 | 0.080 |
| HBS-1 | 0.030 |
| Gelatin | 0.95 |
| Eleventh Layer (First Blue Sensitive Emulsion Layer) | |
| Emulsion A | as silver 0.080 |
| Emulsion B | as silver 0.070 |
| Emulsion F | as silver 0.070 |
| Sensitizing dye VII | $3.5 \times 10^{-4}$ |
| EX-8 | 0.042 |
| EX-9 | 0.81 |
| HBS-1 | 0.41 |
| Gelatin | 1.10 |
| Twelfth Layer (Second Blue sensitive Emulsion Layer) | |
| Emulsion G | as silver 0.45 |
| Sensitizing dye VII | $2.1 \times 10^{-4}$ |
| EX-9 | 0.17 |
| EX-10 | $7.0 \times 10^{-3}$ |
| HBS-1 | 0.090 |
| Gelatin | 0.78 |
| Thirteenth Layer (Third Blue sensitive Emulsion Layer) | |
| Emulsion H | as silver 0.77 |

-continued

| Sample 101 | |
|---|---|
| Sensitizing dye VII | $2.2 \times 10^{-4}$ |
| EX-9 | 0.22 |
| HBS-1 | 0.11 |
| Gelatin | 0.69 |
| Fourteenth Layer (First Protective Layer) | |
| Emulsion I | as silver 0.20 |
| U-4 | 0.11 |
| U-5 | 0.17 |
| HBS-1 | $5.0 \times 10^{-2}$ |
| Gelatin | 1.00 |
| Fifteenth Layer (Second Protective Layer) | |
| H-1 | 0.40 |
| B-1 (Diameter 1.7 μm) | $5.0 \times 10^{-2}$ |
| B-2 (Diameter 1.7 μm) | 0.10 |
| B-3 | 0.10 |
| S-1 | 0.20 |
| Gelatin | 1.20 |

Furthermore, W-1, W-2, W-3, W-4, B-4, B-5, F-1, F-2, F-3, F-4, F-5, F-6, F-7, F-8, F-9, F-10, F-11, F-12, F-13, F-14 and iron salts, lead salts, gold salts, platinum salts, iridium salts and rhodium salts were included in all of the layers with a view to improving storage properties, processing properties, pressure resisting properties, fungicidal and biocidal properties, anti-static properties and coating properties.

| Emulsion* | Average AQI Content (%) | Average Grain Size (μm) | Variation Coefficient of the Grain Size (%) | Diameter/ Thickness Ratio | Silver Weight Ratio (AgI Content %) |
|---|---|---|---|---|---|
| A | 4.0 | 0.25 | 15 | 1.0 | Core/Shell = 1/3 (13/1), double structure grains |
| B | 8.9 | 0.40 | 14 | 1.0 | Core/Shell = 3/7 (25/2), double structure grains |
| C | 10 | 0.75 | 18 | 5.5 | Core/Shell = 1/2 (24/3), double structure grains |
| D | 16 | 0.90 | 20 | 7.5 | Core/Shell = 4/6 (40/0), double structure grains |
| E | 10 | 0.85 | 19 | 6.0 | Core/Shell = 1/2 (24/3), double structure grains |
| F | 4.0 | 0.25 | 28 | 1.0 | Core/Shell = 1/3 (13/1), double structure grains |
| G | 14.0 | 0.60 | 17 | 7.0 | Core/Shell = 1/2 (42/0), double structure grains |
| H | 14.5 | 1.10 | 20 | 5.0 | Core/Shell = 37/63 (34/3), double structure grains |
| I | 1 | 0.07 | 15 | 1 | Uniform grains |

*: AGBrI emulsions were used.

EX-1

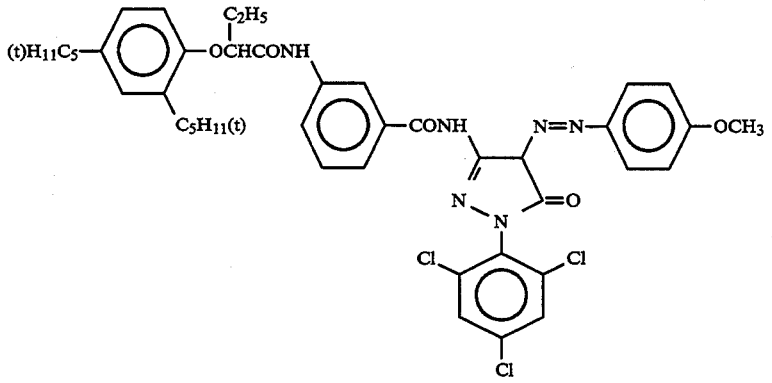

-continued
EX-2
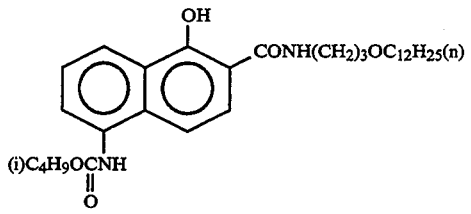
EX-3
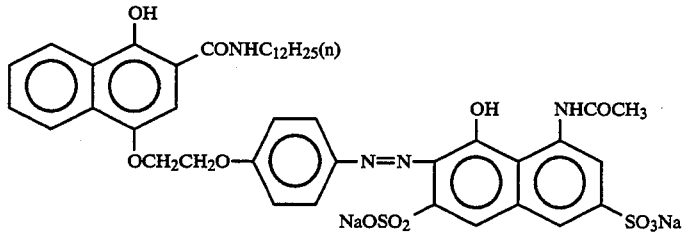
EX-4
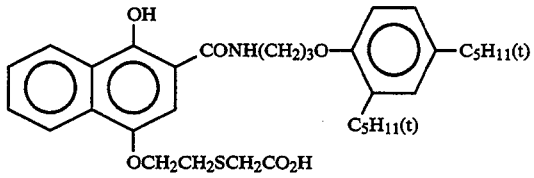
EX-5
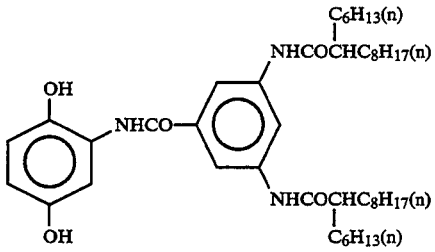
EX-6
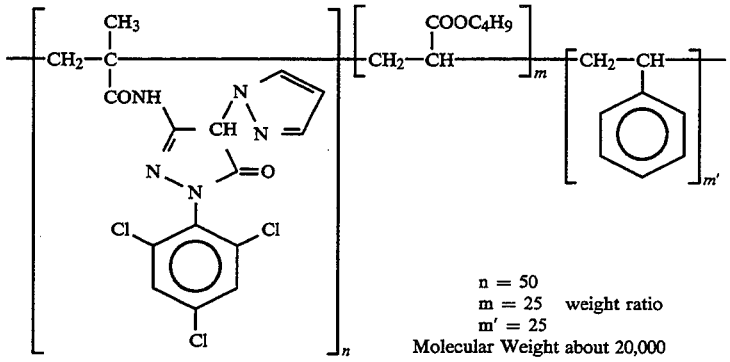
n = 50
m = 25 weight ratio
m' = 25
Molecular Weight about 20,000
EX-7
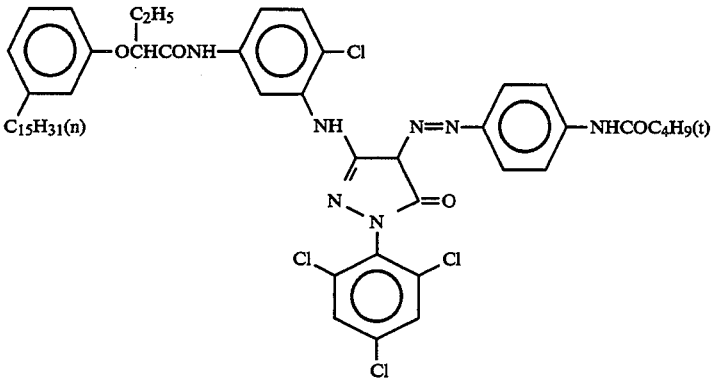

-continued
EX-8
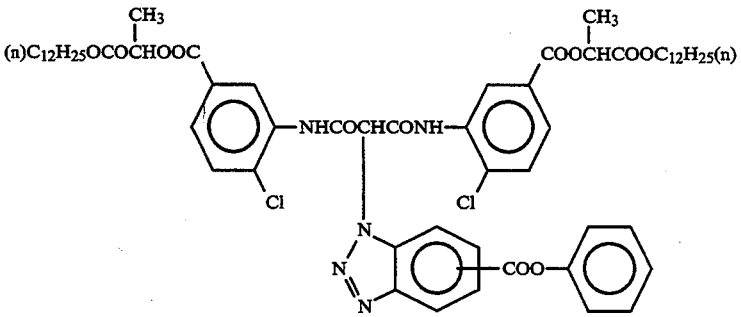
EX-9
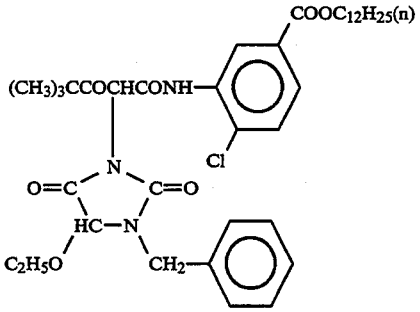
EX-10
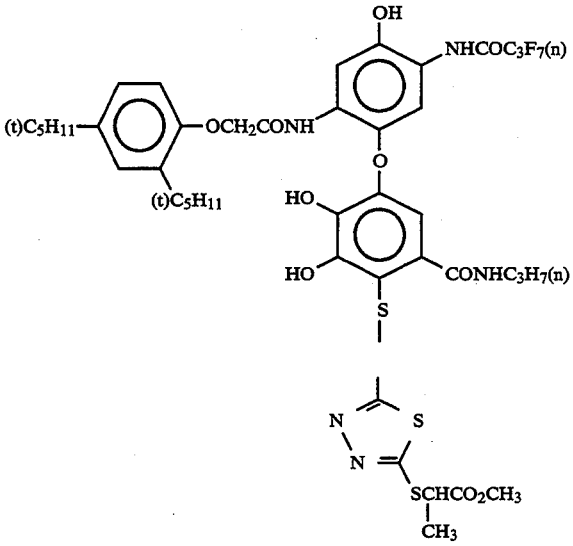
EX-11
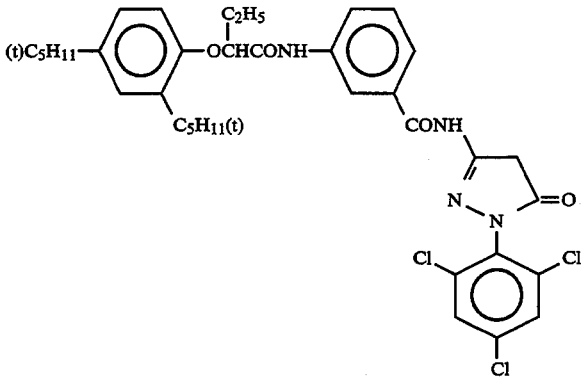

-continued
EX-12
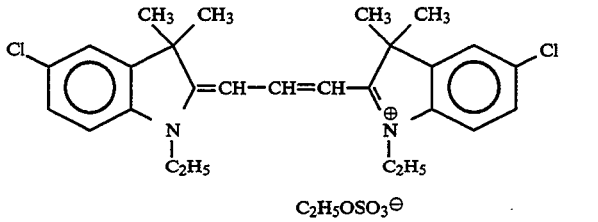
EX-13
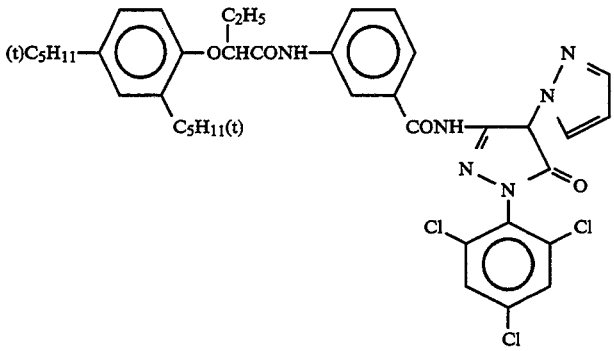
EX-14
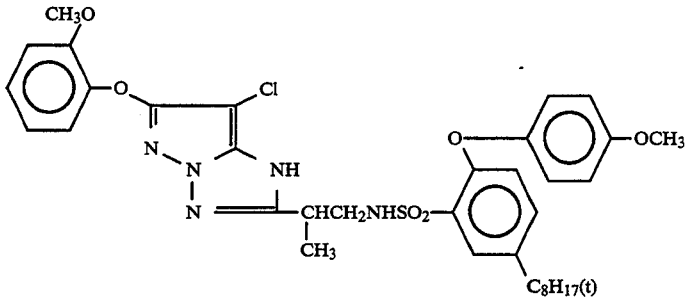
U-1
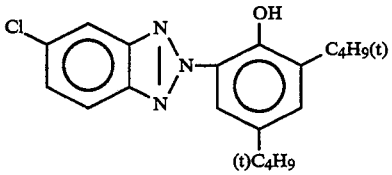
U-2
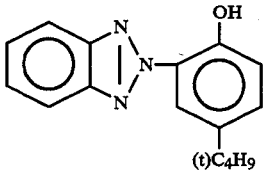
U-3
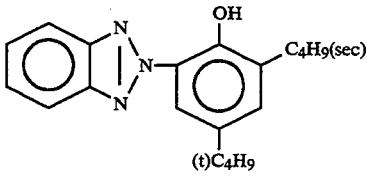
U-4
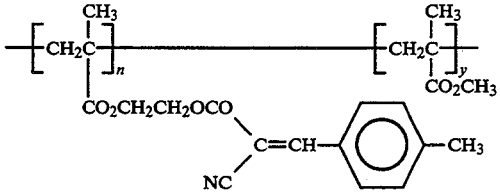
x:y = 70:30 (wt%)

-continued
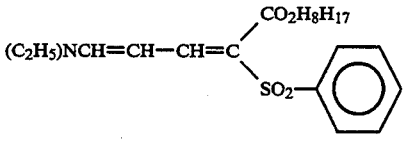
U-5
Tricresyl phoshate
HBS-1
Di-n-butyl phthalate
HBS-2
HBS-3
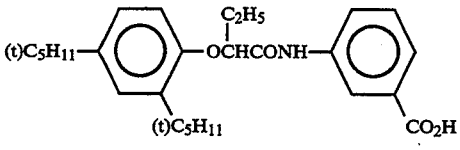
Sensitizing Dye I
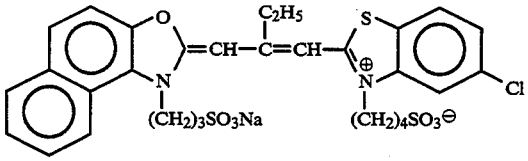
Sensitizing Dye II
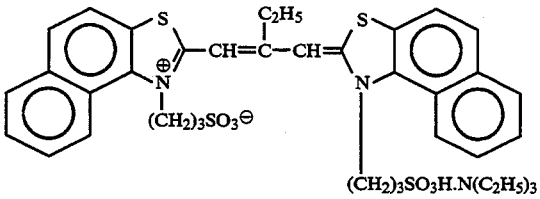
Sensitizing Dye III
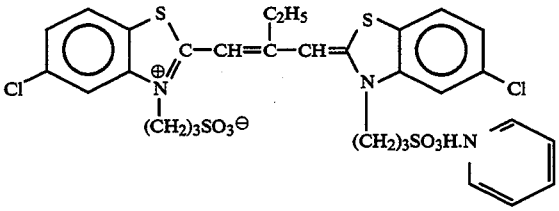
Sensitizing Dye IV
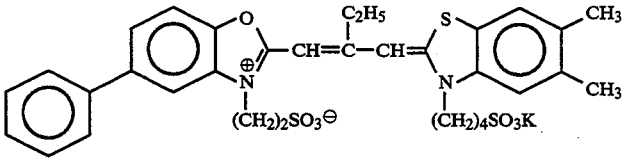
Sensitizing Dye V
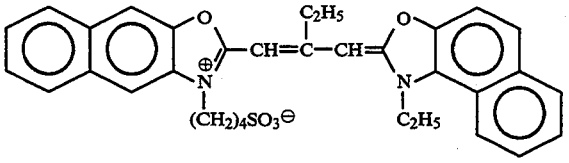
Sensitizing Dye VI
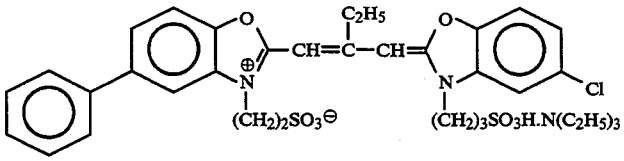

-continued
Sensitizing Dye VII
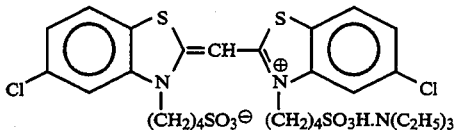
S-1
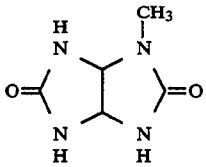
H-1
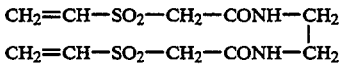
B-1
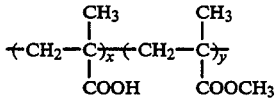
x/y = 10/90 (by weight)
number average molecular
weight: about 20,000
B-2
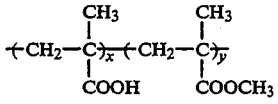
x/y = 40/60 (by weight)
number average molecular
weight: about 20,000
B-4
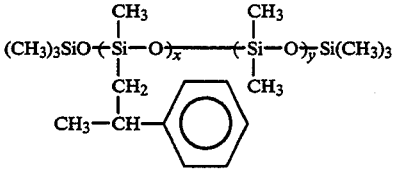
x/y = 29/46 (by weight)
number average molecular
weight: about 10,000
B-4
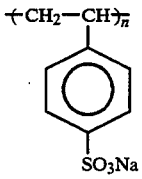
molecular weight: 40,000
B-5
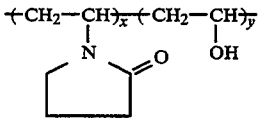
x/y = 70/30 (by weight)
number average molecular
weight: 15,000
W-1
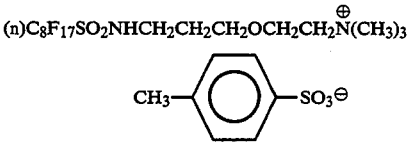
W-2
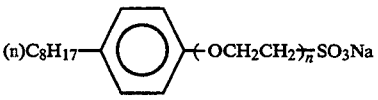
n = 2~4
W-3
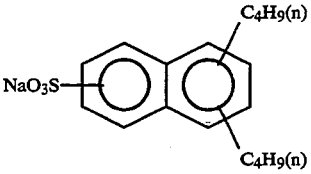

-continued
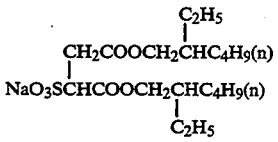
W-4
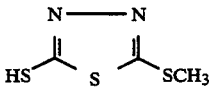
F-1
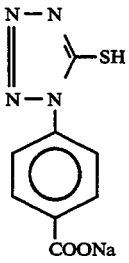
F-2
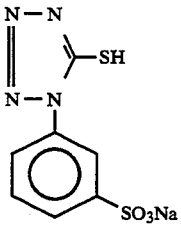
F-3
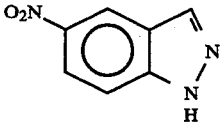
F-4
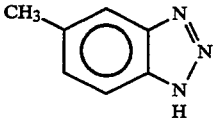
F-5
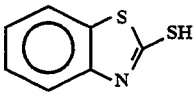
F-6
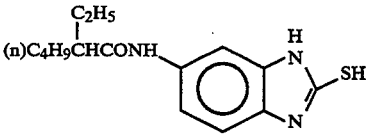
F-7
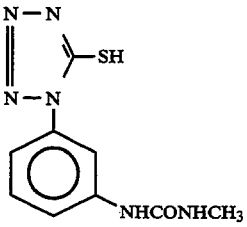
F-8
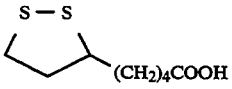
F-9

-continued

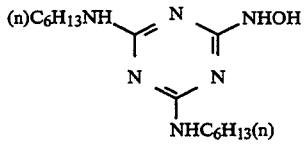

F-10

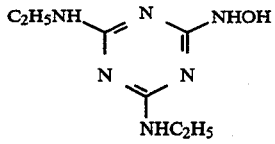

F-11

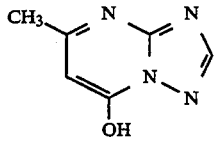

F-12

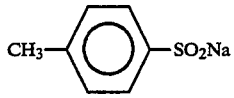

F-13

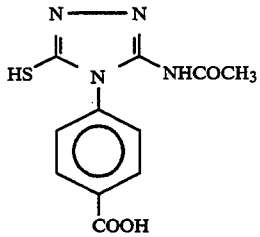

F-14

Next, samples 102 et seq. were prepared in the same way as sample 101 without modification except that yellow colored cyan couplers were added to the third, fourth and fifth layers (red sensitive emulsion layers) in amounts of $5.0\times10^{-5}$ mol/m$^2$ in the third layer, $6.0\times10^{-5}$ mol/m$^2$ in the fourth layer and $2.0\times10^{-5}$ mol/m$^2$ in the fifth layer respectively, and the yellow couplers in the eleventh, twelfth and thirteenth layers (blue sensitive emulsion layers) were replaced with equimolar amounts of other couplers, as shown in Table 1-1.

TABLE 1-1

| Sample Number | 3rd–5th Layers (Red sensitive emulsion layers) Yellow Colored Coupler | 11th–13th Layers (Blue sensitive emulsion layers) General Formula [A] |
|---|---|---|
| 101 (Comp. Ex.) | — | EX-9 |
| 102 (Comp. Ex.) | Coupler (a) | EX-9 |
| 103 (Comp. Ex.) | Coupler (b) | EX-9 |
| 104 (Comp. Ex.) | — | Comp. Coupler (c) |
| 105 (Comp. Ex.) | — | Comp. Coupler (d) |
| 106 (Comp. Ex.) | Coupler (b) | Comp. Coupler (c) |
| 107 (Comp. Ex.) | Coupler (b) | Comp. Coupler (c) |
| 108 (Comp. Ex.) | (YC-10) | EX-9 |
| 109 (Comp. Ex.) | — | (Y-9) |
| 110 (Invention) | Coupler (a) | (Y-9) |
| 111 (Invention) | Coupler (b) | (Y-9) |
| 112 (Invention) | (YC-10) | (Y-9) |
| 113 (Invention) | (YC-1) | (Y-10) |
| 114 (Invention) | (YC-7) | (Y-48) |
| 115 (Invention) | (YC-16) | (Y-12) |
| 116 (Invention) | (YC-17) | (Y-39) |
| 117 (Invention) | (YC-1) | (Y-7) |
| 118 (Invention) | (YC-35) | (Y-9) |
| 119 (Invention) | (YC-51) | (Y-9) |

TABLE 1-1-continued

Coupler (a)
Illustrative Compound C-4 of JP-A-61-221748

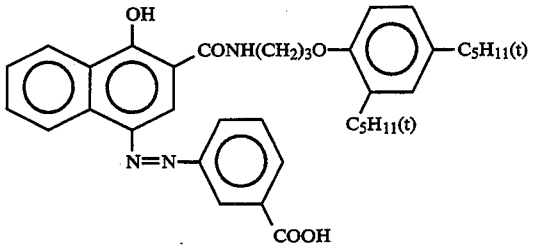

Coupler (b)
Illustrative Compound II-3 of JP-A-1-319744

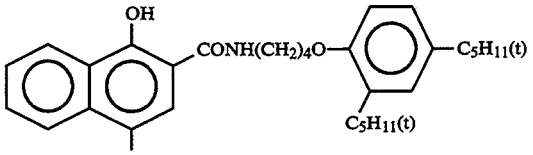

TABLE 1-1-continued

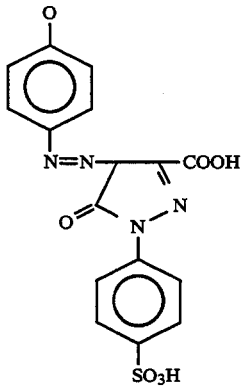

Comparative Coupler (c)
Analogous Compound Disclosed in JP-A-47-26133

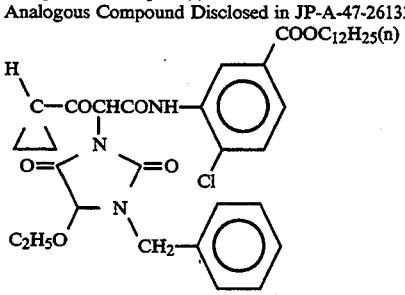

Comparative Coupler (d)
Analogous Compound Disclosed in U.S. Pat. No. 3,265,506

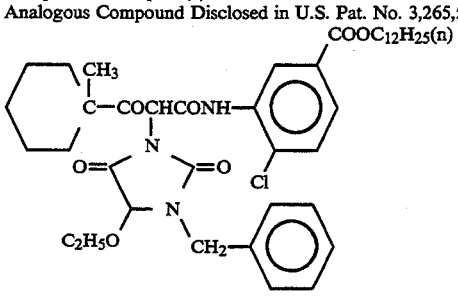

The samples prepared in this way were cut and finished and submitted to be following tests.

The samples were subjected to a wedge exposure to white light (4800° K) and processed in accordance with the method of color development processing indicated below, and then samples which had been given an imagewise exposure were processed until the cumulative quantity of replenisher supplied to the color development tank reached three times the mother liquor bath capacity, after which samples which had been exposed under the same conditions as those described above were processed once again. The samples obtained by processing in this way were subjected to density measurements and the characteristic curves were obtained.

(1-1) The logarithms of the reciprocals of the exposures required to provide densities of minimum density ($D_{min}$)+0.2 on each characteristic curve measured in blue light (B) and red light (R) were obtained from the characteristic curves of the samples which had been processed before the continuous processing run and these values were taken to be the photographic speeds ($S_B$ and $S_R$), and then the differences were calculated by taking sample 101 as a standard. Furthermore, the densities ($D_B$ and $D_R$) on giving an exposure of logE=1.5 were read off on the higher exposure side from the exposure which gave a density of minimum density ($D_{min}$)+0.2 and the density differences were obtained again taking sample 101 as a standard.

(1-2) The photographic speeds ($S_B$ and $S_R$) and the densities ($D_B$ and $D_R$) were read off in the same way as before from the characteristics curves of the samples processed after the continuous processing run, the differences in photographic speed before and after continuous processing ($\Delta S_{B1}$ and $\Delta S_{R1}$) were obtained and these values were used to investigate the changes in photographic performance due to processing fluctuations.

(1-3) Samples which had been processed after the continuous processing run were stored for 10 days under high temperature high humidity conditions of 80° C., 70% RH and then the density after the test at the point at which the exposure gave a density of minimum density ($D_{min}$)+1.5 before the start of the test was measured with blue light (B) and red light (R) and the reductions in density ($\Delta D_B$, $\Delta D_R$) were obtained.

(1-4) Two specimens of each sample were prepared and one was stored in the freezer in a refrigerator and the other was stored under conditions of 50° C., 55% RH for a period of 7 days. After storage, the two specimens were subjected to a wedge exposure with white light under the same conditions and then they were processed using the processing baths obtained after the continuous processing run described above had been completed. The processed samples were subjected to density measurements and the speeds were obtained in the same way as before from the characteristic curves. The differences in speed with blue and red light for the specimens which had been stored under conditions of 50° C., 55% RH measured taking the speeds of the specimen of the same sample which had been stored in the freezer as a standard were obtained. These were the $\Delta S_{B2}$ and $\Delta S_{R2}$ values.

(1-5) Each sample was subjected to a wedge exposure with a red color separation filter and then the samples were processed using the processing baths after the continuous processing run described above had been completed, and the densities of the samples so obtained were measured. The yellow density at the same exposure as the exposure which gave a density of minimum density ($D_{min}$)+1.5 for the cyan density measured with red light was obtained from the characteristic curve and the difference ($\Delta D_Y$) from the yellow density in the uncolored part of the cyan image was calculated as an evaluation of the color mixing of the cyan image. Moreover, color mixing became less pronounced as the value of the density difference ($\Delta D_Y$) became smaller (or took on a negative value), showing an increase in saturation and superior color reproduction.

The results of the performance evaluation described above are summarized in Table 1-2. Moreover, the processing used in this example was as indicated below.

| | Processing Operations | | | |
|---|---|---|---|---|
| Process | Processing Time | Processing Temp. | Replenishment* | Tank Capacity |
| Color Development | 3 min. 05 sec. | 38.0° C. | 600 ml | 5 liters |

-continued

| Process | Processing Time | Processing Operations Processing Temp. | Replenishment* | Tank Capacity |
|---|---|---|---|---|
| Bleach | 50 sec. | 38.0° C. | 140 ml | 3 liters |
| Bleach-fix | 50 sec. | 38.0° C. | — | 3 liters |
| Fix | 50 sec. | 38.0° C. | 420 ml | 3 liters |
| Water Wash | 30 sec. | 38.0° C. | 980 ml | 2 liters |
| Stabilizer (1) | 30 sec. | 38.0° C. | — | 2 liters |
| Stabilizer (2) | 20 sec. | 38.0° C. | 560 ml | 2 liters |
| Drying | 1 minute | 60° C. | | |

*: Replenishment amount per square meter of photosensitive material

The stabilizing solution was used in a counter-flow system from (2) to (1) and the overflow of water washing water is all introduced into the fixing bath. Replenishment of the bleach-fixing bath was achieved with connections by means of pipes between the top of the bleaching tank and the bottom of the bleach-fixing tank and between the top of the fixing tank and the bottom of the bleach-fixing tank of the automatic processor with all of the overflow produced on replenishing the bleaching tank and the fixing tank being introduced into the bleach-fixing bath. Moreover, the carry-over of developer into the bleaching process, the carry-over of bleaching solution into the bleach-fixing process, the carry-over of bleach-fixing solution into the fixing process and the carry-over of fixing solution into the water washing process were 65 ml, 50 ml, 50 ml, and 50 ml respectively, per square meter of light-sensitive material. Furthermore, in each case the crossover time was 5 seconds, and this time is included in the processing time of the preceding process.

The composition of each processing bath is indicated below.

| | Mother Liquor (grams) | Replenisher (grams) |
|---|---|---|
| Color Developing Bath | | |
| Diethylenetriamine penta-acetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.0 |
| Water to make up to | 1.0 liter | 1.0 liter |
| pH | 10.05 | 10.15 |
| Bleaching | | |
| 1,3-Propylenediamine tetra-acetic acid ferric ammonium salt monohydrate | 144.0 | 206.0 |
| Ammonium bromide | 84.0 | 120.0 |
| Ammonium nitrate | 17.5 | 25.0 |
| Hydroxyacetic acid | 63.0 | 90.0 |

-continued

| | Mother Liquor (grams) | Replenisher (grams) |
|---|---|---|
| Acetic acid | 54.2 | 80.0 |
| Water to-make up to | 1.0 liter | 1.0 liter |
| pH (adjusted with aqueous ammonia) | 3.80 | 3.60 |
| Bleach-Fixing Bath | | |
| A 15:85 mixture of the bleach mother liquor indicated above and the fixing mother liquor indicated below. | | |
| Fixing Bath | | |
| Ammonium sulfite | 19.0 | 57.0 |
| Aqueous ammonium thiosulfate solution (700 g/l) | 280 ml | 840 ml |
| Imidazole | 28.5 | 85.5 |
| Ethylene diamine tetra-acetic acid | 12.5 | 37.5 |
| Water to make up to | 1.0 liter | 1.0 liter |
| pH (Adjusted with aqueous ammonia and acetic acid) | 7.40 | 7.45 |
| Washing Water | Mother Liquor = Replenisher | |

Town water was passed through a mixed bed type column which had been packed with an H-type strongly acidic cation exchange resin ("Amberlite IR-120B", made by the Rohm and Haas Co.) and an OH-type strongly basic anion exchange resin ("Amberlite IRA-400", made by the same company) and treated in such a way that the calcium and magnesium ion concentrations were not more than 3 mg/l, after which 20 mg/l of sodium isocyanurate dichloride and 150 mg/l of sodium sulfate were added. The pH of this solution was within the range from 6.5 to 7.5.

| Stabilizing Bath | Mother Liquor = Replenisher (Units:Grams) |
|---|---|
| Formalin (37%) | 1.2 ml |
| Sodium p-toluenesulfinate | 0.3 |
| Polyoxyethylene p-monononyl phenyl ether (average degree of polymerization 10) | 0.2 |
| Ethylenediamine tetra-acetic acid disodium salt | 0.05 |
| Water to make up to | 1.0 liter |
| pH | 7.2 |

TABLE 1-2

| Sample No | Photographic Properties · Speed $S_B$ | $S_R$ | Photographic Properties · Color Density $D_B$ | $D_R$ | Continuous processing $\Delta S_{B1}$ | $\Delta S_{R1}$ | Aging and Storing of Sensitive Material $\Delta S_{B2}$ | $\Delta S_{R2}$ | Colored Image Fastness $\Delta D_B$ | $\Delta D_r$ | Color Turbidity $\Delta D_Y$ |
|---|---|---|---|---|---|---|---|---|---|---|---|
| 101 (Comparative-Example) | 0.00 (Standard) | 0.00 (Standard) | 0.00 (Standard) | 0.00 (Standard) | −0.06 | −0.05 | +0.06 | +0.06 | −0.10 | −0.08 | +0.16 |
| 102 (Comparative-Example) | 0.00 | −0.03 | 0.00 | −0.04 | −0.06 | −0.07 | +0.06 | +0.08 | −0.10 | −0.13 | +0.14 |
| 103 | 0.00 | −0.01 | 0.00 | −0.00 | −0.06 | −0.06 | +0.06 | +0.07 | −0.10 | −0.10 | +0.11 |

TABLE 1-2-continued

| Sample No | Photographic Properties · Speed | | Photographic Properties · Color Density | | Continuous processing | | Aging and Storing of Sensitive Material | | Colored Image Fastness | | Color Turbidity |
|---|---|---|---|---|---|---|---|---|---|---|---|
| | $S_B$ | $S_R$ | $D_B$ | $D_R$ | $\Delta S_{B1}$ | $\Delta S_{R1}$ | $\Delta S_{B2}$ | $\Delta S_{R2}$ | $\Delta D_B$ | $\Delta D_r$ | $\Delta D_Y$ |
| (Comparative-Example) 104 | −0.03 | 0.00 | −0.05 | 0.00 | −0.08 | −0.05 | +0.07 | +0.06 | −0.14 | −0.08 | +0.16 |
| (Comparative-Example) 105 | −0.06 | 0.00 | −0.10 | 0.00 | −0.11 | −0.05 | +0.08 | +0.06 | −0.21 | −0.08 | +0.16 |
| (Comparative-Example) 106 | −0.03 | −0.01 | −0.05 | 0.00 | −0.08 | −0.06 | +0.07 | +0.07 | −0.14 | −0.10 | +0.11 |
| (Comparative-Example) 107 | −0.03 | −0.01 | −0.05 | 0.00 | −0.08 | −0.06 | +0.07 | +0.07 | −0.14 | −0.10 | +0.11 |
| (Comparative-Example) 108 | 0.00 | +0.02 | 0.00 | +0.03. | −0.06 | −0.04 | +0.06 | +0.06 | −0.10 | −0.08 | +0.07 |
| (Comparative-Example) 109 | +0.03 | 0.00 | +0.04 | 0.00 | −0.04 | −0.05 | +0.05 | +0.06 | −0.08 | −0.08 | +0.16 |
| (Comparative-Example) 110 | +0.06 | 0.00 | +0.11 | 0.00 | −0.02 | −0.04 | +0.02 | +0.07 | −0.06 | −0.11 | +0.13 |
| (This Invention) 111 | +0.06 | +0.02 | +0.11 | +0.04 | −0.02 | −0.03 | +0.02 | +0.06 | −0.06 | −0.09 | +0.10 |
| (This Invention) 112 | +0.06 | +0.05 | +0.11 | +0.08 | −0.02 | −0.02 | +0.02 | +0.03 | −0.06 | −0.06 | +0.05 |
| (This Invention) 113 | +0.06 | +0.06 | +0.10 | +0.10 | −0.02 | −0.01 | +0.02 | +0.03 | −0.05 | −0.07 | +0.05 |
| (This Invention) 114 | +0.08 | +0.07 | +0.14 | +0.13 | −0.01 | −0.01 | 0.00 | +0.01 | −0.06 | −0.04 | +0.04 |
| (This Invention) 115 | +0.06 | +0.06 | +0.11 | +0.11 | −0.02 | −0.01 | +0.02 | +0.02 | −0.07 | −0.04 | +0.04 |
| (This Invention) 116 | +0.05 | +0.05 | +0.08 | +0.08 | −0.03 | −0.02 | +0.03 | +0.03 | −0.07 | −0.05 | +0.04 |
| (This Invention) 117 | +0.04 | +0.05 | +0.06 | +0.08 | −0.03 | −0.02 | +0.04 | +0.03 | −0.08 | −0.06 | +0.04 |
| (This Invention) 118 | +0.06 | +0.04 | +0.11 | +0.07 | −0.02 | −0.02 | +0.02 | +0.04 | −0.06 | −0.07 | +0.08 |
| (This Invention) 119 | +0.06 | +0.03 | +0.11 | +0.05 | −0.02 | −0.03 | +0.02 | +0.05 | −0.06 | −0.08 | +0.10 |
| (This Invention) | | | | | | | | | | | |

It is clear from the results shown in Table 1-2 that samples 110 to 119 which fulfilled the structural requirements of the present invention had higher photographic speeds and higher color densities than the comparative samples 101 to 109, and they also exhibited less change in photographic properties (speed) during continuous processing and on aging and storing, they had superior colored image fastness and, moreover, excellent color reproduction with little color turbidity.

Furthermore, with the samples which fulfilled the structural requirements of the present invention it is clear from samples 110–112, 118 and 119 that, in connection with the yellow colored cyan couplers, the best characteristics indicated above were obtained when the group which could be eliminated by reaction with the oxidized product of a color developing agent was a 6-hydroxy-2-pyridon-5-ylazo group, followed by the 2-acylaminophenylazo group, and then the pyrazolon-4-ylazo group and the phenylazo group.

Moreover, it is clear from samples 113 and 117 that, in connection with the acylacetamide yellow couplers having an acyl group represented by general formula (A), the with leaving groups, a group in which X was represented by (Y-1) exhibited superior characteristics in terms of the characteristics described above than a group in which X was represented by formula (Y-2).

In particular, it is clear from a comparison of comparative samples 102, 103 and 106–109 and samples 110–119 of the present invention that the performance obtained was superior to an extent which could not be anticipated by using both of the couplers which are a structural requirement of the present invention at the same time rather than by using a yellow colored cyan coupler and an acyl acetamide yellow coupler having an acyl group represented by general formula (A) individually, and it is clear that with the yellow colored cyan couplers of the present invention, the effect is pronounced when it is used in combination with a yellow colored cyan coupler shown in an earlier example and an acylacetamide yellow coupler having an acyl group represented by general formula (A). Furthermore, it is clear from a comparison of comparative samples 104 to 107 and samples 110 and 111 of the present invention that an acyl acetamide yellow coupler having an acyl group represented by general formula (A) provides a high coloring ability (speed, coloring density), stability of continuous processing, storing stability, fastness of color image which cannot be conjectured from the results obtained by using comparative coupler used in this Example.

EXAMPLE 2

Samples were prepared on the basis of sample 110 of Example 1 by replacing the yellow colored cyan coupler and the acyl acetamide yellow coupler having an acyl group represented by the aforementioned general formula (A) with equimolar amounts of couplers indicated in Table 2, the rest of the samples remaining unchanged.

These prepared samples were then evaluated in terms of performance in the same way as in Example 1.

TABLE 2

| Sample | 3rd–5th Layers (Red sensitive emulsion layers) Yellow Colored Cyan Coupler | 11th–13th Layers (Blue sensitive emulsion layers) Yellow Coupler |
|---|---|---|
| 201 | (YC-3) | (Y-49) |
| 202 | (YC-6) | (Y-55) |
| 203 | (YC-13) | (Y-53) |
| 204 | (YC-18) | (Y-37) |
| 205 | (YC-21) | (Y-38) |
| 206 | (YC-25) | (Y-40) |
| 207 | (YC-27) | (Y-42) |
| 208 | 3rd, 4th layers (YC-17) 5th Layer (YC-30) | 11th Layer (Y-1) 12th Layer (Y-3) 13th Layer (Y-48) |
| 209 | (YC-4)/(YC-30) = ½ (mol ratio) | (Y-51) |
| 210 | YC-33 | (Y-6) |
| 211 | YC-36 | (Y-24) |
| 212 | YC-41 | (Y-15) |
| 213 | YC-42 | (Y-16) |
| 214 | YC-45 | (Y-22) |
| 215 | YC-49 | (Y-1) |
| 216 | YC-53 | (Y-4) |
| 217 | (YC-27)/(YC-39)/(YC-47) = 1/1/1 (mol ratio) | (Y-2)/(Y-3) = 1/1 (mol ratio) |
| 218 | YC-55 | Y-65 |
| 219 | YC-55 | Y-69 |
| 220 | YC-55 | 11th Layer (Y-71) 12th Layer (Y-70) 13th Layer (Y-64) |

The results obtained confirmed that when compared with the samples in Example 1, samples 201 to 220 which satisfied the structural requirements of the present invention in this Example were all superior in performance to samples 101–109 in Example 1 with respect to speed, photographic color density, changes in speed during continuous processing and on aging and storing the sensitive material, color image fastness and color tubidity.

Moreover, it was confirmed that the performance as referred to above improved in more or less the same way as in Example 1 in connection with the yellow colored cyan coupler in the leaving group in the order of 6-hydroxy-2-pyridon-5-ylazo group (samples 201–209, 212–214, 218–220), 2-acylaminophenylazo group (samples 210, 211), pyrazolon-4-ylazo group (samples 215, 216). Furthermore, with the acyl acetamide yellow couplers having an acyl group represented by general formula (A), the couplers in which the leaving group X is represented by formula (Y-1) (samples 201–203, 207–209, 214–217) were superior in terms of photographic properties, stability during continuous processing and the aging stability of the light-sensitive material when compared with those couplers in which the leaving group X is represented by formula (Y-2) or (Y-3) (samples 210–213). Moreover, on comparing those cases in which the hydrocarbon ring formed by Q with C in general formula (A) was a three to five membered ring with sample 110 of Example 1, sample 215 and samples 204–206, it is clear that the best properties were obtained with a three membered ring, followed in order by four membered rings and five membered rings.

EXAMPLE 3

Sample 301, a multi-layer color light-sensitive material comprised of a cellulose triacetate film support (on which an under-layer had been established) coated thereon with the layers in which the compositions are indicated below, was prepared.

Composition of the Photographic Layer

The coated weights are shown in units of g/m² in the case of silver halides and colloidal silver, in units of g/m² in the case of couplers, additives and gelatin, and in units of mols per mol of silver halide in the same layer in the case of the sensitizing dyes.

| | |
|---|---|
| First Layer Anti-halation Layer | |
| Black colloidal silver | as silver 0.15 |
| Gelatin | 1.90 |
| ExM-8 | $2.0 \times 10^{-2}$ |
| Second Layer Intermediate Layer | |
| Gelatin | 2.10 |
| UV-1 | $3.0 \times 10^{-2}$ |
| UV-2 | $6.0 \times 10^{-2}$ |
| UV-3 | $7.0 \times 10^{-2}$ |
| ExF-1 | $4.0 \times 10^{-3}$ |
| Solv-2 | $7.0 \times 10^{-2}$ |
| Third Layer Low Speed Red Sensitive Emulsion Layer | |
| Silver iodobromide emulsion (AgI 2 mol %, high internal AgI type, corresponding sphere diameter 0.3 μm, variation coefficient of corresponding sphere diameter 29%, regular crystal grain/twinned crystal grain mixture, diameter/thickness ratio 2.5) | 0.50 (coated silver amount) |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-3 | 0.20 |
| ExC-4 | $3.0 \times 10^{-2}$ |
| Solv-1 | $7.0 \times 10^{-3}$ |
| Fourth Layer (Intermediate Speed Red Sensitive Emulsion Layer) | |
| Silver iodobromide emulsion (AgI 4 mol %, high internal AgI type, corresponding sphere diameter 0.55 μm, variation coefficient of corresponding sphere diameter 20%, regular crystal grain/twinned crystal grain mixture, diameter/thickness ratio 1.0) | 0.85 (coated silver amount) |
| Gelatin | 2.00 |
| ExS-1 | $1.0 \times 10^{-4}$ |
| ExS-2 | $3.0 \times 10^{-4}$ |
| ExS-3 | $1.0 \times 10^{-5}$ |
| ExC-2 | $8.0 \times 10^{-2}$ |
| ExC-3 | 0.30 |
| ExY-13 | $2.0 \times 10^{-2}$ |
| ExY-14 | $1.0 \times 10^{-2}$ |
| Cpd-10 | $1.0 \times 10^{-4}$ |
| Solv-1 | 0.10 |
| Fifth Layer (High Speed Red Sensitive Emulsion Layer) | |
| Silver iodobromide emulsion (AgI 10 mol %, high internal AgI type, corresponding sphere diameter 0.7 μm, variation coefficient of corresponding sphere diameter 30%, regular crystal grain/twinned crystal grain mixture, diameter/thickness ratio 2.0) | 0.70 (coated silver amount) |
| Gelatin | 1.60 |
| ExS-1 | $1.0 \times 10^{-4}$ |
| ExS-2 | $3.0 \times 10^{-4}$ |
| ExS-3 | $1.0 \times 10^{-5}$ |

-continued

| | |
|---|---|
| ExC-5 | $7.0 \times 10^{-2}$ |
| ExC-6 | $8.0 \times 10^{-2}$ |
| Solv-1 | 0.15 |
| Solv-2 | $7.5 \times 10^{-2}$ |
| Sixth Layer (Intermediate Layer) | |
| Gelatin | 1.10 |
| P-2 | 0.17 |
| Cpd-1 | 0.10 |
| Cpd-4 | 0.17 |
| Solv-1 | $5.0 \times 10^{-2}$ |
| Seventh Layer (Low Speed Green Sensitive Emulsion Layer) | |
| Silver iodobromide emulsion (AgI 2 mol %, high internal AgI type, corresponding sphere diameter 0.3 μm, variation coefficient of corresponding sphere diameter 28%, regular crystal grain/twinned crystal grain mixture, diameter/thickness ratio 2.5) | 0.30 (coated silver amount) |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-7 | 0.12 |
| ExM-8 | $3.0 \times 10^{-2}$ |
| ExM-9 | 0.10 |
| ExY-13 | $3.0 \times 10^{-2}$ |
| Cpd-11 | $7.0 \times 10^{-3}$ |
| Solv-1 | 0.22 |
| Eighth Layer (Intermediate Speed Green Sensitive Emulsion Layer) | |
| Silver iodobromide emulsion (AgI 4 mol %, high internal AgI type, corresponding sphere diameter 0.55 μm, variation coefficient of corresponding sphere diameter 20%, regular crystal grain/twinned crystal grain mixture, diameter/thickness ratio 4.0) | 0.70 (coated silver amount) |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-7 | 0.12 |
| ExM-8 | $3.0 \times 10^{-2}$ |
| ExM-9 | 0.15 |
| ExM-10 | $1.5 \times 10^{-2}$ |
| ExY-13 | $4.0 \times 10^{-2}$ |
| Cpd-11 | $9.0 \times 10^{-3}$ |
| Solv-1 | 0.27 |
| Ninth Layer (High Speed Green Sensitive Emulsion Layer) | |
| Silver iodobromide emulsion (AgI 10 mol %, high internal AgI type, corresponding sphere diameter 0.7 μm, variation coefficient of corresponding sphere diameter 30%, regular crystal grain/twinned crystal grain mixture, diameter/thickness ratio 2.0) | 0.50 (coated silver amount) |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-8 | $2.0 \times 10^{-2}$ |
| ExM-11 | $6.0 \times 10^{-2}$ |
| ExM-12 | $2.0 \times 10^{-2}$ |
| Cpd-2 | $1.0 \times 10^{-2}$ |
| Cpd-9 | $2.0 \times 10^{-4}$ |

-continued

| | |
|---|---|
| Cpd-10 | $2.0 \times 10^{-4}$ |
| Solv-1 | 0.20 |
| Solv-2 | $5.0 \times 10^{-2}$ |
| Tenth Layer (Yellow Filter Layer) | |
| Gelatin | 0.90 |
| Yellow colloid | $5.0 \times 10^{-2}$ |
| Cpd-1 | 0.20 |
| Solv-1 | 0.15 |
| Eleventh Layer (Low Speed Blue Sensitive Emulsion Layer) | |
| Silver iodobromide emulsion (AgI 4 mol %, high internal AgI type, corresponding sphere diameter 0.5 μm, variation coefficient of the corresponding sphere diameter 15%, octahedral grains) | 0.40 (coated silver amount) |
| Gelatin | 1.00 |
| ExS-8 | $2.0 \times 10^{-4}$ |
| ExY-13 | $9.0 \times 10^{-2}$ |
| ExY-15 | 0.90 |
| Cpd-2 | $1.0 \times 10^{-2}$ |
| Solv-1 | 0.30 |
| Twelfth Layer (High Speed Blue Sensitive Emulsion Layer) | |
| Silver iodobromide emulsion (AgI 10 mol %, high internal AgI type, corresponding sphere diameter 1.3 μm, variation coefficient of the corresponding sphere diameter 25%, regular crystal grain/twinned crystal grain mixture, diameter/thickness ratio 4.5) | 0.50 (coated silver amount) |
| Gelatin | 0.60 |
| ExS-8 | $1.0 \times 10^{-4}$ |
| ExY-15 | 0.12 |
| Cpd-2 | $1.0 \times 10^{-3}$ |
| Solv-1 | $4.0 \times 10^{-2}$ |
| Thirteenth Layer (First Protective Layer) | |
| Fine grain silver iodobromide (average grain size 0.07μ, AgI 1 mol %) | 0.20 |
| Gelatin | 0.80 |
| UV-2 | 0.10 |
| UV-3 | 0.10 |
| UV-4 | 0.20 |
| Solv-3 | $4.0 \times 10^{-2}$ |
| P-2 | $9.0 \times 10^{-2}$ |
| Fourteenth Layer (Second Protective Layer) | |
| Gelatin | 0.90 |
| B-1 (Diameter 1.5 μm) | 0.10 |
| B-2 (Diameter 1.5 μm) | 0.10 |
| B-3 | $2.0 \times 10^{-2}$ |
| H-1 | 0.40 |

Moreover, Cpd-3, Cpd-5, Cpd-6, Cpd-7, Cpd-8, P-1, W-1, W-2, W-3, W-4 and W-5 indicated below were added in order to improve storage properties, processing properties and pressure resistance, for biocidal and fungicidal purposes, for anti-static purposes and for improving the coating properties.

n-Butyl p-hydroxybenzoate was added in addition to the above mentioned compounds to all layers. Moreover, B-4, F-1, F-4, F-5, F-6, F-7, F-8, F-9, F-10, F-11, F-13 and F-14, and iron salts, lead salts, gold salts, platinum salts, iridium salts and rhodium salts were included.

The structural formulae or chemical names of the compounds used in this Example are indicated below.

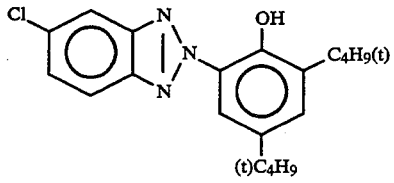
UV-1
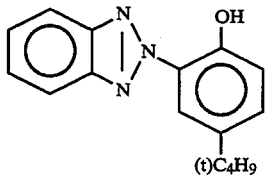
UV-2
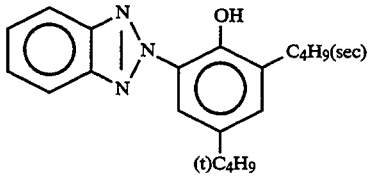
UV-3
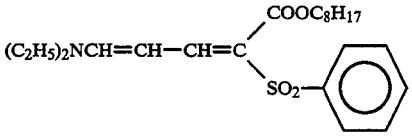
UV-4
Tricresyl phosphate — Solv-1
Dibutyl phthalate — Solv-2
Tri(3-ethylhexyl) phosphate — Solv-3
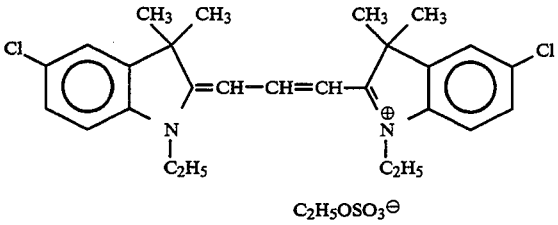
ExF-1
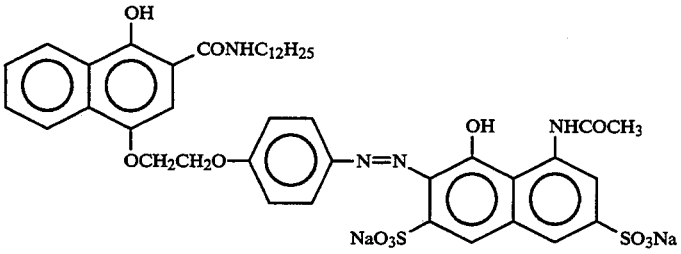
ExC-2
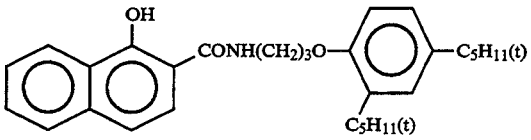
ExC-3

-continued
ExC-4
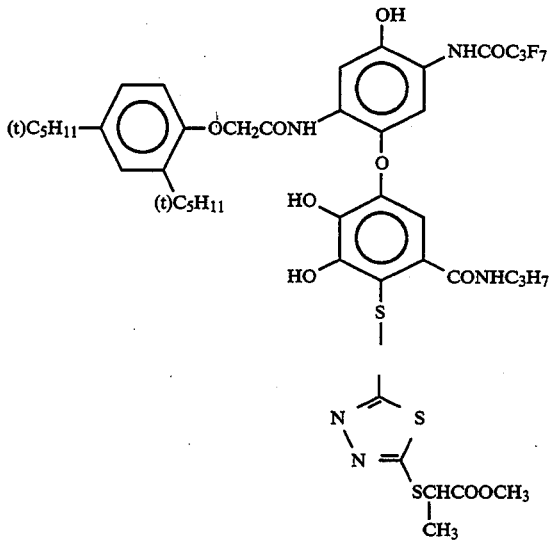
ExC-5
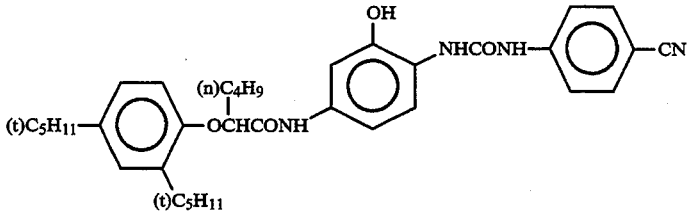
ExC-6
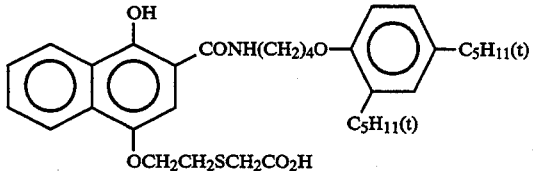
ExM-7
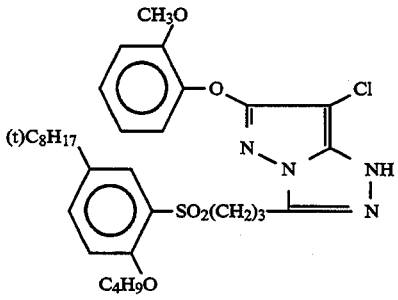
EX-8
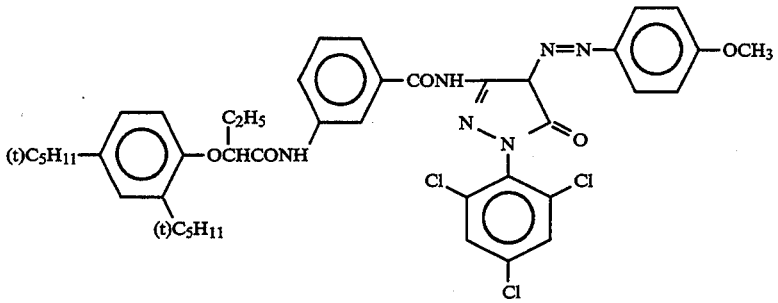

-continued
ExM-9
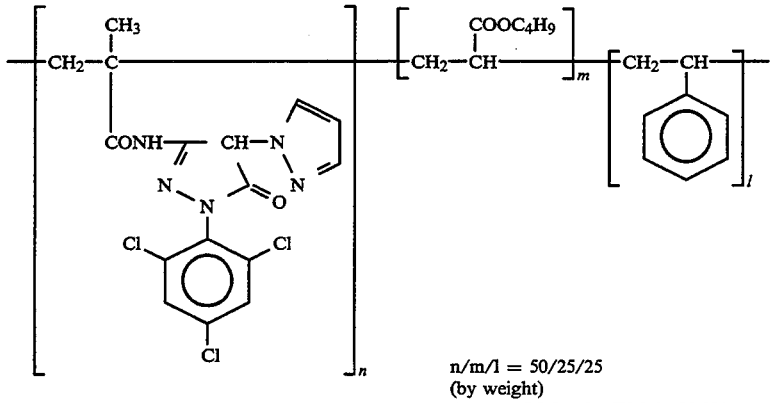
n/m/l = 50/25/25
(by weight)
Average Molecular Weight 20,000
ExM-10
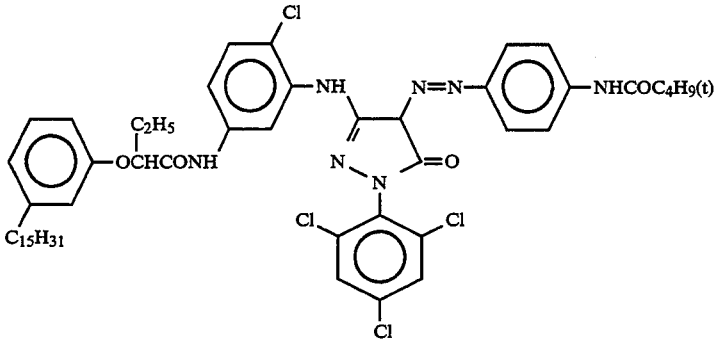
ExM-11
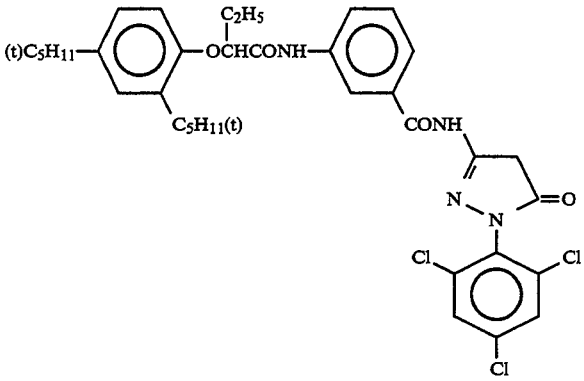
ExM-12
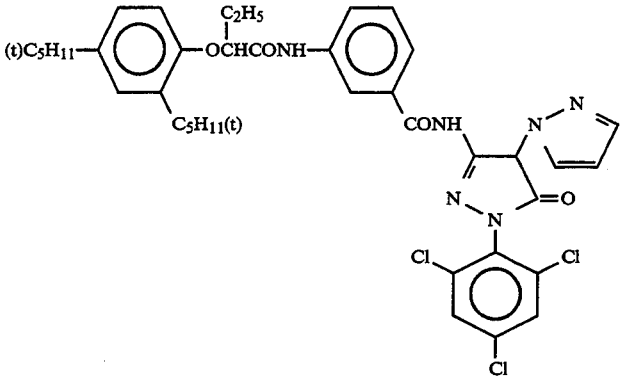

-continued
ExY-13
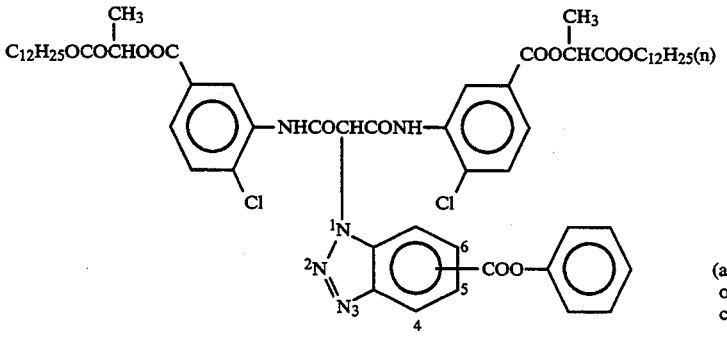
(a 1:1 (mol ratio) mixture of 5- and 6-substituted compounds)
ExY-14
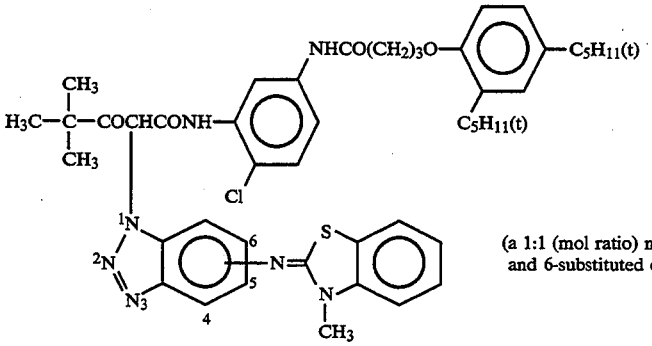
(a 1:1 (mol ratio) mixture of 5- and 6-substituted compounds)
ExY-15
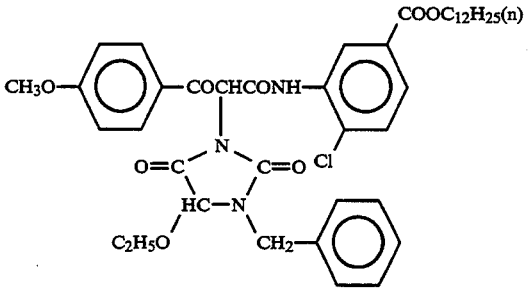
Cpd-1
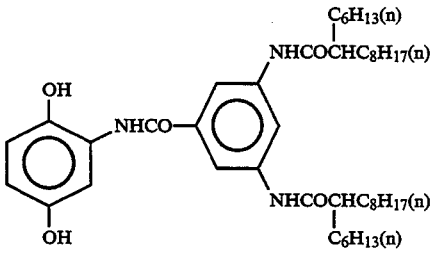
Cpd-2
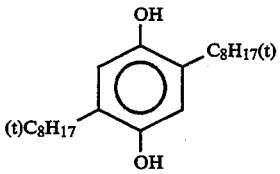
Cpd-3
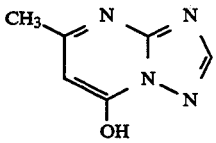

-continued
Cpd-4
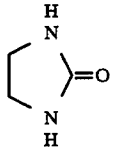
Cpd-5
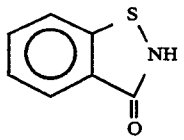
Cpd-6
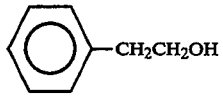
Cpd-7
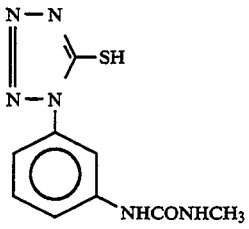
Cpd-8
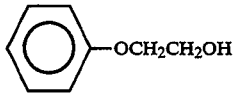
Cpd-9
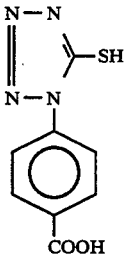
Cpd-10
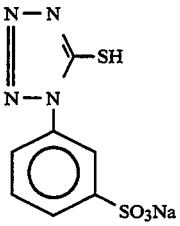
Cpd-11
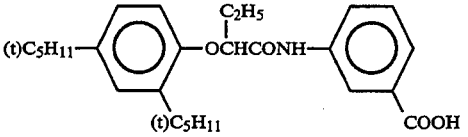
ExS-1
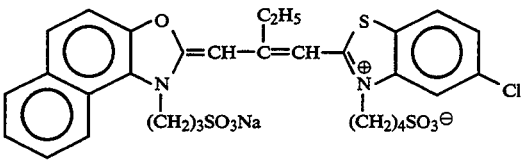

-continued
ExS-2
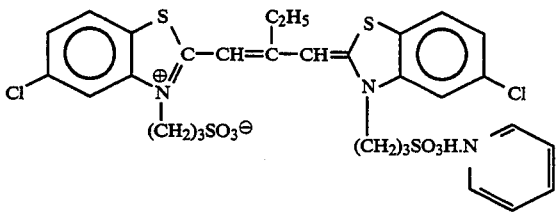
ExS-3
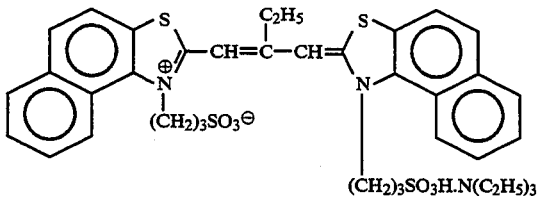
ExS-4
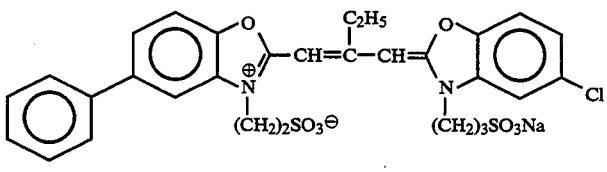
ExS-5
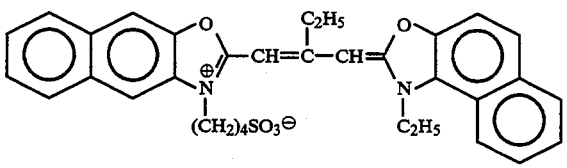
ExS-6
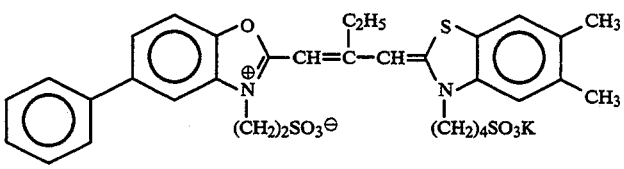
ExS-7
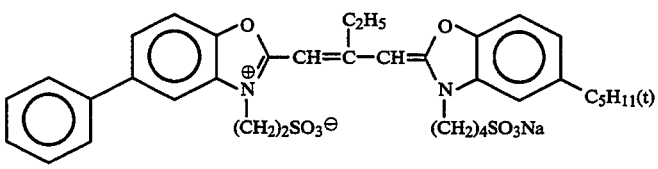
ExS-8
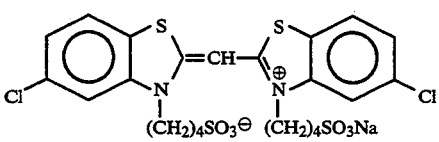
B-1
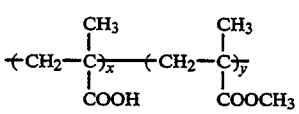
x/y = 10/90 (weight ratio)
number average molecular weight: 20,000
B-2
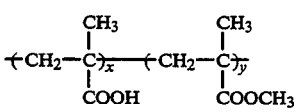
x/y = 40/60 (weight ratio)
number average molecular weight: 20,000

-continued
B-3
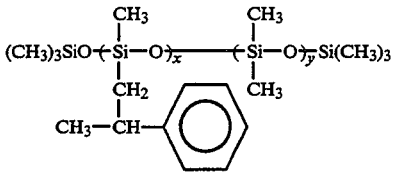
x/y = 29/46 (weight ratio)
number average molecular weight: 10,000
B-4
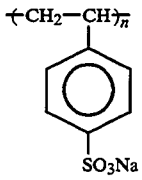
mean molecular weight: 10,000
H-1
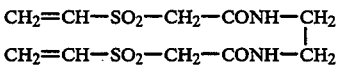
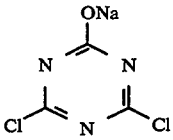
1:1 (mol ratio) mixture
W-1
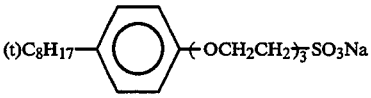
W-2
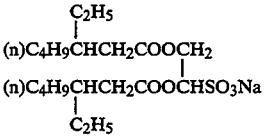
W-3
$C_8F_{17}SO_2N(C_3H_7)CH_2COOK$
W-4
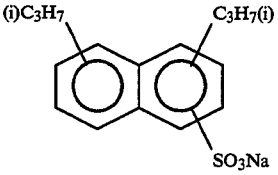
W-5
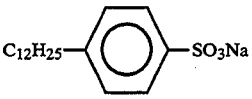
Vinylpyrrolidone/vinyl alcohol copolymer
(Copolymer ratio (by weight) = 70:30)
P-1
Poly(ethyl acrylate)
P-2
F-1
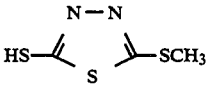
F-4
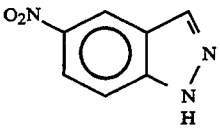

-continued

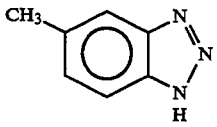

F-5

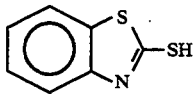

F-6

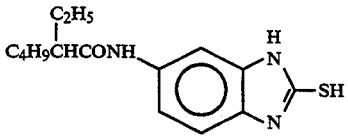

F-7

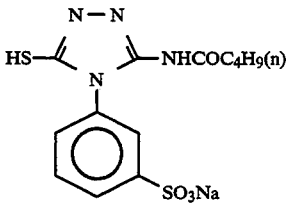

F-8

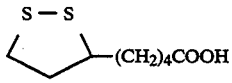

F-9

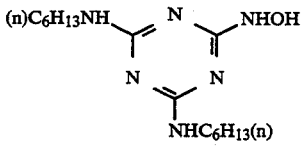

F-10

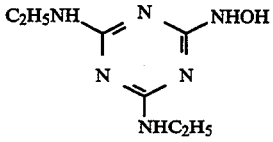

F-11

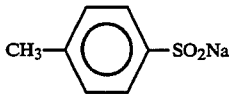

F-13

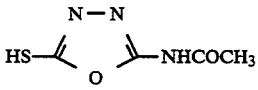

F-14

Next, samples 302 et seq. were prepared by modifying some of the couplers in the third to fifth layers (red sensitive emulsion layers) and eleventh and twelfth layers (blue sensitive emulsion layers) as shown in Table 3-1. Moreover, the amounts of the yellow colored cyan couplers used were, in terms of the coated weights, $2.0\times10^{-5}$ mol/m$^2$ in the third layer, $4.5\times10^{-5}$ mol/m$^2$ in the fourth layer and $2.5\times10^{-5}$ mol/m$^2$ in the fifth layer. Furthermore, the couplers modified as shown in Table 3-1 were replaced in equimolar amounts with the coated weights of couplers in sample 301, and the samples were prepared using the same procedure as for sample 301 with no other modification. However, with samples 310 and 311, the ExY-13 used in the fourth layer, a red sensitive emulsion layer, was replaced by an equimolar amount of (Y-60), and the ExY-14 was replaced by an equimolar amount of (Y-63), and the ExY-13 used in the seventh and eighth layers (green sensitive emulsion layers) was similarly replaced by an equimolar amount of (Y-60).

TABLE 3-1

| Sample No. | Red Sensitive Emulsion Layer: Third and Fourth Layers | Red Sensitive Emulsion Layer: Fifth Layer | Blue Sensitive Emulsion Layer: Eleventh Layer | Blue Sensitive Emulsion Layer: Twelfth Layer |
|---|---|---|---|---|
| 301 (Comparative Example) | ExC-3 | ExC-6 | ExY-15 ExY-13 | ExY-15 |
| 302 (Comparative Example) | ExC-3 YC-30 | ExC-6 YC-30 | ExY-15 ExY-13 | ExY-15 |
| 303 (Comparative Example) | ExC-3 | ExC-6 | Y-9 ExY-13 | Y-9 |
| 304 (This Invention) | ExC-3 YC-30 | ExC-6 YC-30 | Y-9 ExY-13 | Y-9 |
| 305 (This Invention) | C-7 YC-30 | C-34 YC-30 | Same as above | Same as above |
| 306 (This Invention) | C-14 YC-30 | C-35 YC-30 | Same as above | Same as above |
| 307 (This Invention) | C-23 YC-30 | C-37 YC-30 | Same as above | Same as above |
| 308 (This Invention) | C-15 YC-30 | C-40 YC-30 | Same as above | Same as above |
| 309 (This Invention) | C-7 YC-30 | C-34 YC-30 | Y-9 Y-60 | Same as above |
| 310 (This Invention) | ExC-3 YC-30 | ExC-6 YC-30 | ExY-15 ExY-13 | ExY-15 |
| 311 (This Invention) | C-7 YC-30 | C-34 Yc-30 | Y-9 Y-60 | Y-9 |
| 312 (This Invention) | C-7/C-10 = 1/1 (Mol Ratio) YC-30 | C-34 YC-30 | Y-9/Y-48 = 1/1 (Mol Ratio) ExY-13 | Y-9/Y-48 = 1/1 (Mol Ratio) |

*Samples 310, 311
The equimolar replacements indicated below were made in these samples:
Fourth Layer (Red sensitive emulsion layer):
ExY-13 → (Y-60)
ExY-14 → (Y-63)
Seventh and Eighth Layers (Blue sensitive emulsion layers):
ExY-13 → (Y-60)

The prepared samples were cut and finished and then subjected to testing in accordance with the methods indicated under (1-1) to (1-5) in Example 1.

Moreover, the processing used in this example was as indicated below and the method of continuous processing was the same as in Example 1.

The results obtained are summarized in Table 3-2.

| Process | Processing Time | Processing Temp. | Replenishment Rate | Tank Capacity |
|---|---|---|---|---|
| Color Development | 3 min. 15 sec. | 38° C. | 33 ml | 10 liters |
| Bleaching | 6 min. 30 sec. | 38° C. | 25 ml | 20 liters |
| Water Washing | 2 min. 10 sec. | 24° C. | 1200 ml | 10 liters |
| Fix | 4 min. 20 sec. | 38° C. | 25 ml | 20 liters |
| Water Washing (1) | 1 min. 05 sec. | 24° C. | Counter-flow system from (2) to (1) | 10 liters |
| Water Washing (2) | 1 min. 00 sec. | 24° C. | 1200 ml | 10 liters |
| Stabilization | 1 min. 05 sec. | 38° C. | 25 ml | 10 liters |
| Drying | 4 min. 20 sec. | 55° C. | | |

Replenishment rate per meter length of 35 mm wide material.

The composition of each processing bath is indicated below.

| | Mother Liquor (grams) | Replenisher (grams) |
|---|---|---|
| Color Developer | | |
| Diethylenetriamine penta-acetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxy-ethylaminol]-2-methylaniline sulfate | 4.5 | 5.5 |
| Water to make up to | 1.0 liter | 1.0 liter |
| pH | 10.05 | 10.10 |
| Bleaching Solution | | |
| Ethylenediamine tetra-acetic acid ferric ammonium salt.tri-hydrate | 100.0 | 120.0 |
| Ethylenediamine tetra- | 10.0 | 11.0 |

-continued

| | Mother Liquor (grams) | Replenisher (grams) |
|---|---|---|
| acetic acid di-sodium salt | | |
| Ammonium bromide | 140.0 | 160.0 |
| Ammonium nitrate | 30.0 | 35.0 |
| Aqueous ammonia (27%) | 6.5 ml | 4.0 ml |
| Water to make up to | 1.0 liter | 1.0 liter |
| pH | 6.0 | 5.7 |
| Fixing Solution | | |
| Ethylenediamine tetra-acetic acid di-sodium salt | 0.5 | 0.7 |
| Sodium sulfite | 7.0 | 8.0 |
| Sodium bisulfite | 5.0 | 5.5 |
| Aqueous ammonium thio-sulfate solution (700 g/l) | 170.0 ml | 200.0 ml |
| Water to make up to | 1.0 liter | 1.0 liter |
| pH | 6.7 | 6.6 |
| Stabilizing Solution | | |
| Formalin (37%) | 2.0 ml | 3.0 ml |
| Polyoxyethylene p-monononyl-phenyl ether (average degree of polymerization 10) | 0.3 | 0.45 |
| Ethylenediamine tetra-acetic acid di-sodium salt | 0.05 | 0.08 |
| Water to make up to | 1.0 liter | 1.0 liter |
| pH | 5.0–8.0 | 5.0–8.0 |

Furthermore, when the cyan coupler was changed to a coupler represented by the aforementioned formula (C), it was clear from a comparison of sample 304 and samples 305–309, 311 and 312 that there was a further improvement in the above mentioned properties.

Moreover, samples 310 and 311 which fulfilled the structural requirements of the present invention were samples in which couplers of the type in which the leaving group of the acyl acetamide yellow coupler having an acyl group represented by the aforementioned general formula (A) was a group which exhibited a development inhibiting action were used in the red sensitive emulsion layers and the green sensitive emulsion layers. On comparing samples 310 and 311 with sample 302 it is clear that sample 311 was especially superior with respect to the various aspects of performance described above. On the other hand, on comparing sample 310 with sample 302, sample 310 was a sample in which a smaller quantity of an acyl acetamide yellow coupler having an acyl group represented by formula (A) which had a leaving group which released development inhibitor was used, but even though a smaller amount had been used it can be seen from the Table that the various properties aforementioned were improved.

TABLE 3-2

| Sample | Photographic Properties · Speed | | Photographic Properties · Color Density | | Continuous processing | | Aging and Storing of Sensitive Material | | Colored Image Fastness | | Color Turbidity | |
|---|---|---|---|---|---|---|---|---|---|---|---|---|
| No. | $S_B$ | $S_R$ | $D_B$ | $D_R$ | $\Delta S_{B1}$ | $\Delta S_{R1}$ | $\Delta S_{B2}$ | $\Delta S_{R2}$ | $\Delta D_B$ | $\Delta D_G$ | $\Delta D_R$ | $\Delta D_Y$ |
| 301 (Comparative-Example) | 0.00 (Standard) | 0.00 (Standard) | 0.00 (Standard) | 0.00 (Standard) | −0.05 | −0.05 | +0.05 | +0.06 | −0.15 | −0.04 | −0.09 | +0.15 |
| 302 (Comparative-Example) | 0.00 | +0.02 | 0.00 | +0.05 | −0.05 | −0.04 | +0.05 | +0.04 | −0.15 | −0.04 | −0.07 | +0.10 |
| 303 (Comparative-Example) | +0.02 | 0.00 | +0.06 | 0.00 | −0.03 | −0.05 | +0.03 | +0.06 | −0.08 | −0.04 | −0.09 | +0.14 |
| 304 (This Invention) | +0.04 | +0.04 | +0.10 | +0.07 | −0.02 | −0.03 | +0.02 | +0.03 | −0.06 | −0.04 | −0.06 | +0.09 |
| 305 (This Invention) | +0.05 | +0.07 | +0.12 | +0.14 | −0.02 | −0.01 | +0.02 | +0.01 | −0.06 | −0.04 | −0.03 | +0.06 |
| 306 (This Invention) | +0.05 | +0.06 | +0.12 | +0.12 | −0.02 | −0.02 | +0.02 | +0.01 | −0.06 | −0.04 | −0.04 | +0.07 |
| 307 (This Invention) | +0.05 | +0.07 | +0.12 | +0.14 | −0.02 | −0.01 | +0.02 | +0.01 | −0.06 | −0.04 | −0.04 | +0.06 |
| 308 (This Invention) | +0.05 | +0.06 | +0.12 | +0.13 | −0.02 | +0.02 | +0.02 | +0.02 | −0.06 | −0.04 | −0.04 | +0.06 |
| 309 (This Invention) | +0.06 | +0.07 | +0.14 | +0.14 | −0.01 | −0.01 | +0.01 | +0.01 | −0.03 | −0.04 | −0.03 | +0.06 |
| 310 (This Invention) | +0.02 | +0.05 | +0.02 | +0.08 | −0.04 | −0.03 | +0.04 | +0.02 | −0.13 | −0.02 | −0.05 | +0.09 |
| 311 (This Invention) | +0.06 | +0.07 | +0.14 | +0.14 | −0.01 | 0.00 | +0.01 | +0.01 | −0.03 | −0.02 | −0.02 | +0.06 |
| 312 (This Invention) | +0.07 | +0.07 | +0.15 | +0.14 | −0.01 | −0.01 | +0.01 | +0.01 | −0.03 | −0.04 | −0.03 | +0.06 |

It is clear from the results shown in Table 3-2 that samples 304–309, 311 and 312 which satisfied the structural requirements of the present invention had higher photographic speeds and color densities and exhibited less fluctuation in speed with continuous processing than comparative samples 301–303, that they had superior photographic properties in that the changes in speed on aging and storing the sensitive material were small and, moreover, that with respect to the image storage properties the fastness was superior, the tri-color yellow, magenta, cyan color fading balance was good and color reproduction was good with little color turbidity.

Next, on investigating the sharpness (MTF values, 20 and 40 cycles/mm) of the magenta images of samples 302, 310 and 311 in the usual way it was found that samples 310 and 311 exhibited values 1–3 higher than sample 302 and an improvement was confirmed.

EXAMPLE 4

Samples 101 and 110 of Example 1 were taken as a basis for the preparation of samples in which the high boiling point organic solvent HBS-1 used in the blue sensitive emulsion layers (11th layer to 13th layer) was modified as shown in Table 4-1, the remainder of the compositions being unchanged.

TABLE 4-1

| Sample No. | Eleventh-Thirteenth Layer (Yellow-Coupler) | HBS-1 [g/m²] Eleventh Layer | Twelfth Layer | Thirteenth Layer |
|---|---|---|---|---|
| 101 (Comparative Example) | | 0.41 | 0.09 | 0.11 |
| 401 (Comparative Example) | EX-9 | 0.16 | 0.03 | 0.04 |
| 402 (Comparative Example) | | 0.08 | 0.02 | 0.02 |
| 110 (This Invention) | | 0.41 | 0.09 | 0.11 |
| 403 (This Invention) | Y-9 | 0.16 | 0.03 | 0.04 |
| 404 (This Invention) | | 0.08 | 0.02 | 0.02 |

The prepared samples were evaluated in terms of performance as described in (1-1) to (1-4) in Example 1 using the same method of processing.

The results obtained on measuring with blue light (B) only are summarized in Table 4-1.

TABLE 4-2

| Sample No. | Photographic Properties · Speed ($S_B$) | Photographic Properties · Color Density ($D_B$) | Continuous Processing ($\Delta S_{B1}$) | Aging and Storing of Sensitive Material ($\Delta S_{B2}$) | Colored Image Fastness ($\Delta D_B$) |
|---|---|---|---|---|---|
| 101 (Comparative Example) | 0.00 Standard | 0.00 Standard | −0.06 | +0.06 | −0.10 |
| 401 (Comparative Example) | −0.03 | −0.09 | −0.08 | +0.07 | −0.15 |
| 402 (Comparative Example) | −0.08 | −0.28 | −0.12 | +0.10 | −0.23 |
| 110 (This Invention) | +0.06 | +0.11 | −0.02 | +0.02 | −0.06 |
| 403 (This Invention) | +0.06 | +0.11 | −0.02 | +0.02 | −0.06 |
| 404 (This Invention) | +0.05 | +0.08 | −0.03 | +0.03 | −0.08 |

It is clear from the results in Table 4-2 that samples 110, 403 and 404 in which acyl acetamide yellow couplers having acyl groups represented by the aforementioned general formula (A) had been used had better photographic properties such as speed and color density and better photographic properties such as speed on continuous processing and speed on aging and storing the light-sensitive material as a result of reducing the amount of high boiling point organic solvent than comparative samples 101, 401 and 402 and, moreover, they exhibited superior performance with respect to the fastness of the colored image and that the extent of deterioration was vary small.

Thus, it is thought that reducing the amount of high boiling point organic solvent used in the layers which are located furthest from the support in the structural layers of the sensitive material is desirable in that it results in increased image quality in the lower layers, and also in particular increases sharpness and stability in color development processing.

EFFECT OF THE INVENTION

Silver halide color photographic light-sensitive materials which contain yellow colored cyan couplers and acyl acetamide yellow couplers having acyl groups represented by general formula (A) of the present invention exhibit excellent performance, giving high speed and high color densities, having little variation in speed in continuous processing or on aging and storing the light-sensitive material, a fast colored image and little color tubidity. Hence, the present invention can provide silver halide color photographic light-sensitive materials which have improved color reproduction, fast colored images, a good tri-color balance in terms of color fading and stable photographic performance.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one light-sensitive silver halide emulsion layer, wherein the light-sensitive material contains a yellow colored cyan coupler and an acylacetamide yellow dye forming coupler represented by the general formula (Y):

(Y)

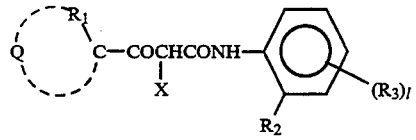

wherein in formula (Y), $R_1$ represents a univalent group other than a hydrogen atom, Q represents a group of non-metal atoms which forms, together with C, a three to five membered hydrocarbon ring or a three to five membered heterocyclic ring containing within it at least one heteroatom selected from among N, S, O and P, $R_2$ represents a hydrogen atom, a halogen atom, an alkoxy group, an aryloxy group, an alkyl group or an amino group, $R_3$ is selected from the group consisting of halogen atoms, alkoxy groups, alkoxycarbonyl groups, carbonamido groups, sulfonamido groups, carbamoyl groups, sulfamoyl groups, alkylsulfonyl groups, acyloxy groups and a cyano group, X represents a hydrogen atom or a group which can be eliminated by means of a coupling reaction with the oxidized product of a primary aromatic amine developing agent, l represents an integer of from 0 to 4, and when l is 2 or more, the $R_3$ groups may be the same or different; said coupler may form a bis compound, a dimer, or a polymer by bonding together via a single bond, a divalent or a higher valent group at $R_1$, Q, X or

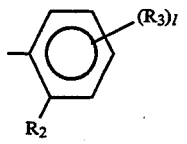

said yellow colored cyan couplers are represented by formulae (CI) and (CII):

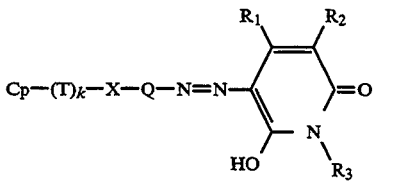

(CI)

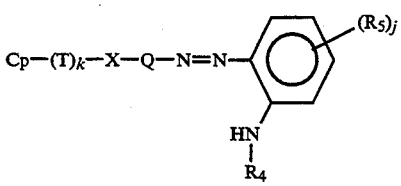

(CII)

wherein in formula (CI) and (CII), Cp represents a cyan coupler residual group, T represents a timing group bonded to the coupling position of Cp, k represents an integer of 0 or 1, X represents a divalent linking group containing N, O or S, and which is bonded with $(T)_k$ by the N, O or S, and connected with Q, and Q represents an arylene group or a divalent heterocyclic group;

in formula (CI) $R_1$ and $R_2$ each represents a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group or an alkylsulfonyl group, and $R_3$ represents a hydrogen atom, an alkyl group, a cycloalkyl group, an aryl group or a heterocyclic group and at least one of X, Q, $R_1$, $R_2$ and $R_3$ contains a water solubilizing group;

in formula (CII) $R_4$ represents an acyl group or an alkyl or aryl sulfonyl group, $R_5$ represents a group substitutable to the benzene ring, and j represents an integer from 0 to 4; when j is 2 or more, the $R_5$ groups may be the same or different and at least one of X, Q, $R_4$ and $R_5$ contains a water solubilizing group.

2. The silver halide color photographic light-sensitive material of claim 1, wherein the light-sensitive material further contains a naphthol cyan dye forming coupler represented by the general formula (C):

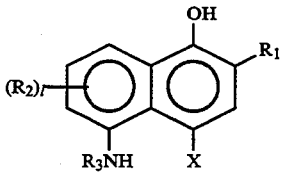

(C)

wherein $R_1$ represents $-CONR_4R_5$, $-SO_2NR_4R_5$, $-NHCOR_4$, $-NHCOOR_6$, $-NHSO_2R_6$, $-NHCONR_4R_5$ or $-NHSO_2NR_4R_5$, $R_2$ represents a group which can be substituted on a naphthalene ring, l represents an integer of from 0 to 3, $R_3$ represents a substituent, and X represents a hydrogen atom or a group which can be eliminated by a coupling reaction with the oxidized product of a primary aromatic amine developing agent, $R_4$ and $R_5$ which may be the same or different each represents a hydrogen atom, an alkyl group, an aryl group or a heterocyclic group, $R_6$ represents an alkyl group, an aryl group or a heterocyclic group, when l represents 2 or more, the $R_2$ groups may be the same or different, or they may be joined together to form a ring, $R_2$ and $R_3$, or $R_3$ and X, may be joined together to form a ring; said coupler may form a bis compound, a dimer or a polymer by bonding together via a single bond, a divalent group or a higher valent group at $R_1$, $R_2$, $R_3$ or X.

3. The silver halide color photographic light-sensitive material of claim 1, wherein the yellow colored cyan coupler is a cyan coupler which can release a water soluble compound residual group containing a group selected from the group consisting of a 6-hydroxy-2-pyridon-5-ylazo group, 2-acylaminophenylazo group, 2-sulfonamidophenylazo group and pyrazolo-4-ylazo group by a reaction with an oxidized product of a primary aromatic amine developing agent.

4. The silver halide color photographic light-sensitive material of claim 1, wherein $R_1$ in formula (Y) is a halogen atom or a univalent group which has 1–60 carbon atoms.

5. The silver halide color photographic light-sensitive material of claim 4, wherein said univalent group is an alkyl group, an alkoxy group, an aryl group, an aryloxy group, an acyl group, or an amino group.

6. The silver halide color photographic light-sensitive material of claim 5, wherein a substituent on said univalent group is selected from the group consisting of a halogen atom, an alkyl group, an aryl group, an alkoxy group, a nitro group, a substituted or unsubstituted amino group, a carbonamido group, a sulfonamido group and an acryl group.

7. The silver halide color photographic light sensitive material of claim 4, wherein $R_1$ in formula (Y) is a cyano group.

8. The silver halide color photographic light-sensitive material of claim 1, wherein Q in formula (Y) represents a group of non-metal atoms which, together with C, forms a three to five membered hydrocarbon ring having from 3 to 30 carbon atoms or a heterocyclic ring having 2 to 30 carbon atoms which contains within the ring at least one hetero atom selected from among N, S, O and P, which may be substituted with substituents, and the rings formed by Q together with C may contain unsaturated bonds within the ring.

9. The silver halide color photographic light-sensitive material of claim 1, wherein the ring formed by together with C is selected from the group consisting of a cyclopropane ring, a cyclobutane ring, a cyclopentane ring, a cyclopropene ring, a cyclobutene ring, a cyclopentene, an oxetene ring, an oxolane ring, a 1,3-dioxolane ring, a thietane ring, a thiolane ring, and a pyrrolidine ring.

10. The silver halide color photographic light-sensitive material of claim 8, wherein a substituent of the ring is selected from the group consisting of a halogen atom, a hydroxyl group, an alkyl group, an aryl group, an acyl group, an alkoxy group, an aryloxy group, a cyano group, an alkoxycarbonyl group, an alkylthio group, an arylthio group, and a group formed by connecting these substituents to form a condensed hydrocarbon ring or a condensed heterocyclic ring containing at least one of O, S and N atoms as hetero-atom.

11. The silver halide color photographic light-sensitive material of claim 1, wherein $R_2$ in formula (Y) represents a halogen atom, an alkoxy group having from 1 to 30 carbon atoms, an aryloxy group having from 6 to 30 carbon atoms, an alkyl group having from 1 to 30 carbon atoms or an amino group having from 0 to 30 carbon atoms.

12. The silver halide color photographic light-sensitive material of claim 11, wherein a substituent of $R_2$ is selected from the group consisting of a halogen atom, an alkyl group, an alkoxy group, and an aryloxy group, and substituents on the substituted amino group may be connected to form a heterocyclic group containing the nitrogen atom in the amino group.

13. The silver halide color photographic light-sensitive material of claim 1, wherein $R_3$ in formula (Y) is a halogen atom, an alkoxy group having from 1 to 30 carbon atoms, an alkoxycarbonyl group having from 2 to 30 carbon atoms, a carbonamido group having from 1 to 30 carbon atoms, a sulfonamido group having from 1 to 30 carbon atoms, a carbamoyl group having from 1 to 30 carbon atoms, a sulfamoyl group having from 0 to 30 carbon atoms, an alkylsulfonyl group having from 1 to 30 carbon atoms, an acyloxy group or a cyano group.

14. The silver halide color photographic light-sensitive material of claim 13, wherein a substituent of $R_3$ is selected from the group consisting of a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group and an arylsulfonyloxy group.

15. The silver halide color photographic light-sensitive material of claim 1, wherein l represents 1 or 2 and the substitution position of $R_3$ is in the meta- or para-position with respect to

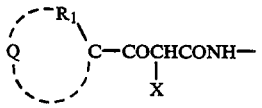

group.

16. The silver halide color photographic light-sensitive material of claim 1, wherein the yellow coupler represented by general formula (A) is present in an amount within the range of from 1.0 to $1.0\times10^{-3}$ mol per mol of silver halide.

17. The silver halide color photographic light-sensitive material of claim 1, wherein said yellow coupler represented by formula (A) is incorporated into at least one of said at least one silver halide emulsion layer and a light-insensitive layer adjacent thereto.

18. The silver halide color photographic light-sensitive material of claim 1, wherein said yellow colored cyan coupler is a cyan coupler in which the maximum absorption in the visible absorption range of the coupler is between 400 nm and 500 nm and which couples with the oxidized product of a primary aromatic amine developing agent and forms a cyan dye of which the maximum absorption in the visible absorption region is between 630 nm and 750 nm.

19. The silver halide color photographic light-sensitive material of claim 1, wherein Cp in general formulae (CI) to (CIV) is represented by formula (Cp-6), (Cp-7) or (Cp-8):

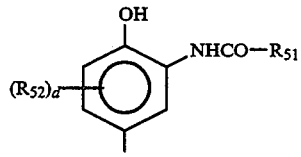

(Cp-6)

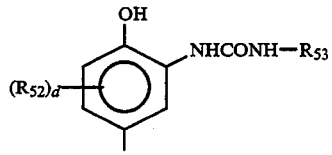

(Cp-7)

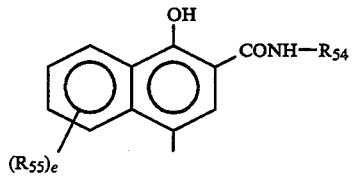

(Cp-8)

wherein the free bond derived from the coupling position represents the bonding position of the coupling leaving group; and the total number of carbon atoms in $R_{51}$, $R_{52}$, $R_{53}$, $R_{54}$ or $R_{55}$ when these groups contain a ballast group is from 8 to 40, and in other cases the total number of carbon atoms is not more than 15;

below $R_{41}$ represents an aliphatic group, an aromatic group or a heterocyclic group, $R_{42}$ represents an aromatic group or a heterocyclic group, and $R_{43}$, $R_{44}$ and $R_{45}$ each represents a hydrogen atom, an aliphatic group, aromatic groups or a heterocyclic group;

$R_{51}$ represents a group having the same meaning as $R_{41}$; $R_{52}$ represents a group which has the same meaning as

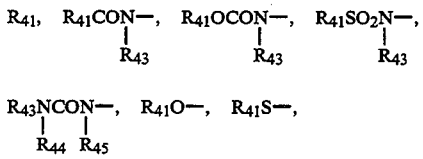

a halogen atom or

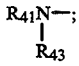

d represents an integer of from 0 to 3; e represents an integer of from 1 to 4; when d is plural, the $R_{52}$ groups may be the same or different, the $R_{52}$ groups may be divalent groups which are joined to form a ring structure; $R_{53}$ represents a group which has the same meaning as $R_{41}$, when e is 2 or more, the $R_{55}$ groups may be the same or different; and $R_{54}$ represents a group which has the same meaning as $R_{41}$, and $R_{55}$ represents a group which has the same meaning as $R_{41}$, $R_{41}OCONH$—, $R_{41}SO_2NH$—,

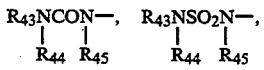

$R_{43}O$—, $R_{41}S$—, a halogen atom or

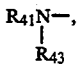

and when there is a plurality of $R_{55}$ groups they may be the same or different.

20. The silver halide color photographic light-sensitive material of claim 1, wherein the yellow colored cyan coupler is added to least one of said at least one light-sensitive silver halide emulsion layer and a layer adjacent thereto.

21. The silver halide color photographic light-sensitive material of claim 1, wherein the yellow colored cyan coupler is added to a red sensitive emulsion layer.

22. The silver halide color photographic light-sensitive material of claim 1, wherein the yellow colored cyan coupler is added to a light-sensitive material in an amount of 0.005 to 0.30 $g/m^2$.

* * * * *